US010337251B2

(12) United States Patent
Clausen et al.

(10) Patent No.: US 10,337,251 B2
(45) Date of Patent: Jul. 2, 2019

(54) DOWNHOLE ADJUSTABLE BEND ASSEMBLIES

(71) Applicant: National Oilwell DHT, L.P., Houston, TX (US)

(72) Inventors: Jeffery Ronald Clausen, Tulsa, OK (US); Nicholas Ryan Marchand, Edmonton (CA)

(73) Assignee: National Oilwell DHT, L.P., Houston, TX (US)

( * ) Notice: Subject to any disclaimer, the term of this patent is extended or adjusted under 35 U.S.C. 154(b) by 0 days.

(21) Appl. No.: 16/007,545

(22) Filed: Jun. 13, 2018

(65) Prior Publication Data

US 2018/0363380 A1 Dec. 20, 2018

Related U.S. Application Data

(63) Continuation of application No. PCT/US2018/034721, filed on May 25, 2018.

(60) Provisional application No. 62/663,723, filed on Apr. 27, 2018, provisional application No. 62/582,672, filed on Nov. 7, 2017, provisional application No. 62/511,148, filed on May 25, 2017.

(51) Int. Cl.
*E21B 7/06* (2006.01)
*E21B 4/02* (2006.01)

(52) U.S. Cl.
CPC ..... *E21B 7/067* (2013.01); *E21B 4/02* (2013.01); *E21B 7/062* (2013.01); *E21B 7/068* (2013.01)

(58) Field of Classification Search
CPC ..... E21B 7/067; E21B 7/068
See application file for complete search history.

(56) References Cited

U.S. PATENT DOCUMENTS

| | | | | |
|---|---|---|---|---|
| 5,117,927 | A * | 6/1992 | Askew | E21B 7/067 175/325.2 |
| 6,394,193 | B1 | 5/2002 | Askew | |
| 9,605,481 | B1 * | 3/2017 | Bleeker | E21B 3/00 |
| 2016/0290049 | A1 | 10/2016 | Kedare et al. | |
| 2017/0089142 | A1 | 3/2017 | Schaaf | |

OTHER PUBLICATIONS

International Search Report and Written Opinion dated Oct. 10, 2018, for International Application No. PCT/US2018/034721.

* cited by examiner

*Primary Examiner* — Giovanna C Wright
(74) *Attorney, Agent, or Firm* — Conley Rose, P.C.

(57) ABSTRACT

A bend adjustment assembly for a downhole mud motor includes a driveshaft housing, a driveshaft disposed in the driveshaft housing, a bearing mandrel, wherein the bend adjustment assembly includes a first position that provides a first deflection angle between a longitudinal axis of the driveshaft housing and a longitudinal axis of the bearing mandrel, wherein the bend adjustment assembly includes a second position that provides a second deflection angle between the longitudinal axis of the driveshaft housing and the longitudinal axis of the bearing mandrel, and an actuator assembly configured to shift the bend adjustment assembly between the first position and the second position in response to a change in at least one of flowrate of a drilling fluid supplied to the downhole mud motor, pressure of the drilling fluid supplied to the downhole mud motor, and relative rotation between the driveshaft housing and the bearing mandrel.

56 Claims, 29 Drawing Sheets

DOWNHOLE ADJUSTABLE BEND ASSEMBLIES

CROSS-REFERENCE TO RELATED APPLICATIONS

This application is a continuation of international application No. PCT/US2018/034721 filed May 25, 2018, and entitled "Downhole Adjustable Bend Assemblies," which claims benefit of U.S. provisional patent application No. 62/511,148 filed May 25, 2017, entitled "Downhole Adjustable Bend Assembly," U.S. provisional patent application No. 62/582,672 filed Nov. 7, 2017, entitled "Downhole Adjustable Bend Assembly," and U.S. provisional patent application No. 62/663,723 filed Apr. 27, 2018, entitled "Downhole Adjustable Bend Assemblies," each of which are hereby incorporated herein by reference in its entirety.

STATEMENT REGARDING FEDERALLY SPONSORED RESEARCH OR DEVELOPMENT

Not applicable.

BACKGROUND

In drilling a borehole into an earthen formation, such as for the recovery of hydrocarbons or minerals from a subsurface formation, it is typical practice to connect a drill bit onto the lower end of a drillstring formed from a plurality of pipe joints connected together end-to-end, and then rotate the drillstring so that the drill bit progresses downward into the earth to create a borehole along a predetermined trajectory. In addition to pipe joints, the drillstring typically includes heavier tubular members known as drill collars positioned between the pipe joints and the drill bit. The drill collars increase the weight applied to the drill bit to enhance its operational effectiveness. Other accessories commonly incorporated into drillstrings include stabilizers to assist in maintaining the desired direction of the drilled borehole, and reamers to ensure that the drilled borehole is maintained at a desired gauge (i.e., diameter). In vertical drilling operations, the drillstring and drill bit are typically rotated from the surface with a top dive or rotary table. Drilling fluid or "mud" is typically pumped under pressure down the drillstring, out the face of the drill bit into the borehole, and then up the annulus between the drillstring and the borehole sidewall to the surface. The drilling fluid, which may be water-based or oil-based, is typically viscous to enhance its ability to carry borehole cuttings to the surface. The drilling fluid can perform various other valuable functions, including enhancement of drill bit performance (e.g., by ejection of fluid under pressure through ports in the drill bit, creating mud jets that blast into and weaken the underlying formation in advance of the drill bit), drill bit cooling, and formation of a protective cake on the borehole wall (to stabilize and seal the borehole wall).

In some applications, horizontal and other non-vertical or deviated boreholes are drilled (i.e., "directional drilling") to facilitate greater exposure to and production from larger regions of subsurface hydrocarbon-bearing formations than would be possible using only vertical boreholes. In directional drilling, specialized drillstring components and "bottomhole assemblies" (BHAs) may be used to induce, monitor, and control deviations in the path of the drill bit, so as to produce a borehole of the desired deviated configuration. Directional drilling may be carried out using a downhole or mud motor provided in the BHA at the lower end of the drillstring immediately above the drill bit. Downhole mud motors may include several components, such as, for example (in order, starting from the top of the motor): (1) a power section including a stator and a rotor rotatably disposed in the stator; (2) a driveshaft assembly including a driveshaft disposed within a housing, with the upper end of the driveshaft being coupled to the lower end of the rotor; and (3) a bearing assembly positioned between the driveshaft assembly and the drill bit for supporting radial and thrust loads. For directional drilling, the motor may include a bent housing to provide an angle of deflection between the drill bit and the BHA. The axial distance between the lower end of the drill bit and bend in the motor is commonly referred to as the "bit-to-bend" distance.

BRIEF SUMMARY OF THE DISCLOSURE

An embodiment of a bend adjustment assembly for a downhole mud motor comprises a driveshaft housing, a driveshaft rotatably disposed in the driveshaft housing, a bearing mandrel coupled to the driveshaft, wherein the bend adjustment assembly includes a first position that provides a first deflection angle between a longitudinal axis of the driveshaft housing and a longitudinal axis of the bearing mandrel, wherein the bend adjustment assembly includes a second position that provides a second deflection angle between the longitudinal axis of the driveshaft housing and the longitudinal axis of the bearing mandrel that is different from the first deflection angle, and an actuator assembly configured to shift the bend adjustment assembly between the first position and the second position in response to a change in at least one of flowrate of a drilling fluid supplied to the downhole mud motor, pressure of the drilling fluid supplied to the downhole mud motor, and relative rotation between the driveshaft housing and the bearing mandrel. In some embodiments, the actuator assembly comprises an actuator housing through which the bearing mandrel extends, an actuator piston coupled to the actuator housing, wherein the actuator piston comprises a first plurality of teeth, and a teeth ring coupled to the bearing mandrel and comprising a second plurality of teeth, wherein the actuator piston is configured to matingly engage the first plurality of teeth with the second plurality of teeth of the teeth ring to transfer torque between the actuator housing and the bearing mandrel in response to the change in at least one of flowrate and pressure of the drilling fluid supplied to the downhole mud motor. In some embodiments, the actuator assembly further comprises a biasing member configured to bias the first plurality of teeth of the actuator piston into mating engagement with the second plurality of teeth of the teeth ring. In certain embodiments, the actuator assembly comprises a biasing member configured to apply a mechanical force against the actuator piston to bias the actuator piston in a first axial direction and to apply a hydraulic force against the actuator piston to bias the actuator piston in a second axial direction opposite the first axial direction. In certain embodiments, the bend adjustment assembly further comprises an offset housing comprising a first longitudinal axis and a first offset engagement surface concentric to a second longitudinal axis that is offset from the first longitudinal axis, an adjustment mandrel comprising a third longitudinal axis and a second offset engagement surface concentric to a fourth longitudinal axis that is offset from the third longitudinal axis, wherein the second offset engagement surface is in mating engagement with the first offset engagement surface, and a locking piston disposed in the offset housing, wherein the locking piston comprises a locked position restricting relative rotation between the offset housing and the adjustment mandrel, and an unlocked position, axially spaced from the locked position, permitting relative rotation between the offset housing and the adjustment mandrel, wherein the locking piston is configured to shift between the locked position and the unlocked position in response to a change in at least one of flowrate and pressure of the drilling fluid supplied to the downhole mud motor. In some embodiments, the bend adjustment assembly is locked in at least one of the first and second positions when the locking piston is disposed in the locked position. In some embodiments, the bend adjustment assembly further comprises a first annular seal disposed on an outer surface of the locking piston, a second annular seal disposed on an outer surface of a compensating piston of the bend adjustment assembly, a sealed chamber extending axially between the first annular seal and the second annular seal, and a biasing member in engagement with the compensating piston, wherein the biasing member biases the locking piston towards the unlocked position. In certain embodiments, the bend adjustment assembly further comprises an offset housing comprising a first longitudinal axis and a first offset engagement surface concentric to a second longitudinal axis that is offset from the first longitudinal axis, an adjustment mandrel comprising a third longitudinal axis and a second offset engagement surface concentric to a fourth longitudinal axis that is offset from the third longitudinal axis, wherein the second offset engagement surface is in mating engagement with the first offset engagement surface, and a locking piston disposed in the offset housing about the driveshaft, and wherein the locking piston is configured to alter a restriction to fluid flow of the drilling fluid supplied to the downhole mud motor in response to shifting the locking piston between a first axial position and a second axial position. In some embodiments, the bend adjustment assembly further comprises a thrust bearing assembly including a vibration race having a nonplanar engagement surface. In some embodiments, the bend adjustment assembly further comprises an offset housing comprising a first longitudinal axis and a first offset engagement surface concentric to a second longitudinal axis that is offset from the first longitudinal axis, and an adjustment mandrel comprising a third longitudinal axis and a second offset engagement surface concentric to a fourth longitudinal axis that is offset from the third longitudinal axis, wherein the second offset engagement surface is in mating engagement with the first offset engagement surface, the offset housing comprises an arcuate extension concentric to the second longitudinal axis and defined by a first pair of circumferentially spaced shoulders, the adjustment mandrel comprises a first arcuate groove concentric to the fourth longitudinal axis and defined by a second pair of circumferentially spaced shoulders, a first shoulder of the first pair of shoulders contacts a first shoulder of the second pair of shoulders when the bend adjustment assembly is in the first position, and a second shoulder of the first pair of shoulders contacts a second shoulder of the second pair of shoulders when the bend adjustment assembly is in the second position.

An embodiment of a bend adjustment assembly for a downhole mud motor comprises an offset housing comprising a first longitudinal axis, a first offset engagement surface concentric to a second longitudinal axis offset from the first longitudinal axis, and an arcuate extension concentric to the second longitudinal axis and defined by a first pair of circumferentially spaced shoulders, and an adjustment mandrel comprising a third longitudinal axis, a second offset engagement surface concentric to a fourth longitudinal axis offset from the third longitudinal axis, and a first arcuate groove concentric to the fourth longitudinal axis and defined by a second pair of circumferentially spaced shoulders, wherein the first offset engagement surface matingly engages the second offset engagement surface and the arcuate extension of the offset housing is disposed in the first arcuate groove of the adjustment mandrel, wherein the bend adjustment assembly includes a first position with a first shoulder of the first pair of shoulders contacting a first shoulder of the second pair of shoulders, and wherein the first position provides a first deflection angle between the first longitudinal axis of the offset housing and the third longitudinal axis of the adjustment mandrel, wherein the bend adjustment assembly includes a second position angularly spaced from the first position with a second shoulder of the first pair of shoulders contacting a second shoulder of the second pair of shoulders, and wherein the second position provides a second deflection angle between the first longitudinal axis of the offset housing and the third longitudinal axis of the adjustment mandrel that is different from the first deflection angle. In some embodiments, the offset housing comprises a locked position locking the bend adjustment assembly in at least one of the first and second positions and an unlocked position permitting the bend adjustment assembly to shift between the first and second positions, and an angular distance between the second pair of shoulders defines a magnitude of the difference between the first deflection angle and the second deflection angle. In some embodiments, the bend adjustment assembly is configured to shift from the first position to the second position in response to at least one of flowrate and pressure of a drilling fluid supplied to the downhole mud motor, and shift from the second position to the first position in response to a change in relative rotation between the offset housing and the adjustment mandrel, the bend adjustment assembly is configured to shift from the first position to the second position in response to rotation of the offset housing in a first direction relative to the adjustment mandrel, and shift from the second position to the first position in response to rotation of the offset housing in a second direction relative to the adjustment mandrel that is opposite the first direction. In certain embodiments, the adjustment mandrel further comprises a second arcuate groove concentric to the fourth longitudinal axis and defined by a third pair of circumferentially spaced shoulders, and the bend adjustment assembly includes a third position angularly spaced from the first and second positions with a second shoulder of the first pair of shoulders contacting a second shoulder of the third pair of shoulders, and wherein the third position provides a third deflection angle between the first longitudinal axis of the offset housing and the third longitudinal axis of the adjustment mandrel that is different from the first and second deflection angles. In certain embodiments, the bend adjustment assembly further comprises a locking piston disposed in the offset housing, wherein the locking piston comprises a locked position restricting relative rotation between the offset housing and the adjustment mandrel, and an unlocked position, axially spaced from the locked position, permitting relative rotation between the offset housing and the adjustment mandrel, wherein the locking piston is configured to shift between the locked position and the unlocked position in response to a change in at least one of flowrate and pressure of the drilling fluid supplied to the downhole mud motor. In certain embodiments, the locking piston comprises a key, the adjustment mandrel comprises a first slot and a second slot each extending into an end of the adjustment mandrel, wherein a length of the second slot is different from a length of the first slot, and relative rotation between the adjustment mandrel and the offset housing is restricted when the key of the locking piston is received in either the first slot or the second slot of the adjustment mandrel. In some embodiments, the bend adjustment assembly is locked in the first position when the key of the locking piston is received in the first slot of the adjustment mandrel, and the bend adjustment assembly is locked in the second position when the key of the locking piston is received in the second slot of the adjustment mandrel. In some embodiments, the locking piston is configured to induce a pressure signal providing a surface indication of the deflection angle of the bend adjustment assembly. In certain embodiments, the bend adjustment assembly further comprises a locking piston disposed in the offset housing, and a radial port formed in the offset housing, wherein the locking piston comprises first and second locked positions each restricting relative rotation between the offset housing and the adjustment mandrel, and an unlocked position, axially spaced from the first and second locked positions, permitting relative rotation between the offset housing and the adjustment mandrel, wherein the locking piston is configured to lock the bend adjustment assembly in the first position when the locking piston is in the first locked position, and lock the bend adjustment assembly in the second position when the locking piston is in the second position, wherein the locking piston axially covers the radial port when the locking piston is in at least one of the first locked position, second locked position, and unlocked position to restrict fluid flow through the radial port into the offset housing. In certain embodiments, the bend adjustment assembly further comprises an actuator assembly configured to shift the bend adjustment assembly between the first position and the second position in response to a change in at least one of flowrate of a drilling fluid supplied to the downhole mud motor, pressure of the drilling fluid supplied to the downhole mud motor, and relative rotation between the driveshaft housing and the bearing mandrel. In some embodiments, the actuator assembly is in fluid communication with a sealed volume of oil in which a bearing of the downhole motor is disposed. In some embodiments, the actuator assembly comprises: an actuator housing through which the bearing mandrel extends, an actuator piston coupled to the actuator housing, wherein the actuator piston comprises a first plurality of teeth, and a teeth ring coupled to the bearing mandrel and comprising a second plurality of teeth, wherein the actuator piston is configured to matingly engage the first plurality of teeth with the second plurality of teeth of the teeth ring to transfer torque between the actuator housing and the bearing mandrel in response to the change in flowrate of the drilling fluid supplied to the downhole mud motor. In some embodiments, the actuator assembly comprises an actuator housing through which the bearing mandrel extends, an actuator piston disposed in the actuator housing, and a teeth ring coupled to the bearing mandrel, wherein the actuator piston is configured to permit relative rotation between the actuator housing and the bearing mandrel in response to the application of a torque to the actuator piston from the teeth ring which exceeds a threshold torque.

An embodiment of a method for forming a deviated borehole comprises (a) providing a bend adjustment assembly of a downhole mud motor in a first position that provides a first deflection angle between a longitudinal axis of a driveshaft housing of the downhole mud motor and a longitudinal axis of a bearing mandrel of the downhole mud motor, and (b) with the downhole mud motor positioned in the borehole, actuating the bend adjustment assembly from the first position to a second position that provides a second deflection angle between the longitudinal axis of the driveshaft housing and the longitudinal axis of the bearing mandrel, the second deflection angle being different from the first deflection angle. In some embodiments, (b) comprises (b1) pumping drilling fluid into the borehole from the surface pump at a first flowrate that is less than the drilling flowrate for a first time period, (b2) following the first time period, pumping drilling fluid in the borehole from the surface pump at a second flowrate that is different than the first flowrate for a second time period. In some embodiments, (b) comprises (b1) ceasing the pumping of drilling fluid into the borehole from the surface pump for a first time period, (b2) rotating a drillstring coupled to the bend adjustment assembly from a surface of the borehole for a second time period, and (b3) following the second time period, pumping drilling fluid into the borehole from the surface pump at a flowrate greater than zero for a third time period. In certain embodiments, (b) comprises (b1) pumping drilling fluid into the borehole from the surface pump at a first flowrate that is less than the drilling flowrate for a first time period, (b2) rotating a drillstring coupled to the bend adjustment assembly from a surface of the borehole for a second time period, and (b3) applying weight on bit (WOB) to the downhole mud motor while rotating the drillstring and pumping drilling fluid into the borehole from the surface pump at a second flowrate that is greater than the first flowrate for a third time period. In some embodiments, the method further comprises (c) oscillating the bearing mandrel axially in a bearing housing of the downhole mud motor in response to pumping drilling fluid into the borehole from the surface pump. In some embodiments, the method further comprises (c) with the downhole mud motor positioned in the borehole, actuating the bend adjustment assembly from the second position to a third position that provides a third deflection angle between the longitudinal axis of the driveshaft housing and the longitudinal axis of the bearing mandrel, the third deflection angle being different from the first deflection angle and the second deflection angle. In certain embodiments, (b) comprises (b1) pumping drilling fluid into the borehole from the surface pump at a first flowrate that is less than the drilling flowrate for a first time period, and (b2) following the first time period, pumping drilling fluid in the borehole from the surface pump at a second flowrate that is different than the first flowrate, and (c) comprises (c1) pumping drilling fluid into the borehole from the surface pump at the first flowrate for a third time period, and (c2) following the third time period, pumping drilling fluid in the borehole from the surface pump at a third flowrate. In certain embodiments, (b) comprises (b1) shifting a locking piston of the downhole mud motor from a locked position to an unlocked position axially spaced from the locked position to permit the bend adjustment assembly to actuate between the first position and the second position, (b2) rotating an offset housing of an actuator assembly of the bend adjustment assembly relative to an adjustment mandrel of the bend adjustment assembly to actuate the bend adjustment assembly from the first position to the second position, and (b3) shifting the locking piston from the unlocked position to the locked position to lock the bend adjustment assembly in the second position.

BRIEF DESCRIPTION OF THE DRAWINGS

For a detailed description of disclosed embodiments, reference will now be made to the accompanying drawings in which.

DETAILED DESCRIPTION OF DISCLOSED EMBODIMENTS

Figure 1:
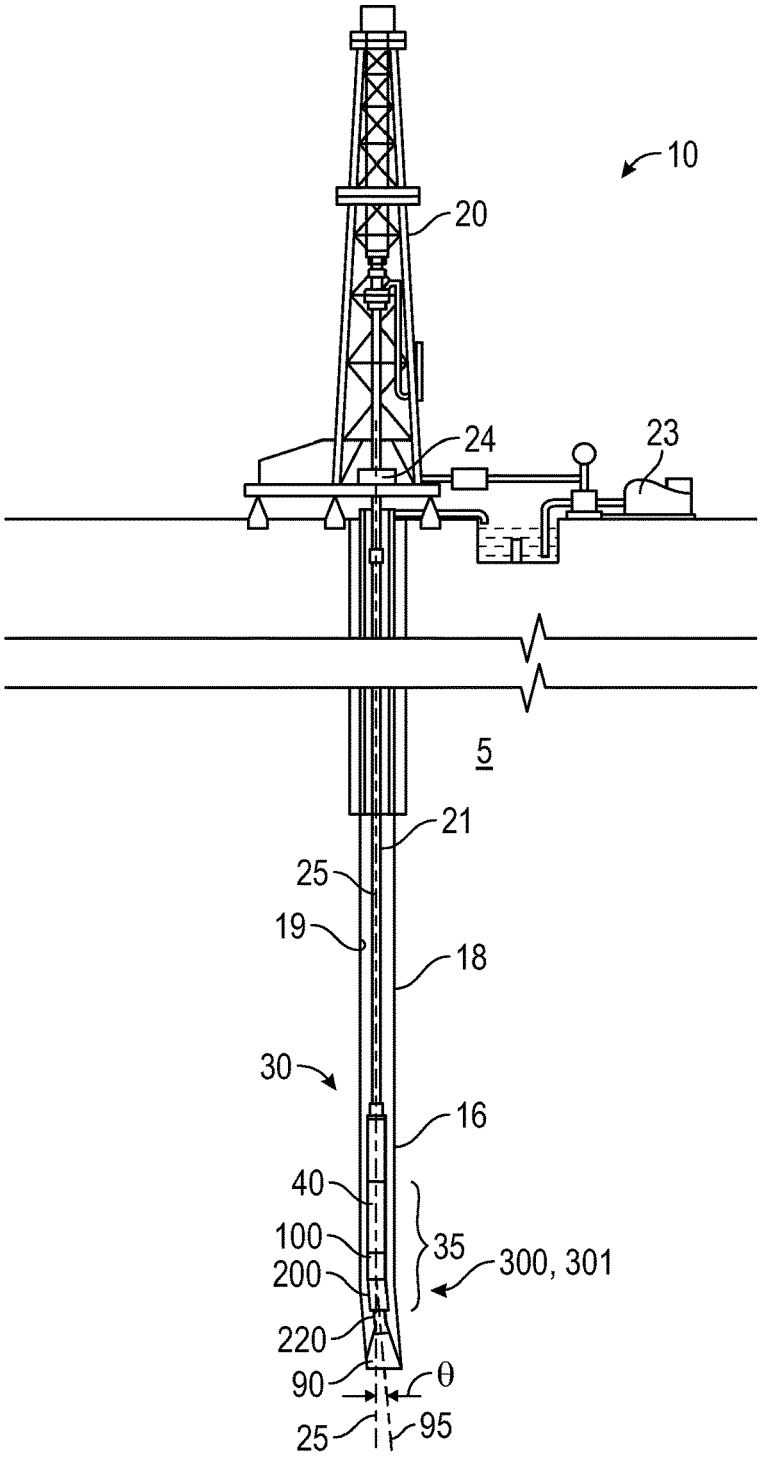
FIG. 1 is a schematic partial cross-sectional view of a drilling system including an embodiment of a downhole mud motor in accordance with principles disclosed herein.

The following discussion is directed to various embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection as accomplished via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation.

Referring to FIG. 1, an embodiment of a well system 10 is shown. Well system 10 is generally configured for drilling a borehole 16 in an earthen formation 5. In the embodiment of FIG. 1, well system 10 includes a drilling rig 20 disposed at the surface, a drillstring 21 extending downhole from rig 20, a bottomhole assembly (BHA) 30 coupled to the lower end of drillstring 21, and a drill bit 90 attached to the lower end of BHA 30. A surface or mud pump 23 is positioned at the surface and pumps drilling fluid or mud through drillstring 21. Additionally, rig 20 includes a rotary system 24 for imparting torque to an upper end of drillstring 21 to thereby rotate drillstring 21 in borehole 16. In this embodiment, rotary system 24 comprises a rotary table located at a rig floor of rig 20; however, in other embodiments, rotary system 24 may comprise other systems for imparting rotary motion to drillstring 21, such as a top drive. A downhole mud motor 35 is provided in BHA 30 for facilitating the drilling of deviated portions of borehole 16. Moving downward along BHA 30, motor 35 includes a hydraulic drive or power section 40, a driveshaft assembly 100, and a bearing assembly 200. In some embodiments, the portion of BHA 30 disposed between drillstring 21 and motor 35 can include other components, such as drill collars, measurement-while-drilling (MWD) tools, reamers, stabilizers and the like.

Power section 40 of BHA 30 converts the fluid pressure of the drilling fluid pumped downward through drillstring 21 into rotational torque for driving the rotation of drill bit 90. Driveshaft assembly 100 and bearing assembly 200 transfer the torque generated in power section 40 to bit 90. With force or weight applied to the drill bit 90, also referred to as weight-on-bit ("WOB"), the rotating drill bit 90 engages the earthen formation and proceeds to form borehole 16 along a predetermined path toward a target zone. The drilling fluid or mud pumped down the drillstring 21 and through BHA 30 passes out of the face of drill bit 90 and back up the annulus 18 formed between drillstring 21 and the wall 19 of borehole 16. The drilling fluid cools the bit 90, and flushes the cuttings away from the face of bit 90 and carries the cuttings to the surface.

Figure 2:
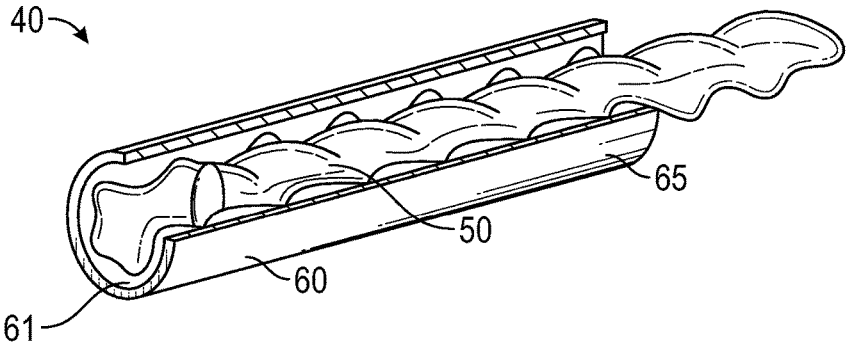
FIG. 2 is a perspective, partial cut-away view of the power section of FIG. 1.
Figure 3:
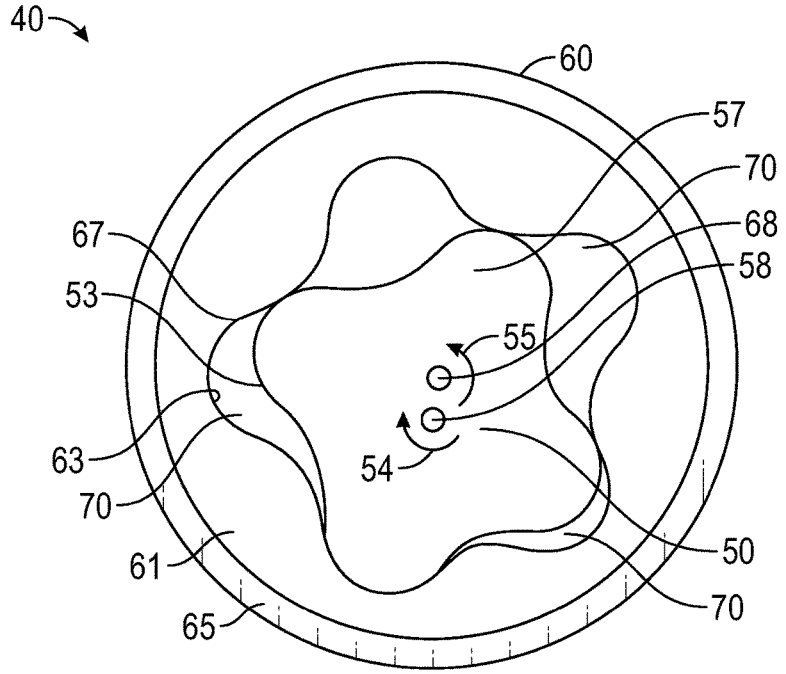
FIG. 3 is a cross-sectional end view of the power section of FIG. 1.

Referring to FIGS. 1-3, an embodiment of the power section 40 of BHA 30 is shown schematically in FIGS. 2 and 3. In the embodiment of FIGS. 2 and 3, power section 40 comprises a helical-shaped rotor 50 disposed within a stator 60 comprising a cylindrical stator housing 65 lined with a helical-shaped elastomeric insert 61. Helical-shaped rotor 50 defines a set of rotor lobes 57 that intermesh with a set of stator lobes 67 defined by the helical-shaped insert 61. As best shown in FIG. 3, the rotor 50 has one fewer lobe 57 than the stator 60. When the rotor 50 and the stator 60 are assembled, a series of cavities 70 are formed between the outer surface 53 of the rotor 50 and the inner surface 63 of the stator 60. Each cavity 70 is sealed from adjacent cavities 70 by seals formed along the contact lines between the rotor 50 and the stator 60. The central axis 58 of the rotor 50 is radially offset from the central axis 68 of the stator 60 by a fixed value known as the "eccentricity" of the rotor-stator assembly. Consequently, rotor 50 may be described as rotating eccentrically within stator 60.

During operation of the hydraulic drive section 40, fluid is pumped under pressure into one end of the hydraulic drive section 40 where it fills a first set of open cavities 70. A pressure differential across the adjacent cavities 70 forces the rotor 50 to rotate relative to the stator 60. As the rotor 50 rotates inside the stator 60, adjacent cavities 70 are opened and filled with fluid. As this rotation and filling process repeats in a continuous manner, the fluid flows progressively down the length of hydraulic drive section 40 and continues to drive the rotation of the rotor 50. Driveshaft assembly 100 shown in FIG. 1 includes a driveshaft discussed in more detail below that has an upper end coupled to the lower end of rotor 50. In this arrangement, the rotational motion and torque of rotor 50 is transferred to drill bit 90 via driveshaft assembly 100 and bearing assembly 200.

In the embodiment of FIGS. 1-3, driveshaft assembly 100 is coupled to bearing assembly 200 via a bend adjustment assembly 300 of BHA 30 that provides an adjustable bend 301 along motor 35. Due to bend 301, a deflection angle θ is formed between a central or longitudinal axis 95 (shown in FIG. 1) of drill bit 90 and the longitudinal axis 25 of drillstring 21. To drill a straight section of borehole 16, drillstring 21 is rotated from rig 20 with a rotary table or top drive to rotate BHA 30 and drill bit 90 coupled thereto. Drillstring 21 and BHA 30 rotate about the longitudinal axis of drillstring 21, and thus, drill bit 90 is also forced to rotate about the longitudinal axis of drillstring 21. With bit 90 disposed at deflection angle θ, the lower end of drill bit 90 distal BHA 30 seeks to move in an arc about longitudinal axis 25 of drillstring 21 as it rotates, but is restricted by the sidewall 19 of borehole 16, thereby imposing bending moments and associated stress on BHA 30 and mud motor 35. In general, the magnitudes of such bending moments and associated stresses are directly related to the bit-to-bend distance D—the greater the bit-to-bend distance D, the greater the bending moments and stresses experienced by BHA 30 and mud motor 35.

In general, driveshaft assembly 100 functions to transfer torque from the eccentrically-rotating rotor 50 of power section 40 to a concentrically-rotating bearing mandrel 220 of bearing assembly 200 and drill bit 90. As best shown in FIG. 3, rotor 50 rotates about rotor axis 58 in the direction of arrow 54, and rotor axis 58 rotates about stator axis 68 in the direction of arrow 55. However, drill bit 90 and bearing mandrel 220 are coaxially aligned and rotate about a common axis that is offset and/or oriented at an acute angle relative to rotor axis 58. Thus, driveshaft assembly 100 converts the eccentric rotation of rotor 50 to the concentric rotation of bearing mandrel 220 and drill bit 90, which are radially offset and/or angularly skewed relative to rotor axis 58.

Referring to FIGS. 1 and 4-9, embodiments of driveshaft assembly 100, bearing assembly 200, and bend adjustment assembly 300 are shown. In the embodiment of FIGS. 4-9, driveshaft assembly 100 includes an outer or driveshaft housing 110 and a one-piece (i.e., unitary) driveshaft 120 rotatably disposed within housing 110. Housing 110 has a linear central or longitudinal axis 115, a first or upper end 110A, a second or lower end 110B coupled to an outer or bearing housing 210 of bearing assembly 200 via bend adjustment assembly 300, and a central bore or passage 112 extending between ends 110A and 110B. Particularly, an externally threaded connector or pin end of driveshaft housing 110 located at upper end 110A threadably engages a mating internally threaded connector or box end disposed at the lower end of stator housing 65, and an internally threaded connector or box end of driveshaft housing 110 located at lower end 110B threadably engages a mating externally threaded connector of bend adjustment assembly 300. Additionally, in the embodiment of FIGS. 4-9, driveshaft housing includes ports 114 (shown in FIG. 9) that extend radially between the inner and outer surfaces of driveshaft housing 110.

As best shown in FIG. 1, in this embodiment, driveshaft housing 110 is coaxially aligned with stator housing 65. As will be discussed further herein, bend adjustment assembly 300 is configured to actuate between a first position 303 (shown in FIG. 5), and a second position 305 (shown in FIG. 7). In the embodiment of FIGS. 4-9, when bend adjustment assembly 300 is in the first position 303, driveshaft housing 110 is not disposed at an angle relative to bearing assembly 200 and drill bit 90. However, when bend adjustment assembly is disposed in the second position 305, bend 301 is formed between driveshaft assembly 100 and bearing assembly 200, orienting driveshaft housing 110 at deflection angle θ relative to bearing assembly 200 and drill bit 90. Additionally, as will be discussed further herein, bend adjustment assembly 300 is configured to actuate between the first and second positions 303 and 305 in-situ with BHA 30 disposed in borehole 16.

Driveshaft 120 of driveshaft assembly 100 has a linear central or longitudinal axis, a first or upper end 120A, and a second or lower end 120B opposite end 120A. Upper end 120A is pivotally coupled to the lower end of rotor 50 with a driveshaft adapter 130 and a first or upper universal joint 140A, and lower end 120B is pivotally coupled to an upper end 220A of bearing mandrel 220 with a second or lower universal joint 140B. In the embodiment of FIGS. 4-9, upper end 120A of driveshaft 120 and upper universal joint 140A are disposed within driveshaft adapter 130, whereas lower end 120B of driveshaft 120 comprises an axially extending counterbore or receptacle that receives upper end 220A of bearing mandrel 220 and lower universal joint 140B. In this embodiment, driveshaft 120 includes a radially outwards extending shoulder 122 located proximal lower end 120B.

In the embodiment of FIGS. 4-9, driveshaft adapter 130 extends along a central or longitudinal axis 135 between a first or upper end coupled to rotor 50, and a second or lower end coupled to the upper end 120A of driveshaft 120. In this embodiment, the upper end of driveshaft adapter 130 comprises an externally threaded male pin or pin end that threadably engages a mating female box or box end at the lower end of rotor 50. A receptacle or counterbore extends axially (relative to axis 135) from the lower end of adapter 130. The upper end 120A of driveshaft 120 is disposed within the counterbore of driveshaft adapter 130 and pivotally couples to adapter 130 via the upper universal joint 140A disposed within the counterbore of driveshaft adapter 130.

Universal joints 140A and 140B allow ends 120A and 120B of driveshaft 120 to pivot relative to adapter 130 and bearing mandrel 220, respectively, while transmitting rotational torque between rotor 50 and bearing mandrel 220. Driveshaft adapter 130 is coaxially aligned with rotor 50. Since rotor axis 58 is radially offset and/or oriented at an acute angle relative to the central axis of bearing mandrel 220, the central axis of driveshaft 120 is skewed or oriented at an acute angle relative to axis 115 of housing 110, axis 58 of rotor 50, and a central or longitudinal axis 225 of bearing mandrel 220. However, universal joints 140A and 140B accommodate for the angularly skewed driveshaft 120, while simultaneously permitting rotation of the driveshaft 120 within driveshaft housing 110.

In general, each universal joint (e.g., each universal joint 140A and 140B) may comprise any joint or coupling that allows two parts that are coupled together and not coaxially aligned with each other (e.g., driveshaft 120 and adapter 130 oriented at an acute angle relative to each other) limited freedom of movement in any direction while transmitting rotary motion and torque including, without limitation, universal joints (Cardan joints, Hardy-Spicer joints, Hooke joints, etc.), constant velocity joints, or any other custom designed joint. In other embodiments, driveshaft assembly 100 may include a flexible shaft comprising a flexible material (e.g., Titanium, etc.) that is directly coupled (e.g., threadably coupled) to rotor 50 of power section 40 in lieu of driveshaft 120, where physical deflection of the flexible shaft (the flexible shaft may have a greater length relative driveshaft 120) accommodates axial misalignment between driveshaft assembly 100 and bearing assembly 200 while allowing for the transfer of torque therebetween.

As previously described, adapter 130 couples driveshaft 120 to the lower end of rotor 50. During drilling operations, high pressure drilling fluid or mud is pumped under pressure down drillstring 21 and through cavities 70 between rotor 50 and stator 60, causing rotor 50 to rotate relative to stator 60. Rotation of rotor 50 drives the rotation of driveshaft adapter 130, driveshaft 120, bearing assembly mandrel 220, and drill bit 90. The drilling fluid flowing down drillstring 21 through power section 40 also flows through driveshaft assembly 100 and bearing assembly 200 to drill bit 90, where the drilling fluid flows through nozzles in the face of bit 90 into annulus 18. Within driveshaft assembly 100 and the upper portion of bearing assembly 200, the drilling fluid flows through an annulus 116 formed between driveshaft housing 110 and driveshaft 120.

Figure 4:
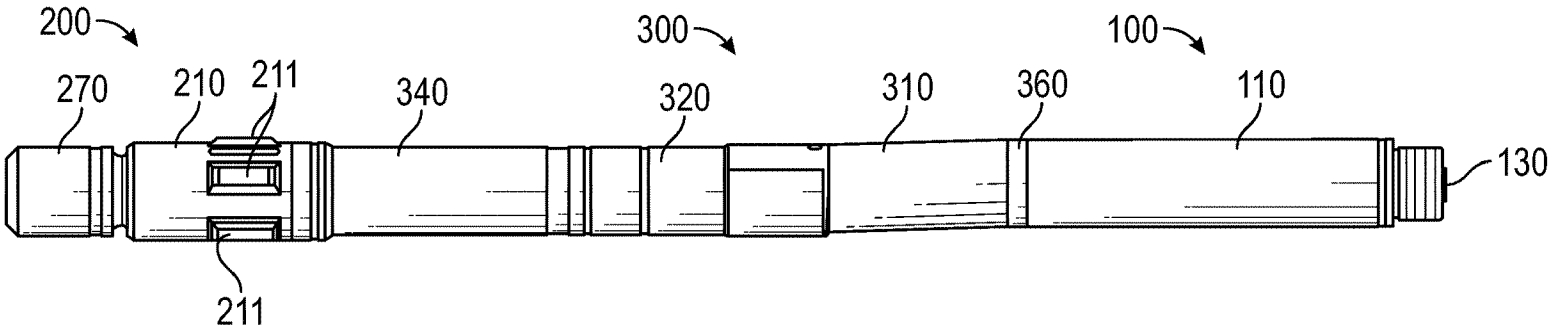
FIG. 4 is a side view of an embodiment of a mud motor of FIG. 1 disposed in a first position, FIG. 4 illustrating a driveshaft assembly, a bearing assembly, and a bend adjustment assembly of the mud motor of FIG. 1 in accordance with principles disclosed herein.
Figure 5:
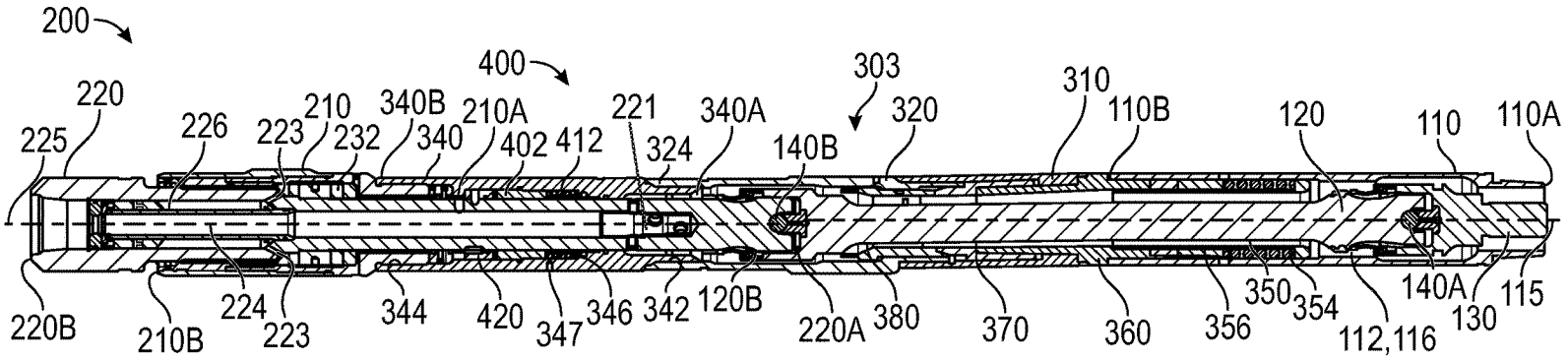
FIG. 5 is a side cross-sectional view of the mud motor of FIG. 4 disposed in the first position.
Figure 6:
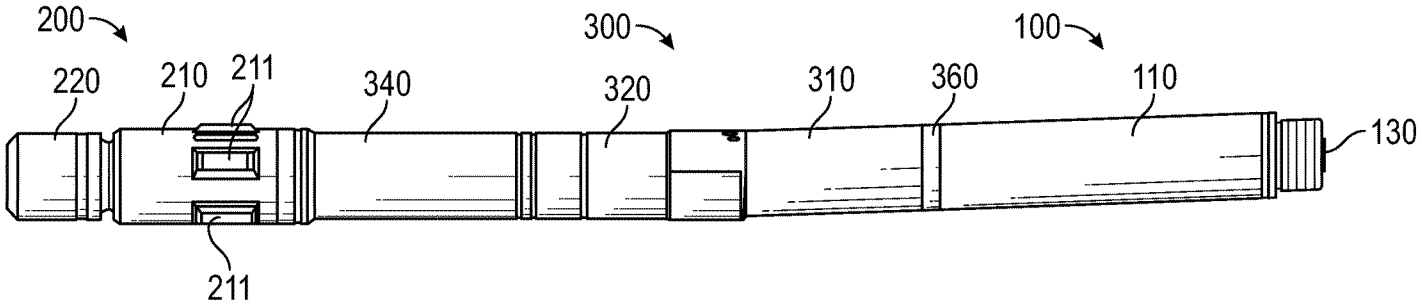
FIG. 6 is a side view of the mud motor of FIG. 4 disposed in a second position.
Figure 7:
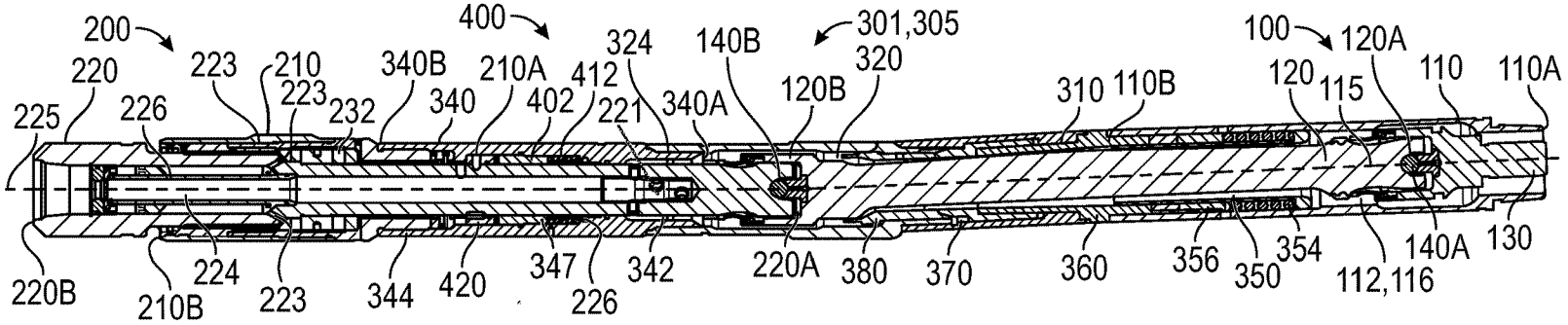
FIG. 7 is a side cross-sectional view of the mud motor of FIG. 4 disposed in the second position.
Figure 8:
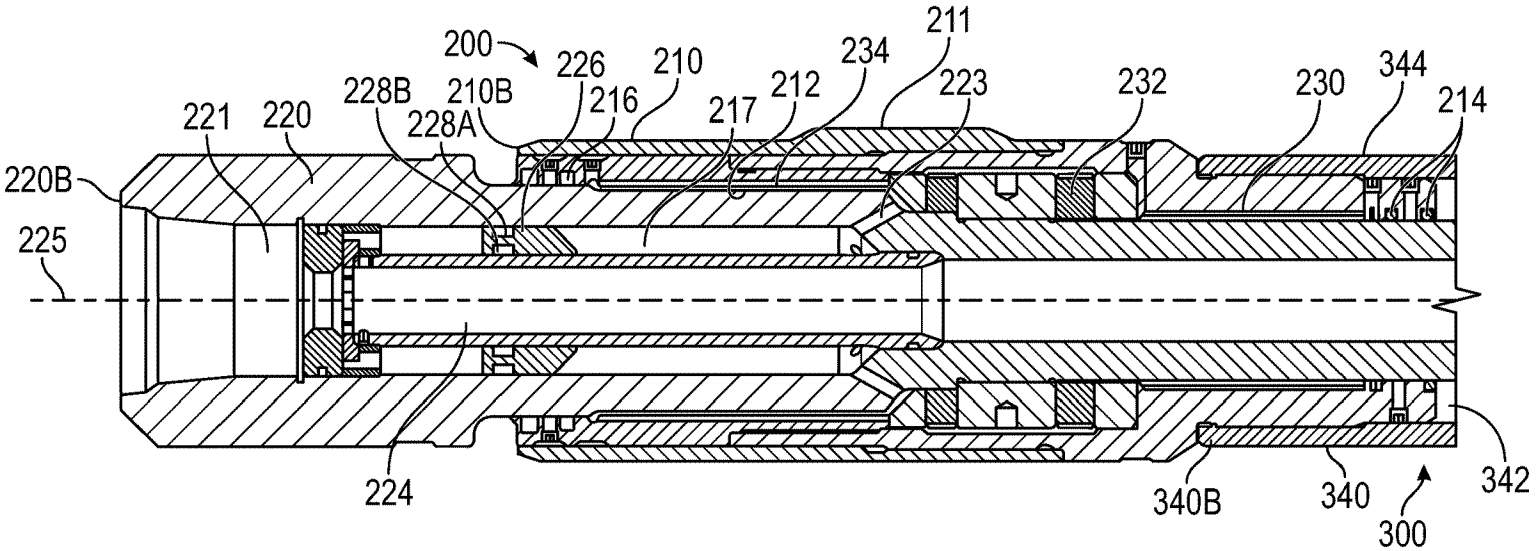
FIG. 8 is a zoomed-in, side cross-sectional view of the bearing assembly of FIG. 4.

Still referring to FIGS. 1 and 4-9, bearing assembly 200 includes bearing housing 210 and one-piece (i.e., unitary) bearing mandrel 220 rotatably disposed within housing 210. Bearing housing 210 has a linear central or longitudinal axis disposed coaxial with central axis 225 of mandrel 220, a first or upper end 210A coupled to lower end 110B of driveshaft housing 110 via bend adjustment assembly 300, a second or lower end 210B, and a central through bore or passage extending axially between ends 210A and 210B. Particularly, the upper end 210A comprises an externally threaded connector or pin end coupled with bend adjustment assembly 300. Bearing housing 210 is coaxially aligned with bit 90, however, due to bend 301 between driveshaft assembly 100 and bearing assembly 200, bearing housing 210 is oriented at deflection angle θ relative to driveshaft housing 110. As best shown in FIGS. 4, 6 and 8, bearing housing 210 includes a plurality of circumferentially spaced stabilizers 211 extending radially outwards therefrom, where stabilizers 211 are generally configured to stabilize or centralize the position of bearing housing 210 in borehole 16

In the embodiment of FIGS. 4-9, bearing mandrel 220 of bearing assembly 200 has a first or upper end 220A, a second or lower end 220B, and a central through passage 221 extending axially from lower end 220B and terminating axially below upper end 220A. The upper end 220A of bearing mandrel 220 is directly coupled to the lower end 120B of driveshaft 120 via lower universal joint 140B. In particular, upper end 220A is disposed within a receptacle formed in the lower end 120B of driveshaft 120 and pivotally coupled thereto with lower universal joint 140B. Additionally, the lower end 220B of mandrel 220 is coupled to drill bit 90.

In the embodiment of FIGS. 4-9, bearing mandrel 220 includes a plurality of drilling fluid ports 222 extending radially from passage 221 to the outer surface of mandrel 220, and a plurality of lubrication ports 223 also extending radially to the outer surface of mandrel 220, where drilling fluid ports 222 are disposed proximal an upper end of passage 221 and lubrication ports 223 are axially spaced from drilling fluid ports 222. In this arrangement, lubrication ports 223 are separated or sealed from passage 221 of bearing mandrel 220 and the drilling fluid flowing through passage 221. Drilling fluid ports 222 provide fluid communication between annulus 116 and passage 221. During drilling operations, mandrel 220 is rotated about axis 225 relative to housing 210. In particular, high pressure drilling fluid is pumped through power section 40 to drive the rotation of rotor 50, which in turn drives the rotation of driveshaft 120, mandrel 220, and drill bit 90. The drilling mud flowing through power section 40 flows through annulus 116, drilling fluid ports 222 and passage 221 of mandrel 220 in route to drill bit 90.

In the embodiment of FIGS. 4-9, the upper end 120A of driveshaft 120 is coupled to rotor 50 with a driveshaft adapter 130 and upper universal joint 140A, and the lower end 120B of driveshaft 120 is coupled to the upper end 220A of bearing mandrel 220 with lower universal joint 140B. As shown particularly in FIG. 8, bearing housing 210 has a central bore or passage defined by a radially inner surface 212 that extends between ends 210A and 210B. A pair of first or upper annular seals 214 are disposed in the inner surface 212 of housing 210 proximal upper end 210A while a second or lower annular seal 216 is disposed in the inner surface 212 proximal lower end 210B. In this arrangement, an annular chamber 217 is formed radially between inner surface 212 and an outer surface of bearing mandrel 220, where annular chamber 217 extends axially between upper seals 214 and lower seal 216. Additionally, in the embodiment of FIGS. 4-9, bearing mandrel 220 includes a central sleeve 224 disposed in passage 221 and coupled to an inner surface of mandrel 220 defining passage 221. An annular piston 226 is slidably disposed in passage 221 radially between the inner surface of mandrel 220 and an outer surface of sleeve 224, where piston 226 includes a first or outer annular seal 228A that seals against the inner surface of mandrel 220 and a second or inner annular seal 228B that seals against the outer surface of sleeve 224. In this arrangement, chamber 217 extends into the annular space (via lubrication ports 223) formed between the inner surface of mandrel 220 and the outer surface of sleeve 224 that is sealed from the flow of drilling fluid through passage 221 via the annular seals 228A and 228B of piston 226.

In the embodiment of FIGS. 4-9, a first or upper radial bearing 230, a thrust bearing assembly 232, and a second or lower radial bearing 234 are each disposed in chamber 217. Upper radial bearing 230 is disposed about mandrel 220 and axially positioned above thrust bearing assembly 232, and lower radial bearing 234 is disposed about mandrel 220 and axially positioned below thrust bearing assembly 232. In general, radial bearings 230, 234 permit rotation of mandrel 220 relative to housing 210 while simultaneously supporting radial forces therebetween. In this embodiment, upper radial bearing 230 and lower radial bearing 234 are both sleeve type bearings that slidingly engage the outer surface of mandrel 220. However, in general, any suitable type of radial bearing(s) may be employed including, without limitation, needle-type roller bearings, radial ball bearings, or combinations thereof.

Annular thrust bearing assembly 232 is disposed about mandrel 220 and permits rotation of mandrel 220 relative to housing 210 while simultaneously supporting axial loads in both directions (e.g., off-bottom and on-bottom axial loads). In this embodiment, thrust bearing assembly 232 generally comprises a pair of caged roller bearings and corresponding races, with the central race threadedly engaged to bearing mandrel 220. In other embodiments, one or more other types of thrust bearings may be included in bearing assembly 200, including ball bearings, planar bearings, etc. In still other embodiments, the thrust bearing assemblies of bearing assembly 200 may be disposed in the same or different thrust bearing chambers (e.g., two-shoulder or four-shoulder thrust bearing chambers). In the embodiment of FIGS. 4-9, radial bearings 230, 234 and thrust bearing assembly 232 are oil-sealed bearings. Particularly, chamber 217 comprises an oil or lubricant filled chamber that is pressure compensated via piston 226. In other words, piston 226 equalizes the fluid pressure within chamber 217 with the pressure of drilling fluid flowing through passage 221 of mandrel 220 towards drill bit 90. As previously described, in this embodiment, bearings 230, 232, 234 are oil-sealed. However, in other embodiments, the bearings of the bearing assembly (e.g., bearing assembly 200) are mud lubricated.

Referring still to FIGS. 1, and 4-9, as previously described, bend adjustment assembly 300 couples driveshaft housing 110 to bearing housing 210, and introduces bend 301 and deflection angle θ along motor 35. Central axis 115 of driveshaft housing 110 is coaxially aligned with axis 25, and central axis 225 of bearing mandrel 220 is coaxially aligned with axis 95, thus, deflection angle θ also represents the angle between axes 115, 225 when mud motor 35 is in an undeflected state (e.g., outside borehole 16). Bend adjustment assembly 300 is configured to adjust the deflection angle θ between a first predetermined deflection angle $\theta_1$ and a second predetermined deflection angle $\theta_2$, different from the first deflection angle $\theta_1$, with drillstring 21 and BHA 30 in-situ disposed in borehole 16. In other words, bend adjustment assembly 300 is configured to adjust the amount of bend 301 without needing to pull drillstring 21 from borehole 16 to adjust bend adjustment assembly 300 at the surface, thereby reducing the amount of time required to drill borehole 16. In the embodiment of FIGS. 4-9, first predetermined deflection angle $\theta_1$ is substantially equal to 0° while second deflection angle $\theta_2$ is an angle greater than 0°, such as an angle between 0°-5°; however, in other embodiments, first deflection angle $\theta_1$ may be greater than 0°, as will be discussed further herein.

In the embodiment of FIGS. 4-9, bend adjustment assembly 300 generally includes a first or upper housing 310, a second or lower housing 320, and a clocker or actuator housing 340, a piston mandrel 350, a first or upper adjustment mandrel 360, a second or lower adjustment mandrel 370, and a locking piston 380. Additionally, in this embodiment, bend adjustment assembly 300 includes a locker or actuator assembly 400 housed in the actuator housing 340, where locker assembly 400 is generally configured to control the actuation of bend adjustment assembly between the first deflection angle $\theta_1$ and the second deflection angle $\theta_2$ with BHA 30 disposed in borehole 16. Upper housing 310 and lower housing 320 may be referred to at times as offset housings 310, 320.

Figure 9:
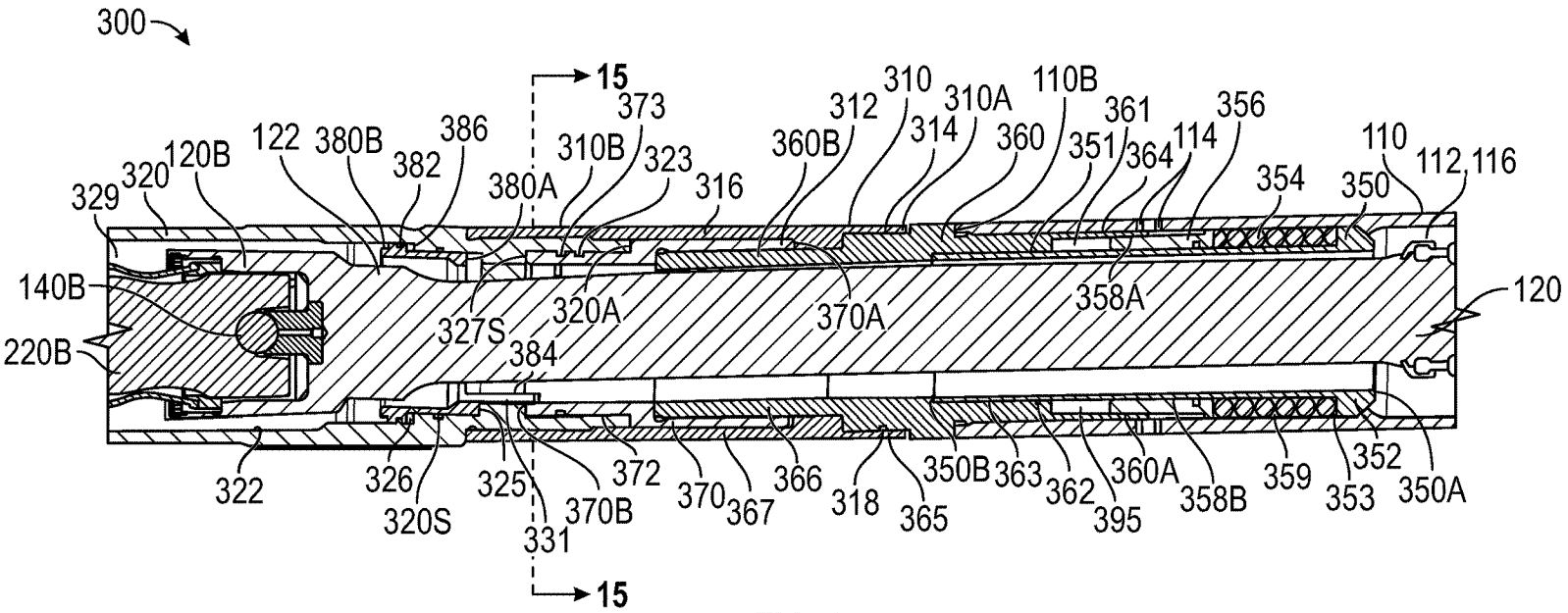
FIG. 9 is a zoomed-in, side cross-sectional view of the bend adjustment assembly of FIG. 4.
Figure 10:
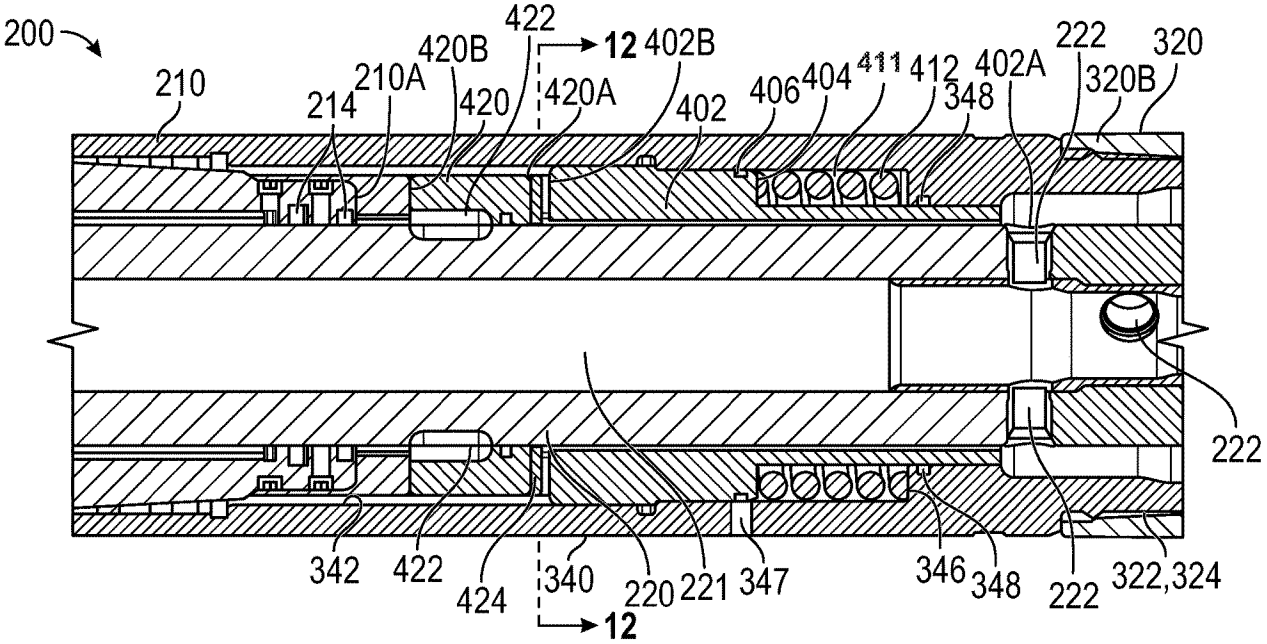
FIG. 10 is a zoomed-in, side cross-sectional view of an embodiment of an actuator assembly of the bearing assembly of FIG. 4 in accordance with principles disclosed herein.

Referring to FIGS. 4-10, components of the bend adjustment assembly 300 of FIGS. 4-10 are shown in greater detail in FIGS. 9 and 10. As shown particularly in FIG. 9, upper housing 310 is generally tubular and has a first or upper end 310A, a second or lower end 310B, and a central bore or passage defined by a generally cylindrical inner surface 312 extending between ends 310A and 310B. The inner surface 312 of upper housing 310 includes an engagement surface 314 extending from upper end 310A and a threaded connector 316 extending from lower end 310B. An annular seal 318 is disposed radially between engagement surface 314 of upper housing 310 and an outer surface of upper adjustment mandrel to seal the annular interface formed therebetween.

Referring to FIGS. 4-11 and 20, lower housing 320 of bend adjustment assembly 300 is generally tubular and has a first or upper end 320A, a second or lower end 320B, and a generally cylindrical inner surface 322 extending between ends 320A and 320B. A generally cylindrical outer surface of lower housing 320 includes a threaded connector coupled to the threaded connector 316 of upper housing 310. The inner surface 322 of lower housing 320 includes an offset engagement surface 323 extending from upper end 320A to an internal shoulder 327S, and a threaded connector 324 extending from lower end 320B. In the embodiment of FIGS. 4-11, offset engagement surface 323 defines an offset bore or passage 327 (shown in FIG. 11) that extends between upper end 320A and internal shoulder 327S of lower housing 320. Additionally, lower housing 320 includes a central bore or passage 329 extending between lower end 320B and internal shoulder 327S, where central bore 329 (shown in FIG. 9) has a central axis disposed at an angle relative to a central axis of offset bore 327. In other words, offset engagement surface 323 has a central or longitudinal axis 333 (shown in FIG. 20) that is offset or disposed at an angle relative to a central or longitudinal axis of lower housing 320. Thus, in the embodiment of FIGS. 4-11, the offset or angle formed between central bore 329 and offset bore 327 of lower housing 320 facilitates the formation of bend 301 described above. In this embodiment, the inner surface 322 of lower housing 320 additionally includes a first or upper annular shoulder 325, a second or lower annular shoulder 326, and an annular seal 320S located between shoulders 325 and 326. Additionally, inner surface 322 of lower housing 320 includes a pair of circumferentially spaced slots 331, where slots 331 extend axially into lower housing 320 from upper shoulder 325.

Figure 11:
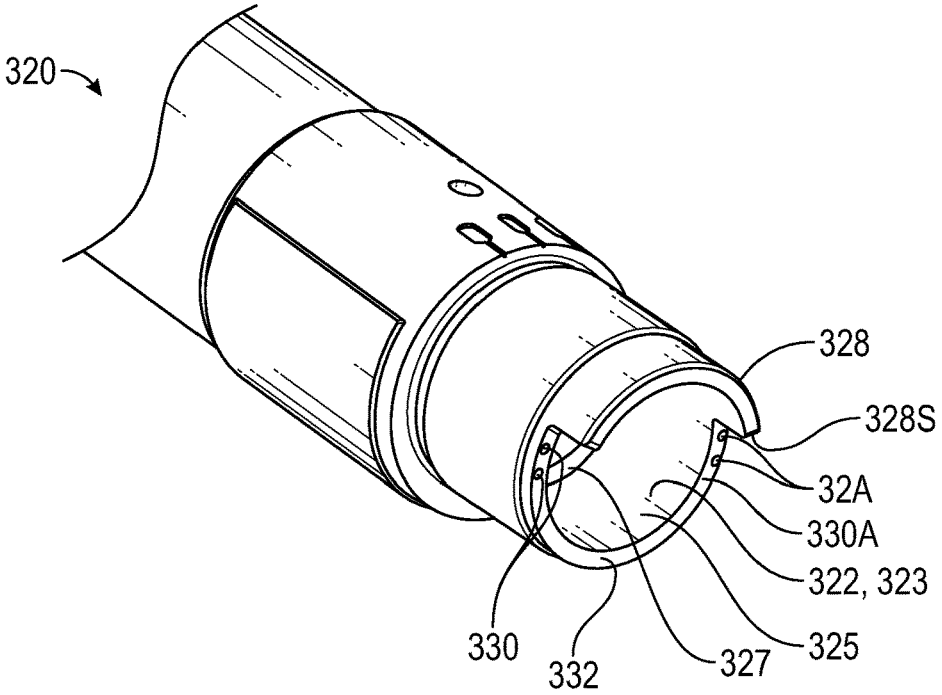
FIG. 11 is a perspective view of an embodiment of a lower housing of the bend adjustment assembly of FIG. 4.
Figure 12:
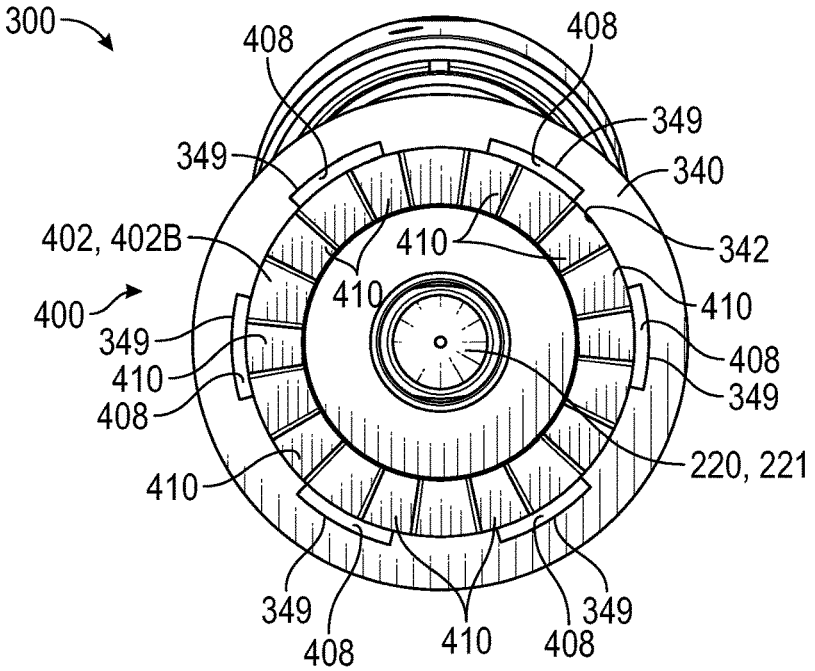
FIG. 12 is a cross-sectional view of the mud motor of FIG. 4 along line 12-12 of FIG. 10.
Figure 13:
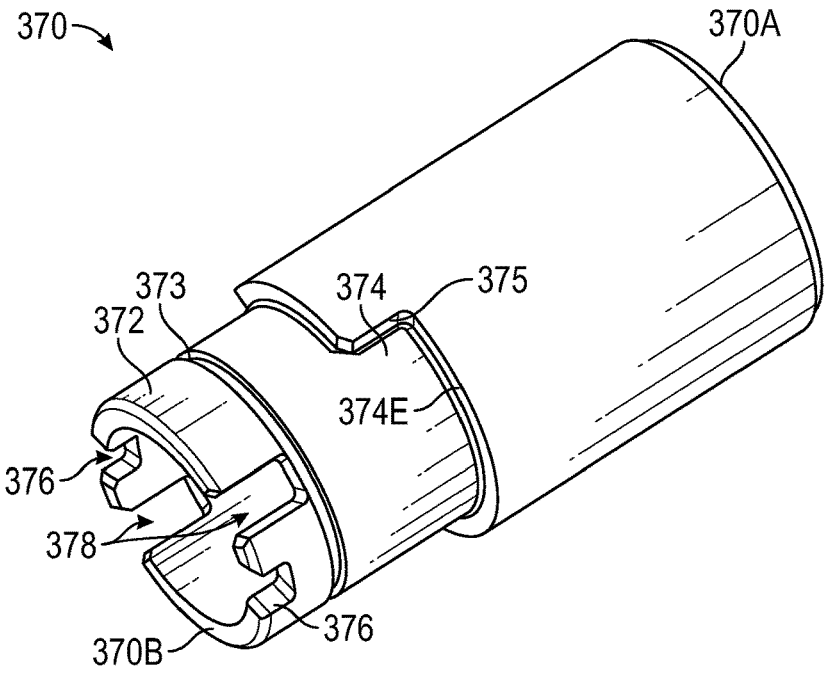
FIG. 13 is a perspective view of an embodiment of a lower adjustment mandrel of the bend adjustment assembly of FIG. 4 in accordance with principles disclosed herein.
Figure 14:
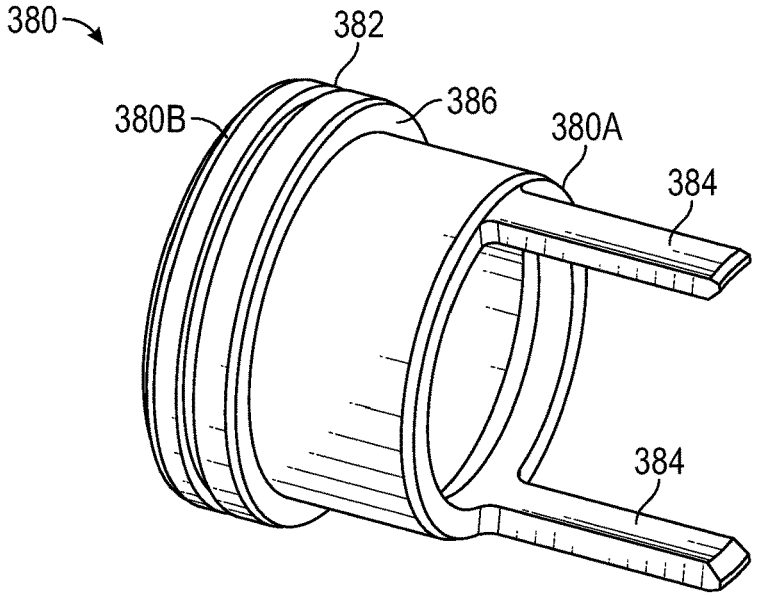
FIG. 14 is a perspective view of an embodiment of a locking piston of the bend adjustment assembly of FIG. 4 in accordance with principles disclosed herein.
Figure 15:
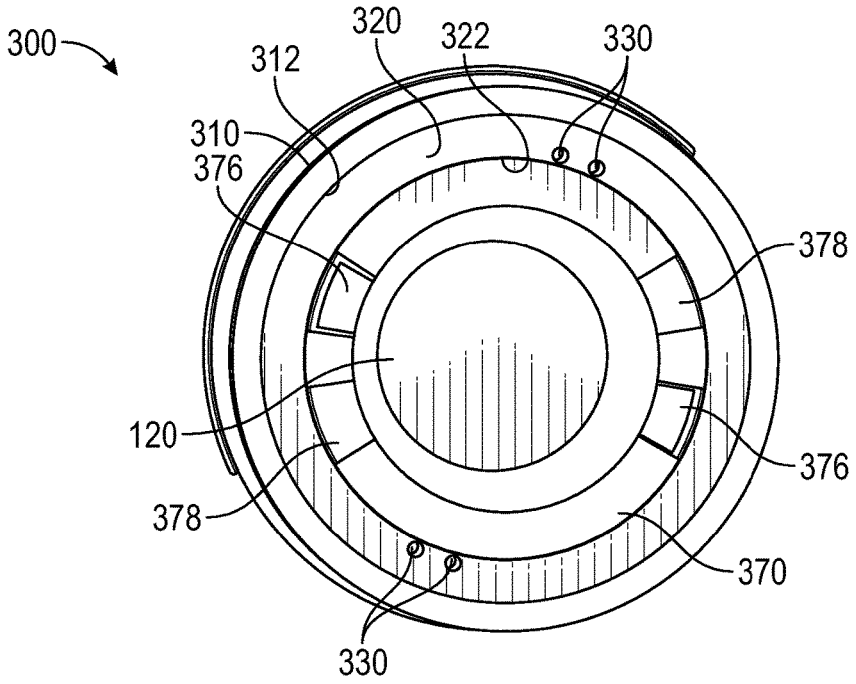
FIG. 15 is a cross-sectional view of the mud motor of FIG. 4 along line 15-15 of FIG. 9.
Figure 16:
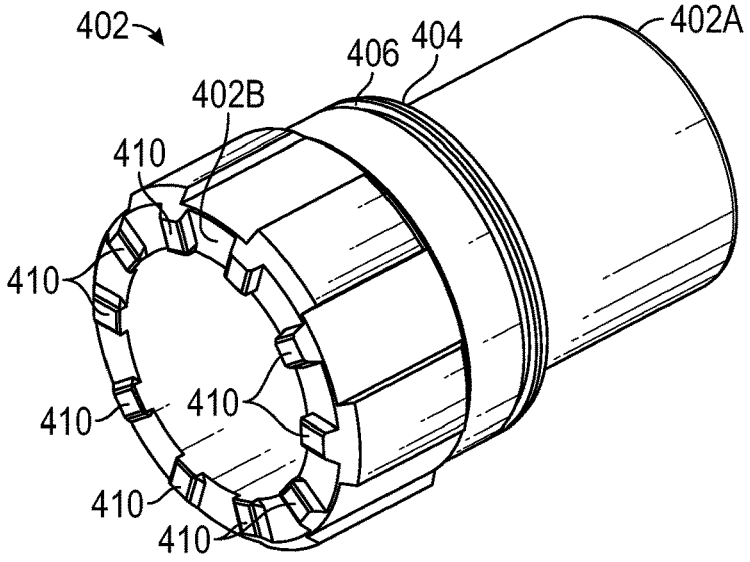
FIG. 16 is a perspective view of an embodiment of an actuator piston of the actuator assembly of FIG. 10 in accordance with principles disclosed herein.
Figure 17:
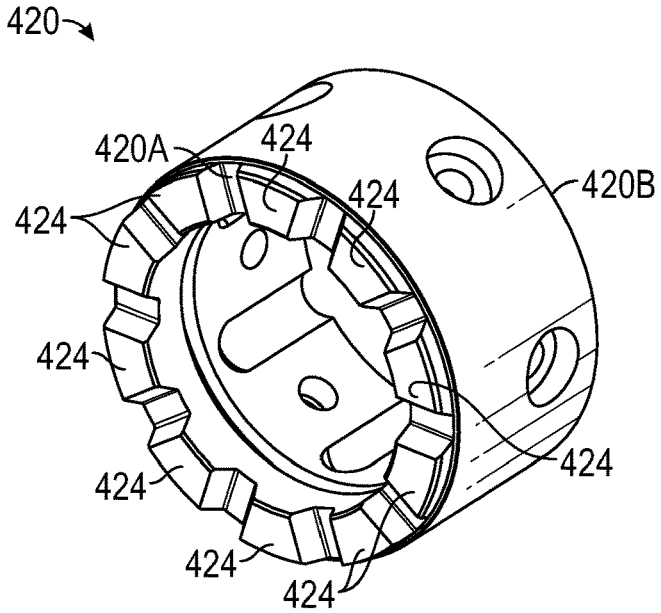
FIG. 17 is a perspective view of an embodiment of a torque transmitter of the actuator assembly of FIG. 10 in accordance with principles disclosed herein.
Figure 18:
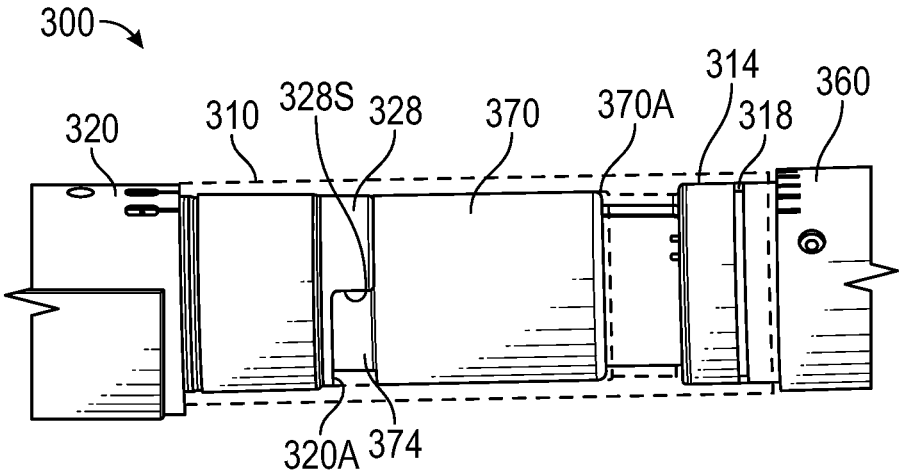
FIG. 18 is another zoomed-in, side cross-sectional view of the bend adjustment assembly of FIG. 4.

As shown particularly in FIG. 11, in the embodiment of FIGS. 4-11, lower housing 320 of bend adjustment assembly 300 includes an arcuate lip or extension 328 at upper end 320A. Particularly, extension 328 extends arcuately between a pair of axially extending shoulders 328S. In this embodiment, extension 328 extends less than 180° about the central axis of lower housing 320; however, in other embodiments, the arcuate length or extension of extension 328 may vary. Additionally, in the embodiment of FIGS. 4-11, lower housing 320 includes a plurality of circumferentially spaced and axially extending ports 330 (shown in FIG. 11). Particularly, ports 330 extend axially between lower shoulder 326 and an arcuate shoulder 332 (shown in FIG. 11) from which extension 328 extends. As will be discussed further herein, ports 330 of lower housing 320 provide fluid communication through a generally annular compensation or locking chamber 395 (shown in FIG. 9) of bend adjustment assembly 300.

Referring to FIGS. 4-12, actuator housing 340 of bend adjustment assembly 300 houses the locker assembly 400 of bend adjustment assembly 300 and threadably couples bend adjustment assembly 300 with bearing assembly 200. Actuator housing 340 is generally tubular and has a first or upper end 340A, a second or lower end 340B, and a central bore or passage defined by a generally cylindrical inner surface 342 extending between ends 340A and 340B. A generally cylindrical outer surface of actuator housing 340 includes a threaded connector at upper end 340A that is coupled with the threaded connector 324 of lower housing 320. In the embodiment of FIGS. 4-12, the inner surface 342 of actuator housing 340 includes a threaded connector 344 at lower end 340B, an annular shoulder 346, and a port 347 that extends radially between inner surface 342 and the outer surface of actuator housing 340. Threaded connector 344 couples with a corresponding threaded connector disposed on an outer surface of bearing housing 210 at the upper end 210A of bearing housing 210 to thereby couple bend adjustment assembly 300 with bearing assembly 20. In this embodiment, the inner surface 342 of actuator housing 340 additionally includes an annular seal 348 located proximal shoulder 346 and a plurality of circumferentially spaced and axially extending slots or grooves 349 (shown in FIG. 12). As will be discussed further herein, seal 348 and slots 349 are configured to interface with components of locker assembly 400.

As shown particularly in FIG. 9, piston mandrel 350 of bend adjustment assembly 300 is generally tubular and has a first or upper end 350A, a second or lower end 350B, and a central bore or passage extending between ends 350A and 350B. Additionally, in the embodiment of FIGS. 4-12, piston mandrel 350 includes a generally cylindrical outer surface comprising a threaded connector 351 and an annular seal 352. In other embodiments, piston mandrel 350 may not include connector 351. Threaded connector 351 extends from lower end 350B while annular seal 352 is located at upper end 350A that sealingly engages the inner surface of driveshaft housing 110. Further, piston mandrel 350 includes an annular shoulder 353 located proximal upper end 350A that physically engages or contacts an annular biasing member 354 extending about the outer surface of piston mandrel 350. In the embodiment of FIGS. 4-12, an annular compensating piston 356 is slidably disposed about the outer surface of piston mandrel 350. Compensating piston 356 includes a first or outer annular seal 358A disposed in an outer cylindrical surface of piston 356, and a second or inner annular seal 358B disposed in an inner cylindrical surface of piston 356, where inner seal 358B sealingly engages the outer surface of piston mandrel 350.

As shown particularly in FIG. 9, upper adjustment mandrel 360 of bend adjustment assembly 300 is generally tubular and has a first or upper end 360A, a second or lower end 360B, and a central bore or passage defined by a generally cylindrical inner surface extending between ends 360A and 360B. In the embodiment of FIGS. 4-12, the inner surface of upper adjustment mandrel 360 includes an annular recess 361 extending axially into mandrel 360 from upper end 360A, and an annular seal 362 axially spaced from recess 361 and configured to sealingly engage the outer surface of piston mandrel 350. The inner surface of upper adjustment mandrel 360 additionally includes a threaded connector 363 coupled with a threaded connector on the outer surface of piston mandrel 350 at the lower end 350B thereof. In other embodiments, upper adjustment mandrel 360 may not include connector 363. In the embodiment of FIGS. 4-12, outer seal 358A of compensating piston 356 sealingly engages the inner surface of upper adjustment mandrel 360, restricting fluid communication between locking chamber 395 and a generally annular compensating chamber 359 formed about piston mandrel 350 and extending axially between seal 352 of piston mandrel 350 and outer seal 358A of compensating piston 356. In this configuration, compensating chamber 359 is in fluid communication with the surrounding environment (e.g., borehole 16) via ports 114 in driveshaft housing 110.

In the embodiment of FIGS. 4-12, upper adjustment mandrel 360 includes a generally cylindrical outer surface comprising a first or upper threaded connector 364, an offset engagement surface 365, and a second or lower threaded connector 366. Upper threaded connector extends from upper end 360A and couples to a threaded connector disposed on the inner surface of driveshaft housing 110 at lower end 110B. Offset engagement surface 365 has a central or longitudinal axis that is offset from or disposed at an angle relative to a central or longitudinal axis of upper adjustment mandrel 360 or 360A. Offset engagement surface 365 matingly engages the engagement surface 314 of upper housing 310, as will be described further herein. In this embodiment, relative rotation is permitted between upper housing 310 and upper adjustment mandrel 360 while relative axial movement is restricted between housing 310 and mandrel 360. The lower threaded connector 366 threadably couples upper adjustment mandrel 360 with lower adjustment mandrel 370. Further, the outer surface of upper offset mandrel 360 proximal lower threaded connector 366 includes an annular seal 367 located proximal lower end 360B that sealingly engages lower housing 320.

Referring to FIGS. 5, 7, 9, 13, 15, 18, and 20, lower adjustment mandrel 370 of bend adjustment assembly 300 is generally tubular and has a first or upper end 370A, a second or lower end 370B, and a central bore or passage extending therebetween that is defined by a generally cylindrical inner surface. In the embodiment of FIGS. 5, 7, 9, 13, 15, 18, and 20, the inner surface of lower adjustment mandrel 370 includes a threaded connector coupled with the lower threaded connector 366 of upper adjustment mandrel 360. Additionally, in this embodiment, lower adjustment mandrel 370 includes a generally cylindrical outer surface comprising an offset engagement surface 372, an annular seal 373 (shown in FIG. 13), and an arcuately extending recess 374 (shown in FIGS. 13 and 15). Offset engagement surface 372 has a central or longitudinal axis 377 (shown in FIG. 20) that is offset or disposed at an angle relative to a central or longitudinal axis of the upper end 360A of upper adjustment mandrel 360 and the lower end 320B of lower housing 320, where offset engagement surface 372 is disposed directly adjacent or overlaps the offset engagement surface 323 of lower housing 320. Additionally, central axis 377 of offset engagement surface 372 is offset or disposed at an angle relative to a central or longitudinal axis of lower adjustment mandrel 370. When bend adjustment assembly 300 is disposed in the first position, a first deflection angle is provided between the central axis of lower housing 320 and the central axis of lower adjustment mandrel 370, and when bend adjustment assembly 300 is disposed in the second position, a second deflection angle is provided between the central axis of lower housing 320 and the central axis of lower adjustment mandrel 370 that is different from the first deflection angle.

In the embodiment of FIGS. 5, 7, 9, 13, 15, 18, and 20, an annular seal 373 is disposed in the outer surface of lower adjustment mandrel 370 to sealingly engage the inner surface of lower housing 320. In this embodiment, relative rotation is permitted between lower housing 320 and lower adjustment mandrel 370 while relative axial movement is restricted between housing 320 and mandrel 370. In the embodiment of FIGS. 5, 7, 9, 13, 15, and 18, arcuate recess 374 is defined by an inner terminal end 374E and a pair of circumferentially spaced shoulders 375. In this embodiment, lower adjustment mandrel 370 further includes a pair of circumferentially spaced first or short slots 376 and a pair of circumferentially spaced second or long slots 378, where both short slots 376 and long slots 378 extend axially into lower adjustment mandrel 370 from lower end 370B. In this embodiment, each short slot 376 is circumferentially spaced approximately 180° apart. Similarly, in this embodiment, each long slot 378 is circumferentially spaced approximately 180° apart.

Referring to FIGS. 5, 7, 9, 13, and 14, locking piston 380 of bend adjustment assembly 300 is generally tubular and has a first or upper end 380A, a second or lower end 380B, and a central bore or passage extending therebetween. Locking piston 380 includes a generally cylindrical outer surface comprising an annular seal 382 disposed therein. In the embodiment of FIGS. 5, 7, 9, 13, and 14, locking piston 380 includes a pair of circumferentially spaced keys 384 that extend axially from upper end 380A, where each key 384 extends through one of the circumferentially spaced slots 331 of lower housing 320. In this arrangement, relative rotation between locking piston 380 and lower housing 320 is restricted while relative axial movement is permitted therebetween. As will be discussed further herein, each key 384 is receivable in either one of the short slots 376 or long slots 378 of lower adjustment mandrel 370 depending on the relative angular position between locking piston 380 and lower adjustment mandrel 370. In this embodiment, the outer surface of locking piston 380 includes an annular shoulder 386 located between ends 380A and 380B. In this embodiment, engagement between locking piston 380 and lower adjustment mandrel 370 serves to selectively restrict relative rotation between lower adjustment mandrel 370 and lower housing 320; however, in other embodiments, lower housing 320 includes one or more features (e.g., keys, etc.) receivable in slots 376, 378 to selectively restrict relative rotation between lower adjustment mandrel 370 and lower housing 320.

In this embodiment, the combination of sealing engagement between seal 382 of locking piston 380 and the inner surface 322 of lower housing 320, and seal 320S of housing 320 and the outer surface of locking piston 380, defines a lower axial end of locking chamber 395. Locking chamber 395 extends longitudinally from the lower axial end thereof to an upper axial end defined by the combination of sealing engagement between the outer seal 358A of compensating piston 356 and the inner seal 358B of piston 356. Particularly, lower adjustment mandrel 370 and upper adjustment mandrel 360 each include axially extending ports similar in configuration to the ports 330 of lower housing 320 such that fluid communication is provided between the annular space directly adjacent shoulder 386 of locking piston 380 and the annular space directly adjacent a lower end of compensating piston 356. Locking chamber 395 is sealed from annulus 116 such that drilling fluid flowing into annulus 116 is not permitted to communicate with fluid disposed in locking chamber 395, where locking chamber 395 is filled with lubricant.

Referring to FIGS. 10, 12, 16, and 17, locker assembly 400 of bend adjustment assembly 300 generally includes a actuator piston 402 and a torque transmitter or teeth ring 420. actuator piston 402 is slidably disposed about bearing mandrel 220 and has a first or upper end 402A, a second or lower end 402B, and a central bore or passage extending therebetween. In the embodiment of FIGS. 10, 12, 16, and 17, actuator piston 402 has a generally cylindrical outer surface including an annular shoulder 404 and an annular seal 406 located axially between shoulder 404 and lower end 402B. As shown particularly in FIGS. 12 and 16, the outer surface of actuator piston 402 includes a plurality of radially outwards extending and circumferentially spaced keys 408 received in the slots 349 of actuator housing 340. In this arrangement, actuator piston 402 is permitted to slide axially relative actuator housing 340 while relative rotation between actuator housing 340 and actuator piston 402 is restricted. Additionally, in this embodiment, actuator piston 402 includes a plurality of circumferentially spaced locking teeth 410 extending axially from lower end 402B.

In the embodiment of FIGS. 10, 12, 16, and 17, seal 406 of actuator piston 402 sealingly engages the inner surface 342 of actuator housing 340 and the seal 348 of actuator housing 340 sealingly engages the outer surface of actuator piston 402 to form an annular, sealed compensating chamber 411 (shown in FIG. 10) extending therebetween. Fluid pressure within compensating chamber 411 is compensated or equalized with the surrounding environment (e.g., borehole 16) via port 347 of actuator housing 340. Additionally, an annular biasing member 412 is disposed within compensating chamber 411 and applies a biasing force against shoulder 404 of actuator piston 402 in the axial direction of teeth ring 420. Teeth ring 420 of locker assembly 400 is generally tubular and comprises a first or upper end 420A, a second or lower end 420B, and a central bore or passage extending between ends 420A and 420B. Teeth ring 420 is coupled to bearing mandrel 220 via a plurality of circumferentially spaced splines or pins 422 disposed radially therebetween. In this arrangement, relative axial and rotational movement between bearing mandrel 220 and teeth ring 420 is restricted. In the embodiment of FIGS. 10, 12, 16, and 17, teeth ring 420 comprises a plurality of circumferentially spaced teeth 424 extending from upper end 420A. Teeth 424 of teeth ring 420 are configured to matingly engage or mesh with the teeth 410 of actuator piston 402 when biasing member 412 biases actuator piston 402 into contact with teeth ring 420, as will be discussed further herein.

As shown particularly in FIG. 10, in this embodiment, locker assembly 400 is both mechanically and hydraulically biased during operation of mud motor 35. Additionally, the driveline of mud motor 35 is independent of the operation of locker assembly 400 while drilling, thereby permitting 100% of the available torque provided by power section 40 to power drill bit 90 when locker assembly 400 is disengaged. The disengagement of locker assembly 400 may occur at high flowrates through mud motor 35, and thus, when higher hydraulic pressures are acting against actuator piston 402. Additionally, in some embodiments, locker assembly 400 may be used to rotate something parallel to bearing mandrel 220 instead of being used like a clutch to interrupt the main torque carrying driveline of mud motor 35. In this configuration, locker assembly 400 comprises a selective auxiliary drive that is simultaneously both mechanically and hydraulically biased. Further, this configuration of locker assembly 400 allows for various levels of torque to be applied as the hydraulic effect can be used to effectively reduce the preload force of biasing member 412 acting on mating teeth ring 420. This type of angled tooth clutch may be governed by the angle of the teeth (e.g., teeth 424 of teeth ring 420), the axial force applied to keep the teeth in contact, the friction of the teeth ramps, and the torque engaging the teeth to determine the slip torque that is required to have the teeth slide up and turn relative to each other.

In some embodiments, locker assembly 400 permits rotation in mud motor 35 to rotate rotor 50 and bearing mandrel 220 until bend adjustment assembly 300 has fully actuated, and then, subsequently, ratchet or slip while transferring relatively large amounts of torque to bearing housing 210. This reaction torque may be adjusted by increasing the hydraulic force or hydraulic pressure acting on actuator piston 402, which may be accomplished by increasing flowrate through mud motor 35. When additional torque is needed a lower flowrate or fluid pressure can be applied to locker assembly 400 to modulate the torque and thereby rotate bend adjustment assembly 300. The fluid pressure is transferred to actuator piston 402 by compensating piston 226. In some embodiments, the pressure drop across drill bit 90 may be used to increase the pressure acting on actuator piston 402 as flowrate through mud motor 35 is increased. Additionally, ratcheting of locker assembly 400 once bend adjustment assembly 300 reaches a fully bent position may provide a relatively high torque when teeth 424 are engaged and riding up the ramp and a very low torque when locker assembly 400 ratchets to the next tooth when the slipping torque value has been reached (locker assembly 400 catching again after it slips one tooth of teeth 424). This behavior of locker assembly 400 may provide a relatively good pressure signal indicator that bend adjustment assembly 300 has fully actuated and is ready to be locked.

Having described the structure of the embodiment of driveshaft assembly 100, bearing assembly 200, and bend adjustment assembly 300 shown in FIGS. 1-20, an embodiment for operating assemblies 100, 200, and 300 will now be described. As described above, bend adjustment assembly 300 includes first position 303 shown in FIG. 5 and second position 305 shown in FIG. 7. In the embodiment of FIGS. 1-20, first position 303 of assembly 300 corresponds to a 0° first deflection angle $\theta_1$ while second position 305 corresponds to a deflection angle $\theta_2$ that is greater than 0°. In some embodiments, central axis 115 of driveshaft housing 110 is parallel with, but laterally offset from central axis 225 of bearing mandrel 220 when bend adjustment assembly 300 is in first position; however, in other embodiments, axes 115 and 225 may be coaxial when bend adjustment assembly 300 is in first position 303. In the embodiment of FIGS. 1-20, locker assembly 400 is configured to control or facilitate the downhole or in-situ actuation or movement of bend adjustment assembly between deflection angles $\theta_1$ and $\theta_2$. In other words, when bend adjustment assembly 300 comprises first position 303 and first deflection angle $\theta_1$, bend 301 is removed. Conversely, when bend adjustment assembly 300 comprises second position 305 and second deflection angle $\theta_2$, bend 301 is provided along motor 35. As will be described further herein, in this embodiment, bend adjustment assembly 300 is configured to shift from the first position to the second position in response to rotation of lower housing 320 in a first direction relative to lower adjustment mandrel 370, and shift from the second position to the first position in response to rotation of lower housing 320 in a second direction relative to lower adjustment mandrel 370 that is opposite the first direction.

In the embodiment of FIGS. 1-20, bend adjustment assembly 300 may be actuated between deflection angles $\theta_1$ and $\theta_2$ via rotating offset housings 310 and 320 relative adjustment mandrels 360 and 370 in response to varying a flowrate of drilling fluid through annulus 116 and/or varying the degree of rotation of drillstring 21 at the surface. Particularly, locking piston 380 includes a first or locked position restricting relative rotation between offset housings 310, 320, and adjustment mandrels 360, 370, and a second or unlocked position axially spaced from the locked position that permits relative rotation between housings 310, 320, and adjustment mandrels 360, 370. In the locked position of locking piston 380 (shown in FIGS. 5, 7, 9, and 20), keys 384 are received in either short slots 376 (shown in FIG. 9) or long slots 378 of lower adjustment mandrel 370 (shown in FIG. 20), thereby restricting relative rotation between locking piston 380, which is not permitted to rotate relative lower housing 320, and lower adjustment mandrel 370. In the unlocked position of locking piston 380, keys 384 of locking piston 380 are not received in either short slots 376 or long slots 378 of lower adjustment mandrel 370, and thus, rotation is permitted between locking piston 380 and lower adjustment mandrel 370. Additionally, in the embodiment of FIGS. 1-20, bearing housing 210, actuator housing 340, lower housing 320, and upper housing 310 are threadably connected to each other. Similarly, lower adjustment mandrel 370, upper adjustment mandrel 360, and driveshaft housing 110 are each threadably connected to each other in this embodiment. Thus, relative rotation between offset housings 310, 320, and adjustment mandrels 360, 370, results in relative rotation between bearing housing 210 and driveshaft housing 110.

As described above, in the embodiment of FIGS. 1-20, offset bore 327 and offset engagement surface 323 of lower housing 320 are offset from central bore 329 and the central axis of housing 320 to form a lower offset angle, and offset engagement surface 365 of upper adjustment mandrel 360 is offset from the central axis of mandrel 360 to form an upper offset angle. Additionally, offset engagement surface 323 of lower housing 320 matingly engages the engagement surface 372 of lower adjustment mandrel 370 while the engagement surface 314 of upper housing 310 matingly engages the offset engagement surface 365 of upper adjustment mandrel 360. In this arrangement, the relative angular position between lower housing 320 and lower adjustment mandrel 370 determines the total offset angle (ranging from 0° to a maximum angle greater than 0°) between the central axes of lower housing 320 and driveshaft housing 110. The minimum angle (0° in this embodiment) occurs when the upper and lower offsets are in-plane and cancel out, while the maximum angle occurs when the upper and lower offsets are in-plane and additive. Therefore, by adjusting the relative angular positions between offset housings 310, 320, and adjustment mandrels 360, 370, the deflection angle θ and bend 301 of bend adjustment assembly 300 may be adjusted or manipulated in-turn. The magnitudes of bend 301 in positions 303 and 305 (e.g., the magnitudes of deflection angles $\theta_1$ and $\theta_2$) are controlled by the relative positioning of shoulders 328S and shoulders 375, which establish the extents of angular rotation in each direction. In this embodiment, lower housing 320 is provided with a fixed amount of spacing between shoulders 328S, while adjustment mandrel 370 can be configured with an optional amount of spacing between shoulders 375, allowing the motor to be set up with the desired bend setting options ($\theta_1$ and $\theta_2$) as dictated by a particular job simply by providing the appropriate configuration of lower adjustment mandrel 370.

Also as described above, locker assembly 400 is configured to control the actuation of bend adjustment assembly 300, and thereby, control the degree of bend 301. In the embodiment of FIGS. 1-20, locker assembly 400 is configured to selectively or controllably transfer torque from bearing mandrel 220 (supplied by rotor 50) to actuator housing 340 in response to changes in the flowrate of drilling fluid supplied to power section 40. Particularly, in this embodiment, to actuate bend adjustment assembly from the first deflection angle $\theta_1$ (unbent in this embodiment) to the second deflection angle $\theta_2$, the pumping of drilling mud from surface pump 23 and the rotation of drillstring 21 by rotary system 24 is ceased. Particularly, the pumping of drilling mud from surface pump 23 is ceased for a predetermined first time period. In some embodiments, the first time period over which pumping is ceased from surface pump 23 comprises approximately 15-120 seconds; however, in other embodiments, the first time period may vary. With the flow of drilling fluid to power section 40 ceased during the first time period, fluid pressure applied to the lower end 380B of locking piston 380 (from drilling fluid in annulus 116) is reduced, while fluid pressure applied to the upper end 380A of piston 380 is maintained, where the fluid pressure applied to upper end 380A is from lubricant disposed in locking chamber 395 that is equalized with the fluid pressure in borehole 16 via ports 114 and locking piston 356. With the fluid pressure acting against lower end 380B of locking piston 380 reduced, the biasing force applied to the upper end 380A of piston 380 via biasing member 354 (the force being transmitted to upper end 380A via the fluid disposed in locking chamber 395) is sufficient to displace or actuate locking piston 380 from the locked position with keys 384 received in long slots 378 of lower adjustment mandrel 370 (shown in FIG. 20), to the unlocked position with keys 384 free from long slots 378, thereby unlocking offset housings 310, 320, from adjustment mandrels 360, 370. In this manner, locking piston 380 comprises a first locked position with keys 384 receives in short slots 376 of lower adjustment mandrel 370 and a second locked position, which is axially spaced from the first locked position, with keys 384 receives in long slots 378 of lower adjustment mandrel 370.

Directly following the first time period, surface pump 23 resumes pumping drilling mud into drillstring 21 at a first flowrate that is reduced by a predetermined percentage from a maximum mud flowrate of well system 10, where the maximum mud flowrate of well system 10 is dependent on the application, including the size of drillstring 21 and BHA 30. For instance, the maximum mud flowrate of well system 10 may comprise the maximum mud flowrate that may be pumped through drillstring 21 and BHA 30 before components of drillstring 21 and/or BHA 30 are eroded or otherwise damaged by the mud flowing therethrough. In some embodiments, the first flowrate of drilling mud from surface pump 23 comprises approximately 1%-30% of the maximum mud flowrate of well system 10; however, in other embodiments, the first flowrate may vary. For instance, in some embodiments, the first flowrate may comprise zero or substantially zero fluid flow. In this embodiment, surface pump 23 continues to pump drilling mud into drillstring 21 at the first flowrate for a predetermined second time period while rotary system 24 remains inactive. In some embodiments, the second time period comprises approximately 15-120 seconds; however, in other embodiments, the second time period may vary.

During the second time period with drilling mud flowing through BHA 30 from drillstring 21 at the first flowrate, rotational torque is transmitted to bearing mandrel 220 via rotor 50 of power section 40 and driveshaft 120. Additionally, biasing member 412 applies a biasing force against shoulder 404 of actuator piston 402 to urge actuator piston 402 into contact with teeth ring 420, with teeth 410 of piston 402 in meshing engagement with the teeth 424 of teeth ring 420. In this arrangement, torque applied to bearing mandrel 220 is transmitted to actuator housing 340 via the meshing engagement between teeth 424 of teeth ring 420 (rotationally fixed to bearing mandrel 220) and teeth 410 of actuator piston 402 (rotationally fixed to actuator housing 340). Rotational torque applied to actuator housing 340 via locker assembly 400 is transmitted to offset housings 310, 320, which rotate (along with bearing housing 210) in a first rotational direction relative adjustment mandrels 360, 370. Particularly, extension 328 of lower housing 320 rotates through arcuate recess 374 of lower adjustment mandrel 370 until a shoulder 328S engages a corresponding shoulder 375 of recess 374, restricting further relative rotation between offset housings 310, 320, and adjustment mandrels 360, 370. Following the rotation of lower housing 320, bend adjustment assembly 300 forms second deflection angle $\theta_2$, and thus, provides bend 301 (shown in FIG. 7). Additionally, although during the actuation of bend adjustment assembly 300 drilling fluid flows therethrough at the first flowrate, the first flowrate is not sufficient to overcome the biasing force provided by biasing member 354 against locking piston 380 to thereby actuate locking piston 380 back into the locked position.

Directly following the second time period, with bend adjustment assembly 300 now forming second deflection angle $\theta_2$, the flowrate of drilling mud from surface pump 23 is increased from the first flowrate to a second flowrate that is greater than the first flowrate. In some embodiments, the second flowrate of drilling mud from surface pump 23 comprises approximately 50%-100% of the maximum mud flowrate of well system 10; however, in other embodiments, the second flowrate may vary. Following the second time period with drilling mud flowing through BHA 30 from drillstring 21 at the second flowrate, the fluid pressure applied to the lower end 380B of locking piston 380 is sufficiently increased to overcome the biasing force applied against the upper end 380A of piston 380 via biasing member 354, actuating or displacing locking piston 380 from the unlocked position to the locked position with keys 384 received in short slots 376 (shown in FIG. 9), thereby rotationally locking offset housings 310, 320, with adjustment mandrels 360, and 370.

Figure 19:
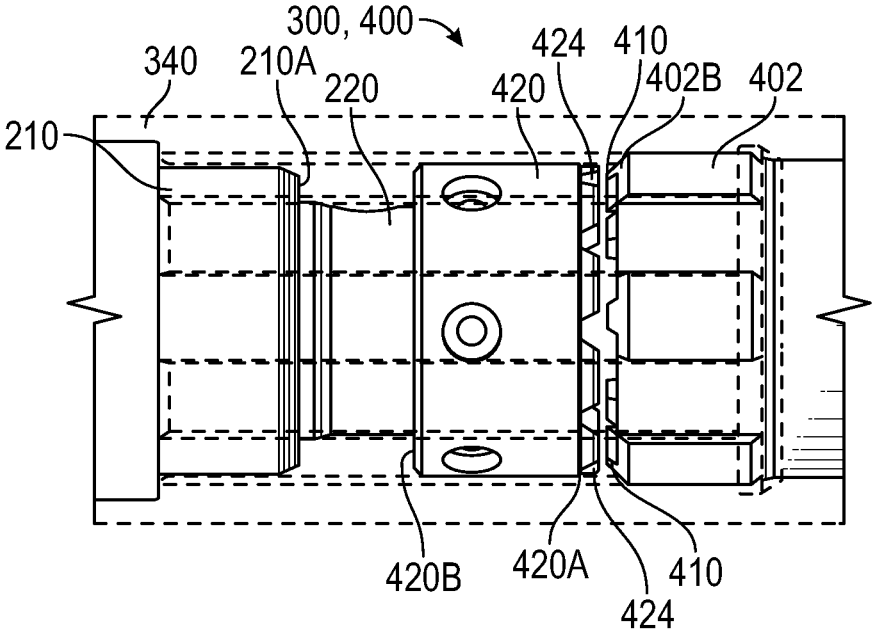
FIG. 19 is another zoomed-in, side cross-sectional view of the actuator assembly of FIG. 10.

Additionally, with drilling mud flowing through BHA 30 from drillstring 21 at the second flowrate, fluid pressure applied against the lower end 402B of actuator piston 402 from the drilling fluid (such as through leakage of the drilling fluid in the space disposed radially between the inner surface of actuator piston 402 and the outer surface of bearing mandrel 220) is increased, overcoming the biasing force applied against shoulder 404 by biasing member 412 and thereby disengaging actuator piston 402 from teeth ring 420 (shown in FIG. 19). With actuator piston 402 disengaged from teeth ring 420, torque is no longer transmitted from bearing mandrel 220 to actuator housing 340. Further, in the embodiment of FIGS. 1-20, a flow restriction is formed between the inner surface of locking piston 380 and shoulder 122 of driveshaft 120 when locking piston 380 is in the unlocked position. The flow restriction may be registered or indicated by a pressure increase in the drilling fluid pumped into drillstring 21 by surface pump 23, where the pressure increase results from the backpressure provided by the flow restriction. Thus, bend adjustment assembly 300 is configured in this embodiment to provide a surface indication of the position of locking piston 380. In some embodiments, the actuation of the locking piston 380 into the locked position may be registered at the surface via a reduction in backpressure resulting from a decrease in the flow restriction formed between locking piston 380 and the shoulder 122 of driveshaft 120. In some embodiments, the flowrate of drilling mud from surface pump 23 may be maintained at or above the second flowrate to ensure that locking piston 380 remains in the locked position. In some embodiments, as borehole 16 is drilled with bend adjustment assembly 300 in the second position 305, additional pipe joints may need to be coupled to the upper end of drillstring 21, necessitating the stoppage of the pumping of drilling fluid to power section 40 from surface pump 23. In some embodiments, following such a stoppage, the steps described above for actuating bend adjustment assembly 300 into the second position 305 may be repeated to ensure that assembly 300 remains in the second position 305.

On occasion, it may be desirable to actuate bend adjustment assembly 300 from the second or bent (in this embodiment) position 305 (shown in FIG. 7) to the first or straight (in this embodiment) position 303 (shown in FIG. 5). In this embodiment, bend adjustment assembly 300 is actuated from the bent position 305 to the straight position 303 by ceasing the pumping of drilling fluid from surface pump 23 for a predetermined third period of time. Either concurrent with the third time period or following the start of the third time period, rotary system 24 is activated to rotate drillstring 21 at a first or actuation rotational speed for a predetermined fourth period of time. In some embodiments, both the third time period and the fourth time period each comprise approximately 15-120 seconds; however, in other embodiments, the third time period and the fourth time period may vary. Additionally, in some embodiments, the actuation rotational speed comprises approximately 1-30 revolutions per minute (RPM) of drillstring 21; however, in other embodiments, the actuation rotational speed may vary. During the fourth time period, with drillstring 21 rotating at the actuation rotational speed, reactive torque is applied to bearing housing 210 via physical engagement between stabilizers 211 and the wall 19 of borehole 16, thereby rotating bearing housing 210 and offset housings 310, 320, relative to adjustment mandrels 360, 370 in a second rotational direction opposite the first rotational direction described above. Rotation of lower housing 320 causes shoulder 328 to rotate through recess 374 of lower adjustment mandrel 370 until a shoulder 328S physically engages a corresponding shoulder 375 of recess 374, restricting further rotation of lower housing 320 in the second rotational direction.

Figure 20:
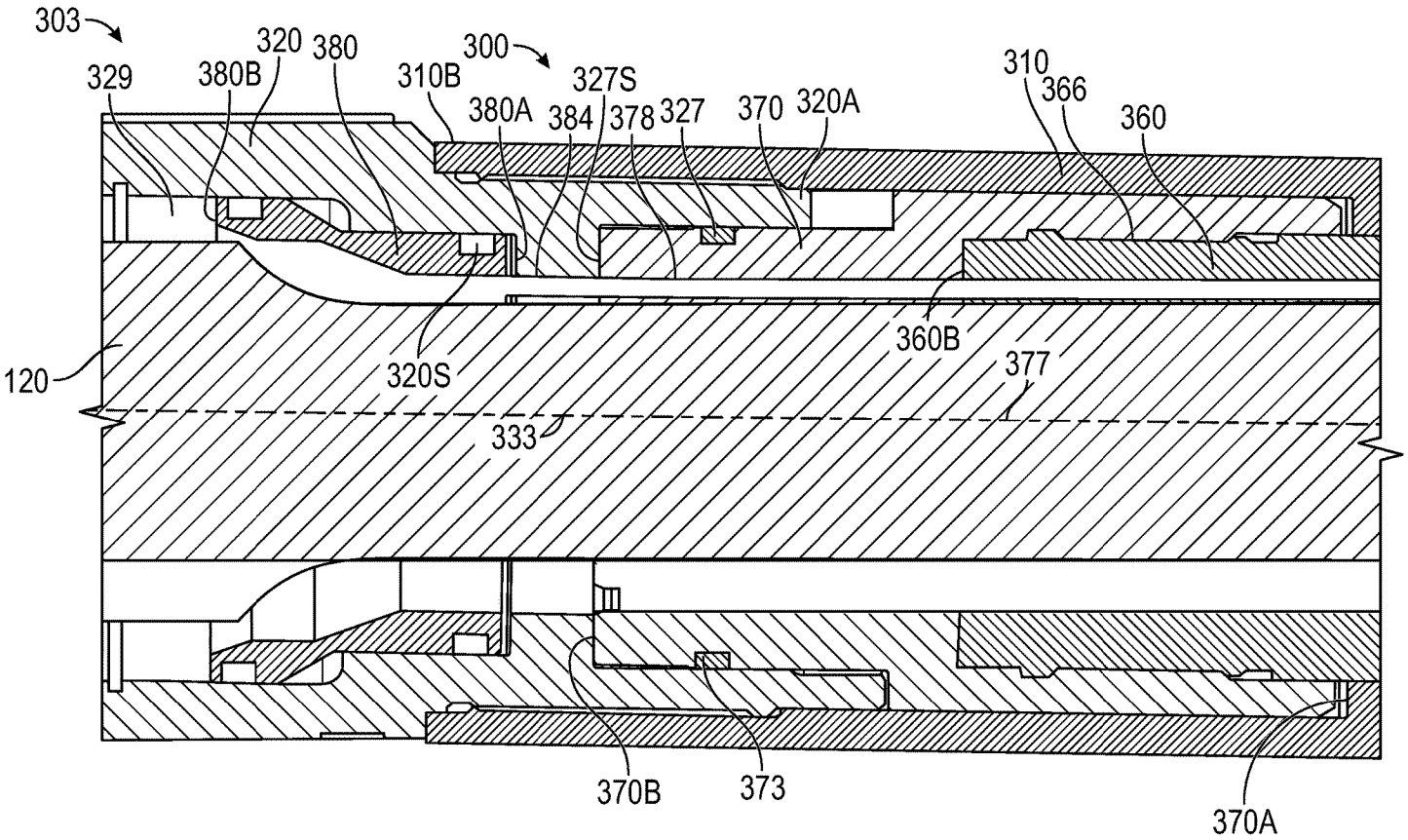
FIG. 20 is another zoomed-in, side cross-sectional view of the bend adjustment assembly of FIG. 4.

Following the third and fourth time periods (the fourth time period ending either at the same time as the third time period or after the third time period has ended), with bend adjustment assembly 300 disposed in the straight position 303 shown in FIG. 20, drilling mud is pumped through drillstring 21 from surface pump 23 at a third flowrate for a predetermined fifth period of time while drillstring 21 is rotated by rotary system 24 at the actuation rotational speed. In some embodiments, the fifth period of time comprises approximately 15-120 second and the third flowrate of drilling mud from surface pump 23 comprises approximately 30%-80% of the maximum mud flowrate of well system 10; however, in other embodiments, the firth period of time and the third flowrate may vary.

Following the fifth period of time, the flowrate of drilling mud from surface pump 23 is increased from the third flowrate to a flowrate near or at the maximum mud flowrate of well system 10 to thereby disengage locker assembly 400 and dispose locking piston 380 in the locked position. Once surface pump 23 is pumping drilling mud at the drilling or maximum mud flowrate of well system 10, rotation of drillstring 21 via rotary system 24 may be ceased or continued at the actuation rotational speed. With drilling mud being pumped into drillstring 21 at the third flowrate and the drillstring 21 being rotated at the actuation rotational speed, locker assembly 400 is disengaged and locking piston 380 is disposed in the locked position with keys 384 received in long slots 378 (shown in FIG. 9) of lower adjustment mandrel 370. With locker assembly 300 disengaged and locking piston 380 disposed in the locked position drilling of borehole 16 via BHA 30 may be continued with surface pump 23 pumping drilling mud into drillstring 21 at or near the maximum mud flowrate of well system 10. In the embodiment of FIGS. 1-20, the flow restriction formed between the inner surface of locking piston 380 and shoulder 122 of driveshaft 120 is reduced when locking piston 380 is in the locked position. In other embodiments, the flow restriction may be created when the locking piston 380 is in the locked position and reduced or abated when locking piston 380 is in the unlocked position such that the pressure signal registered at the surface occurs when piston 380 is in the locked position.

In other embodiments, instead of surface pump 23 at the third flowrate for a period of time following the third and fourth time periods, surface pump 23 may be operated immediately at 100% of the maximum mud flowrate of well system 10 to disengage locker assembly 400 and dispose locking piston 380 in the locked position. Once surface pump 23 is pumping drilling mud at the drilling or maximum mud flowrate of well system 10, rotation of drillstring 21 via rotary system 24 may be ceased or continued at the actuation rotational speed.

In an alternative embodiment, the procedures for shifting bend adjustment assembly 300 between the first position 303 and the second position 305 may be reversed by reconfiguring lower adjustment mandrel 370 of bend adjustment assembly 300. Particularly, in this alternative embodiment, the position of arcuate recess 374 is shifted 180° about the circumference of lower adjustment mandrel 370. By shifting the angular position of arcuate recess 374 180° about the circumference of lower adjustment mandrel 370, the alternative embodiment of bend adjustment assembly 300 may be shifted from the first position 303 to the second position 305 by ceasing the pumping of drilling fluid from surface pump 23 for the third period of time to shift locking piston 380 into the unlocked position. Then, either concurrent with third time period or following the start of the third time period, activating rotary system 24 to rotate drillstring 21 at the actuation rotational speed for the fourth period of time to apply reactive torque to bearing housing 210 and rotate offset housing 320 relative to adjustment mandrel 370 in the second rotational direction, thereby shifting the alternative embodiment of bend adjustment assembly 300 into the second position 305. Surface pump 23 may then be operated at the third flowrate for the fifth period of time or immediately operated at the maximum mud flowrate of well system 10 to shift locking piston into the locked position, thereby locking the alternative embodiment of bend adjustment assembly 300 into the second position 305.

Additionally, the alternative embodiment of bend adjustment assembly 300 may be shifted from the second position 305 to the first position 303 by ceasing rotation of drillstring 21 from rotary system 24 and ceasing the pumping of drilling mud from surface pump 23 for the first time period to thereby shift locking piston 380 into the unlocked position. Following the first time period, surface pump 23 resumes pumping drilling mud into drillstring 21 at the first flowrate for the second period of time while rotary system 24 remains inactive, thereby rotating lower adjustment mandrel 370 in the first rotational direction to shift the alternative embodiment of bend adjustment assembly 300 into the first position 301. Following the second time period, with the alternative embodiment of bend adjustment assembly 300 now disposed in first position 303, the flowrate of drilling mud from surface pump 23 is increased from the first flowrate to the second flowrate to shift locking piston 380 into the locked position, thereby locking the alternative embodiment of bend adjustment assembly 300 in the first position 303.

Figure 21:
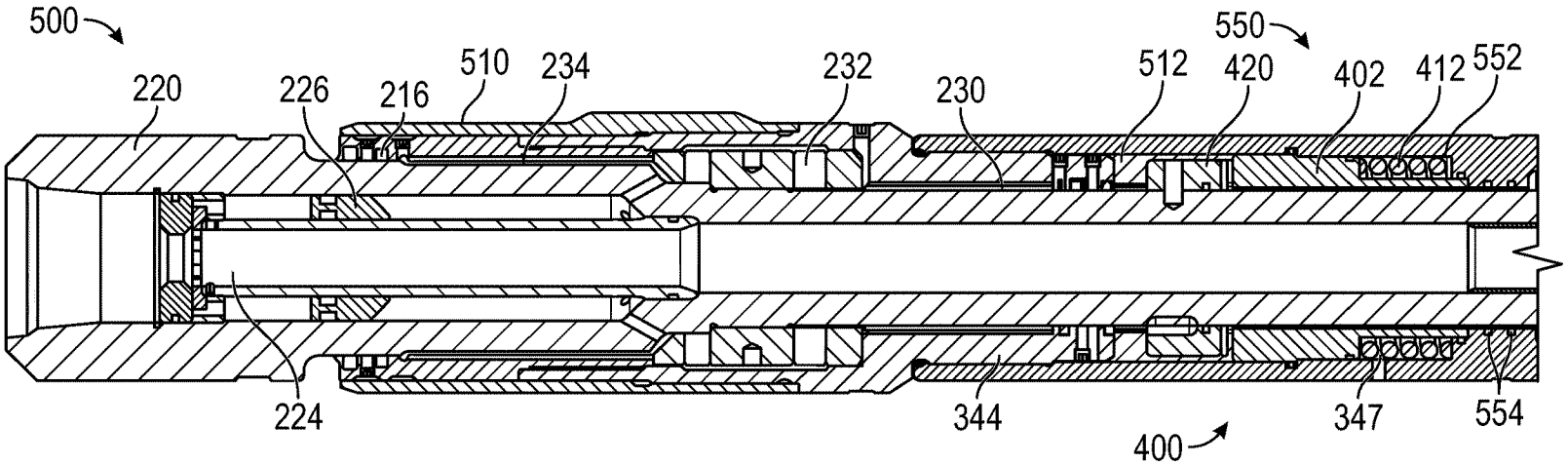
FIG. 21 is a side cross-sectional view of another embodiment of a bearing assembly and a bend adjustment assembly of the mud motor of FIG. 1 in accordance with principles disclosed herein.

Referring to FIG. 21, another embodiment of a bearing assembly 500 and a bend adjustment assembly 550 of the BHA 30 described above is shown. Bearing assembly 500 and bend adjustment assembly 550 include features in common with bearing assembly 200 and bend adjustment assembly 300 shown in FIGS. 1-20, and shared features are labeled similarly. Particularly, in the embodiment of FIG. 21, bearing assembly 500 includes a bearing housing 510 and bearing mandrel 220 rotatably disposed therein. In this embodiment, bearing housing 510 includes an oil or lubricant filled annular chamber 512 (sealed from the drilling fluid flowing through passage 221 of bearing mandrel 220) and lower seals 216, but does not include upper seals 214 like bearing housing 210 of the bearing assembly 200 described above. Instead, an upper axial end of annular chamber 512 is defined by a pair of annular seals 554 disposed in a generally cylindrical inner surface of a actuator housing 552 of bend adjustment assembly 550. Thus, in the embodiment of FIG. 21, chamber 512 extends into a central bore or passage of actuator housing 552. In this arrangement, actuator piston 402 and teeth ring 420 are each disposed within chamber 512, and thus, are not exposed to the drilling fluid flowing through passage 221 of bearing mandrel 220. However, the lower end 402B of actuator piston 402 is exposed to fluid pressure equal to the fluid pressure of the drilling fluid flowing through passage 221 due to the compensating or equalizing action provided by piston 226. In this manner, locker assembly 400 may operate similarly as described above while being lubricated by the lubricant disposed in chamber 512.

Figure 22:
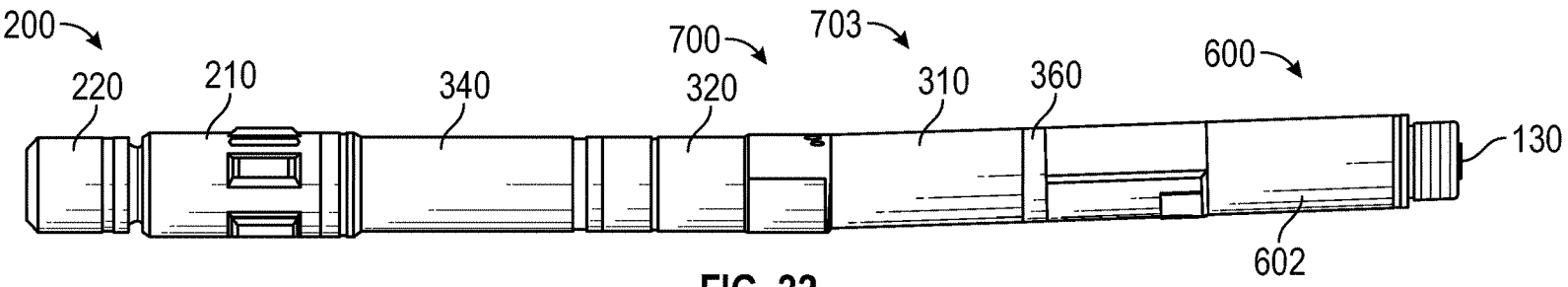
FIG. 22 is a side view of another embodiment of the mud motor of FIG. 1 in accordance with principles disclosed herein.
Figure 23:
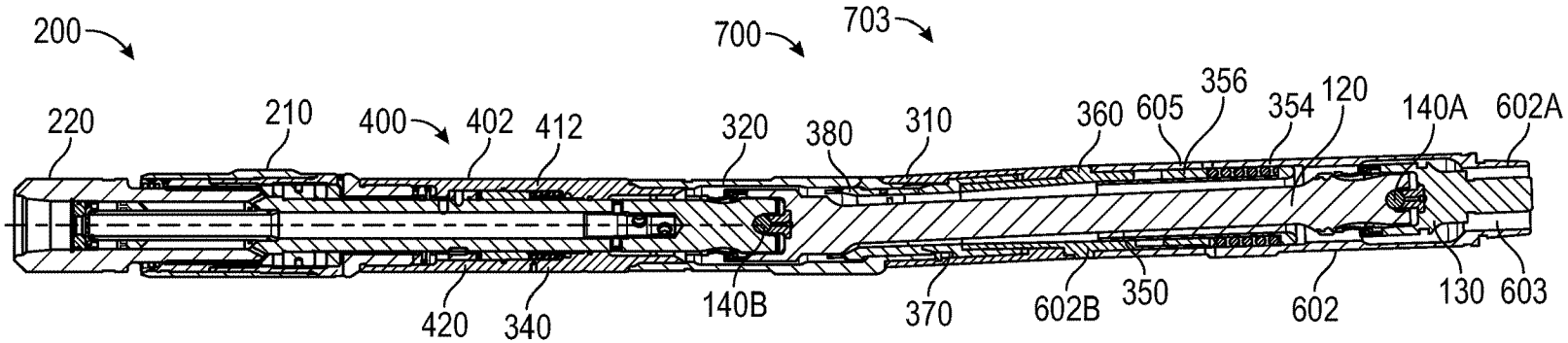
FIG. 23 is a side cross-sectional view of the mud motor of FIG. 22.
Figure 24:
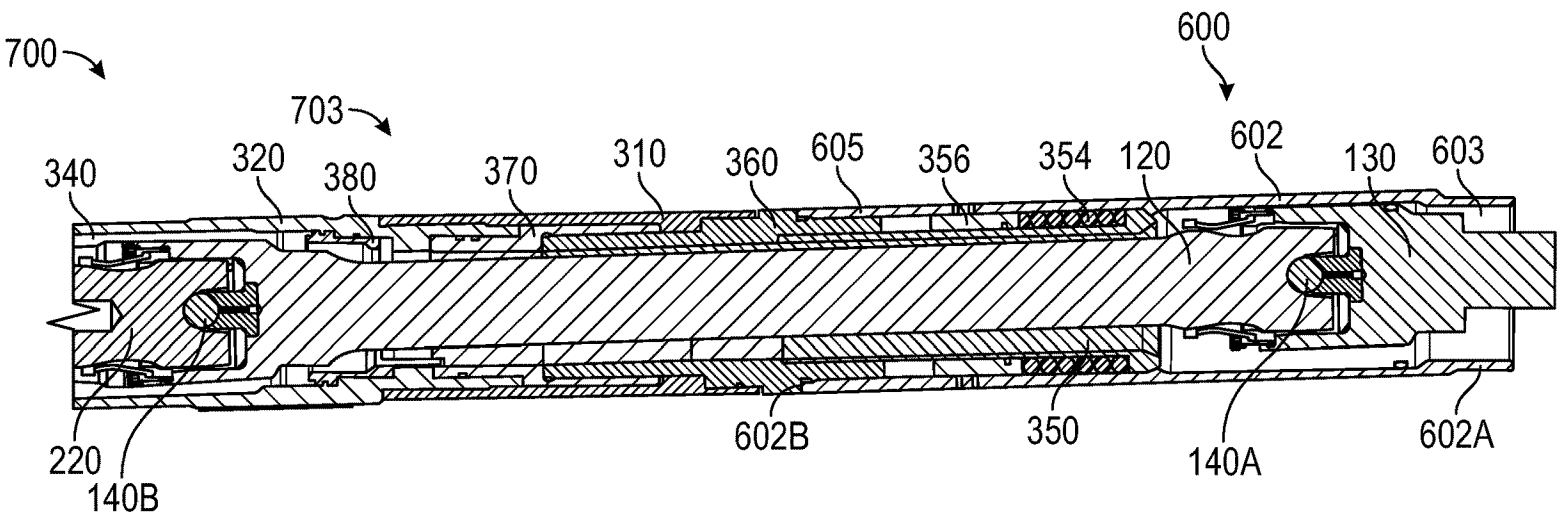
FIG. 24 is a zoomed-in, side cross-sectional view of an embodiment of a bend adjustment assembly of the mud motor of FIG. 22 in accordance with principles disclosed herein.
Figure 25:
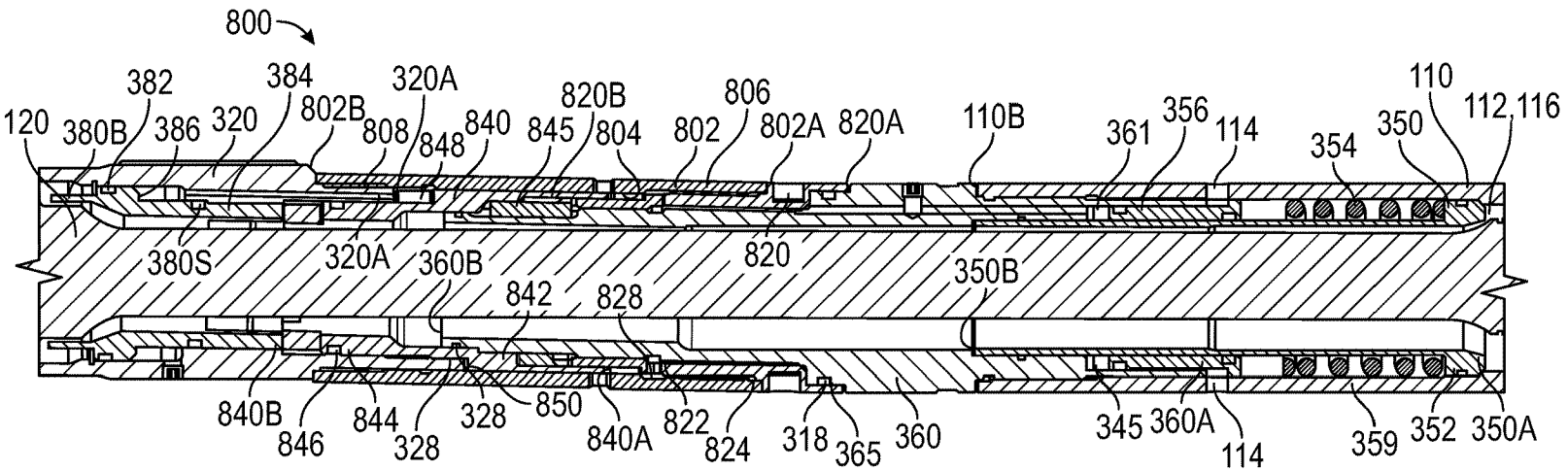
FIG. 25 is a side cross-sectional view of another embodiment of a bend adjustment assembly of the mud motor of FIG. 4 in accordance with principles disclosed herein.
Figure 26:
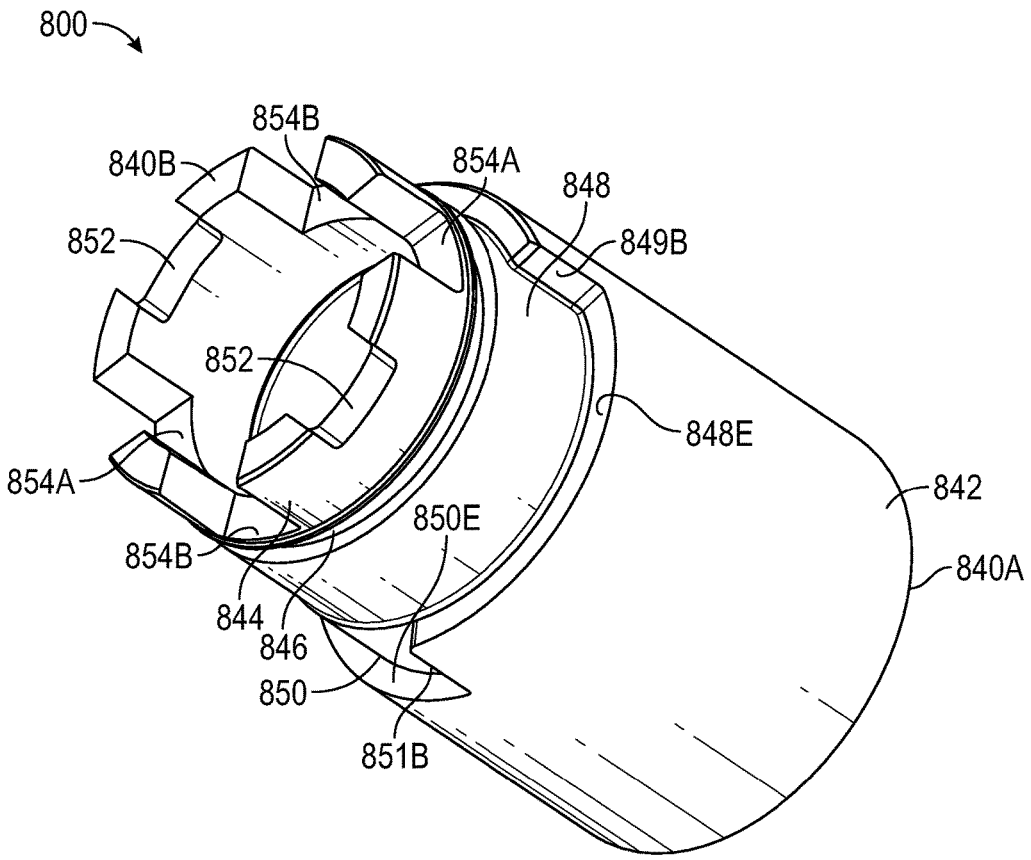
FIGS. 26, 27 are perspective views of an embodiment of an adjustment mandrel of the bend adjustment assembly of FIG. 25 in accordance with principles disclosed herein.
Figure 27:
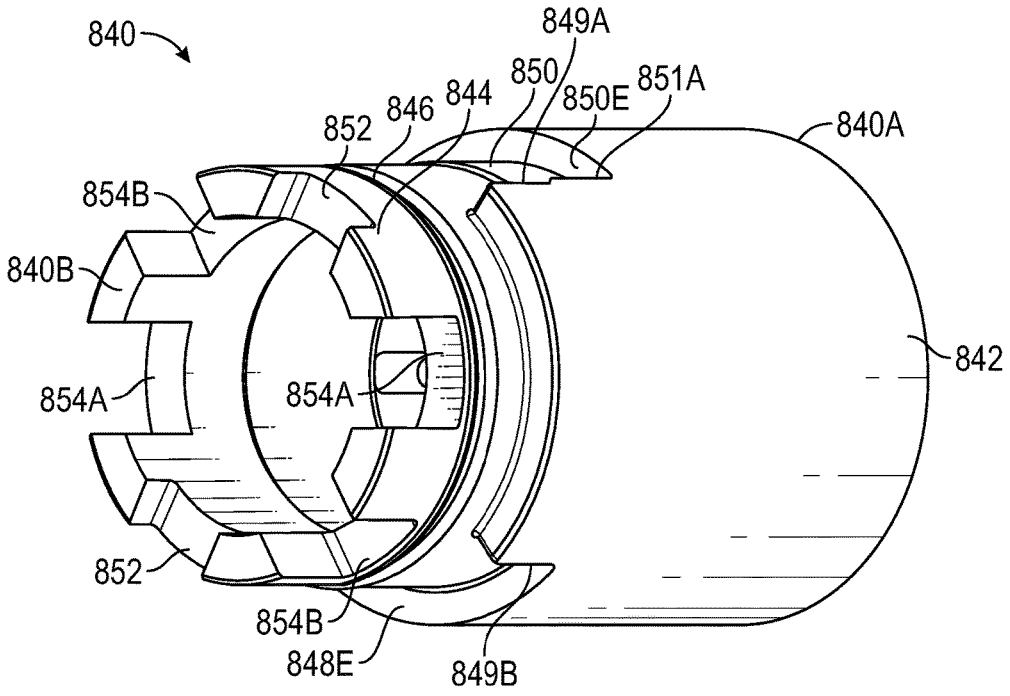
Figure 28:
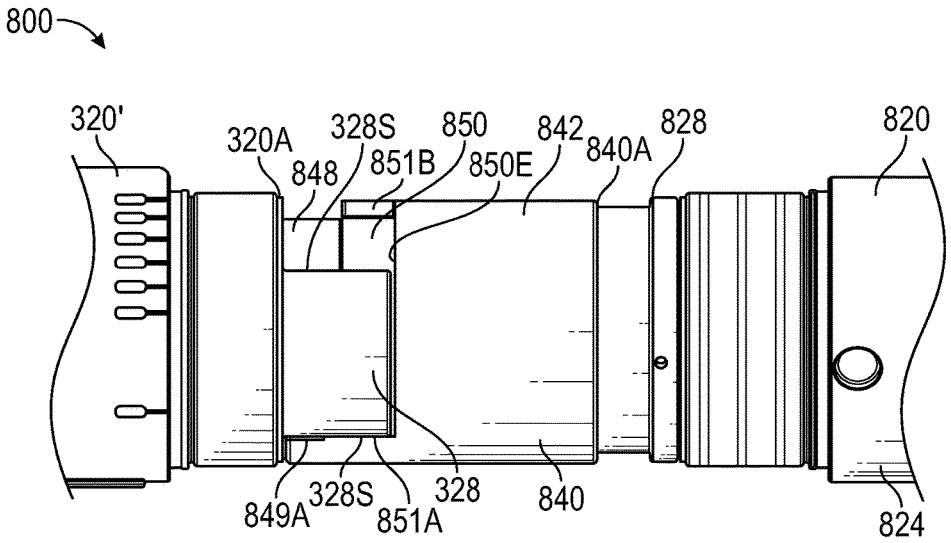
FIGS. 28, 29 are side views of the bend adjustment assembly of FIG. 25.
Figure 29:
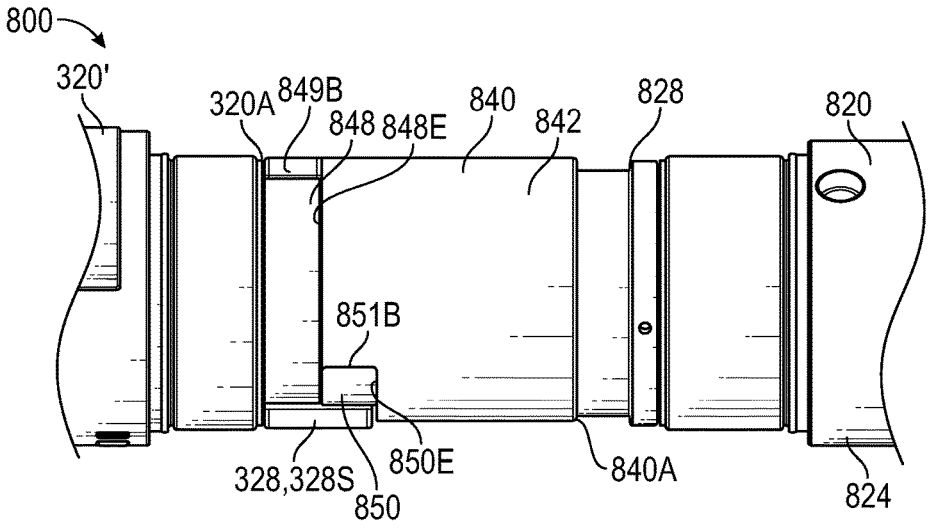
Figure 30:
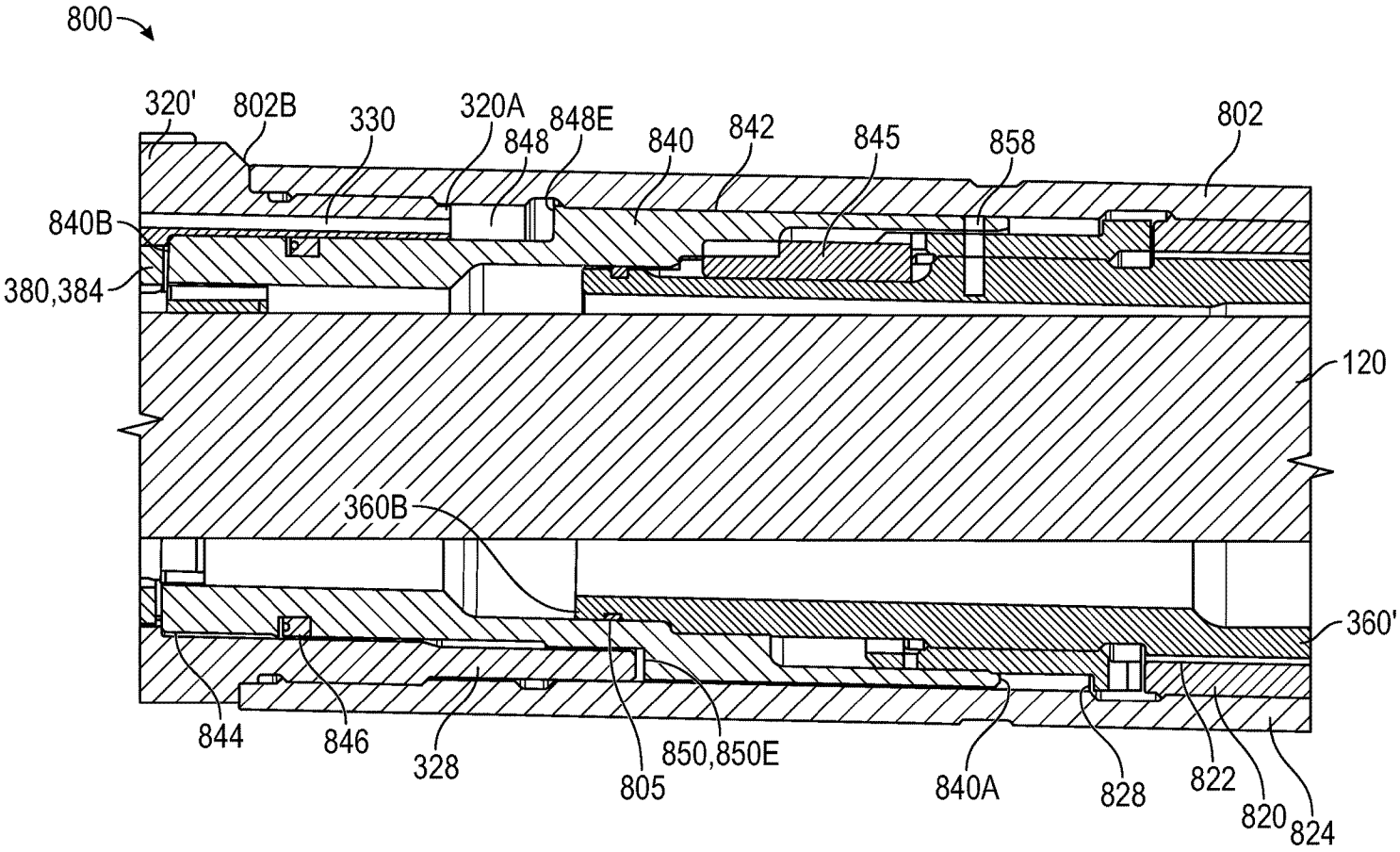
FIGS. 30-33 are zoomed-in, side cross-sectional views of the bend adjustment assembly of FIG. 25.
Figure 31:
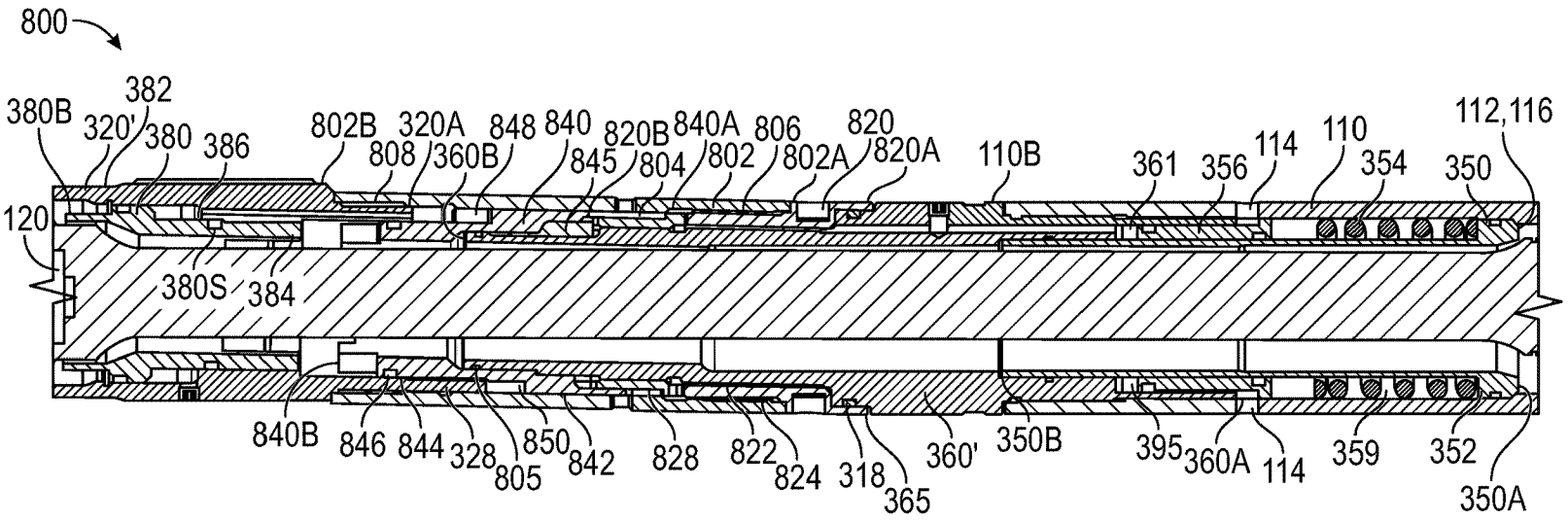
Figure 32:
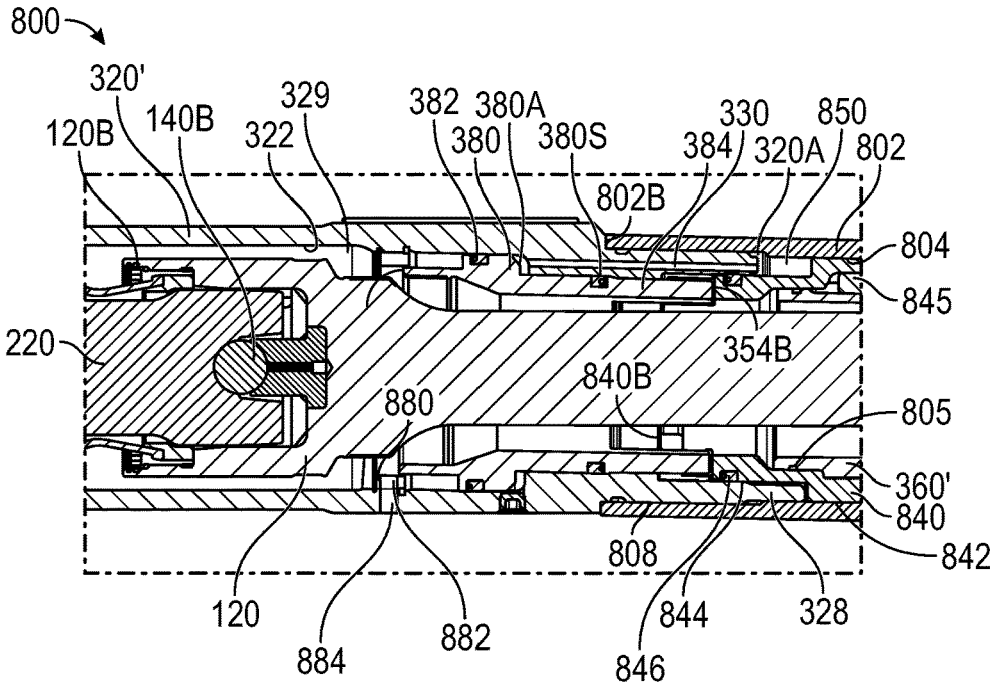
Figure 33:
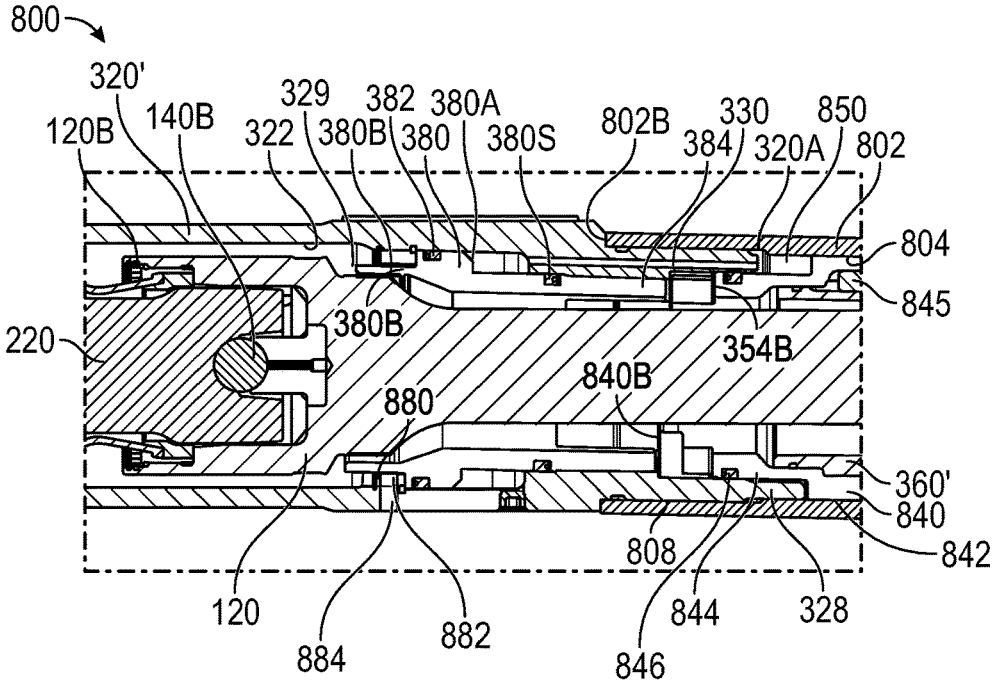

Referring to FIGS. 22-24, another embodiment of a driveshaft assembly 600 and a bend adjustment assembly of the BHA 30 described above is shown. Driveshaft assembly 700 includes features in common with driveshaft assembly 100 of FIGS. 4-20 while bend adjustment assembly 700 include features in common with bend adjustment assembly 300 of FIGS. 4-20, and shared features are labeled similarly. Particularly, in the embodiment of FIGS. 22-24, bend adjustment assembly 700 includes a first position 703 (shown in FIGS. 22-24) that corresponds to a first deflection angle $\theta_1$ and a second position (not shown) that corresponds to a second deflection angle $\theta_2$ that is less than the first deflection angle $\theta_1$ but greater than 0°. In other words, unlike the embodiment of bend adjustment assembly 300 shown in FIGS. 1-20 that actuates between an unbent first position 303 and a second, bent position 305 comprising bend 301, bend adjustment angle 700 of FIGS. 22-24 actuates between a first big-bend position 703 and a second small-bend position. In some embodiments, the degree or angle of bend provided by deflection angles $\theta_1$ and $\theta_2$ may be controlled or adjusted by adjusting the offset angle formed between the central axes of housing 320 and lower adjustment mandrel 370. In other embodiments, the degree or angle of bend provided by deflection angles $\theta_1$ and $\theta_2$ may be controlled or adjusted by adjusting the angular position of the arcuate recess 374 of lower adjustment mandrel 370. In other words, by shifting the angular position of arcuate recess 374, the degree or magnitude of bend 301 provided by first position 603 may be adjusted.

Additionally, in the embodiment of FIGS. 22-24, driveshaft assembly 600 includes a fixed bent housing 602 in lieu of the driveshaft housing 110 of the driveshaft assembly 100 shown in FIGS. 4-20. Particularly, bent housing 602, unlike driveshaft housing 110, has an offset axis where a first or upper end 602A of driveshaft housing 602 comprises a central bore or passage 603 having a central axis that is coaxial with longitudinal axis 25 of drillstring 21, and a second or lower end 602B comprising an offset bore or passage 605 having a central axis offset from the central axis of central bore 603. Particularly, central bore 603 is offset from offset bore 605 by deflection angle $\theta_2$. Thus, in the embodiment of FIGS. 22-24, the fixed bend produced between the upper and lower ends 602A and 602B of bent housing 602 defines deflection angle $\theta_2$. Adjustment mandrels 360 and 370 of bend adjustment assembly 700 function similarly as bend adjustment assembly 300 described above to allow the selective actuation of bend adjustment assembly 700 between the big-bend position 703 and the small-bend position, where there is no additional offset or deflection angle provided between the lower end 602B of driveshaft housing 602 and the lower end 220B of bearing mandrel 220 when bend adjustment assembly 700 is in the small-bend position. As with bend adjustment assembly 300, the procedures for shifting bend adjustment assembly 700 between big-bend position 703 and the small-bend position may be reversed by shifting the position of the position of arcuate recess 374 180° about the circumference of lower adjustment mandrel 370. Conversely, when bend adjustment assembly 700 is in the big-bend position 703, an additional offset or deflection angle is formed between the lower end 602B of driveshaft housing 602 and the lower end 220B of bearing mandrel 220, with the additional offset comprising the difference between deflection angle $\theta_1$ and deflection angle $\theta_2$. In some embodiments, deflection angles $\theta_1$ and $\theta_2$ are arranged to lie in the same angular direction such that the MWD toolface direction of drill bit 90 is maintained between the big-bend position 703 and the small-bend position.

In this embodiment, the upper and lower housings 310, 320 of bend adjustment assembly 300 may use different angles to permit bend adjustment assembly 300 to enter into multiple distinct "bent" positions to provide a "bent to bent" configuration. Particularly, by making upper housing 310 have a higher angle with a higher offset from the central axis of upper housing 310 and then providing a very low angle in the lower housing 320, smaller changes to the deflection angle (e.g., magnitude of bend 301) are possible. For example, lower housing 320 may be rotated 180 degrees and thus the high side of the deflection angle is dictated by the upper offset angle, which does not change position rotationally. Thus, the scribe for a MWD tool of drillstring 21 does not change either when the bend is adjusted with the lower offset at 0 or 180 degrees from this high side location of upper housing 310. Additionally, in some embodiments, upper housing 310 and lower housing 320 are additive in one position and subtract in the other—meaning that the resultant bend of this embodiment of bend adjustment assembly 300 may be, for example, approximately 1.5+0.5 or 2.0 degree if the upper offset angle is 1.5 degrees and the lower offsets angle is 0.5 degrees. The bend of this embodiment of bend adjustment assembly 300 with the lower housing 320 rotated 180 degrees may be, for example, 1 degree or 1.5-0.5 degrees. In this manner, a bent to bent configuration may be achieved with bend adjustment assembly 300 that utilizes similar methods and mechanisms as described above, including the permanent pressure signal and locking mechanisms described herein.

Referring to FIGS. 25-33, another embodiment of a bend adjustment assembly 800 of the BHA 30 of FIG. 1 is shown in FIGS. 25-33. Bend adjustment assembly 800 includes features in common with the bend adjustment assembly 300 shown in FIGS. 4-20, and shared features are labeled similarly. Unlike bend adjustment assembly 300, which is adjustable between two positions (e.g., first and second positions 303, 305), bend adjustment assembly 800 is adjustable between more than two positions. In the embodiment of FIGS. 25-33, bend adjustment assembly 800 includes an upper housing 802, an upper housing extension 820, and a lower adjustment mandrel 840. Upper housing 802 (hidden in FIGS. 28, 29) is generally tubular and has a first or upper end 802A, a second or lower end 802B, and a central bore or passage defined by a generally cylindrical inner surface 804 extending between ends 802A and 802B. The inner surface 804 of upper housing 802 includes a first or upper threaded connector 806 extending from upper end 802A, and a second or lower threaded connector 808 extending from lower end 802B coupled to the threaded connector located at the upper end 320A of lower housing 320'.

Upper housing extension 820 of bend adjustment assembly 800 is generally tubular and has a first or upper end 820A, a second or lower end 820B, a central bore or passage defined by a generally cylindrical inner surface 822 extending between ends 820A and 820B, and a generally cylindrical outer surface 824 extending between ends 820A and 820B. In this embodiment, the inner surface 822 of upper housing extension 820 includes an engagement surface 826 extending from upper end 820A that matingly engages the offset engagement surface 365 of upper adjustment mandrel 360'. Additionally, in this embodiment, the outer surface 824 of upper housing extension 820 includes a threaded connector coupled with the upper threaded connector 806 of upper housing 802 and an annular shoulder 828 facing lower adjustment mandrel 840.

Lower adjustment mandrel 840 of bend adjustment assembly 800 is generally tubular and has a first or upper end 840A, a second or lower end 840B, a central bore or passage extending therebetween that is defined by a generally cylindrical inner surface extending between ends 840A, 840B, and a generally cylindrical outer surface 842 extending between ends 840A, 840B. In this embodiment, outer surface 842 of lower adjustment mandrel 840 includes an offset engagement surface 844, an annular seal 846 in sealing engagement with the inner surface of lower housing 320', a first or lower arcuately extending recess 848, and a second or upper arcuately extending recess 850 axially spaced from lower arcuate recess 848. Offset engagement surface 844 has a central or longitudinal axis that is offset or disposed at an angle relative to a central or longitudinal axis of the upper end 840A of upper adjustment mandrel 840 and the lower end 320B of lower housing 320', where offset engagement surface 844 is disposed directly adjacent or overlaps the offset engagement surface 323 of lower housing 320'. In this embodiment, a plurality of circumferentially spaced cylindrical splines or keys 845 are positioned radially between lower adjustment mandrel 840 and upper adjustment mandrel 360' to restrict relative rotation between lower adjustment mandrel 840 and upper adjustment mandrel 360' while allowing for relative axial movement therebetween. Additionally, upper adjustment mandrel 360' includes an annular seal 805 that sealingly engages the inner surface of lower adjustment mandrel 840.

Lower arcuate recess 848 of lower adjustment mandrel 840 is defined by an inner terminal end 848E, a first shoulder 849A, and a second shoulder 849B circumferentially spaced from first shoulder 849A. Similarly, upper arcuate recess 850 of lower adjustment mandrel 840 is defined by an inner terminal end 850E, a first shoulder 851A, and a second shoulder 851B circumferentially spaced from first shoulder 851A. The inner end 848E of lower arcuate recess 848 is positioned nearer to the lower end 840B of mandrel 840 than the inner end 850E of upper arcuate recess 850. Additionally, while first shoulder 849A of lower arcuate recess 848 is generally circumferentially aligned with first shoulder 851A of upper arcuate recess 850, second shoulder 849B of lower arcuate recess 848 is circumferentially spaced from second shoulder 851B of upper arcuate recess 850. In this arrangement, the circumferential length extending between shoulders 849A, 849B of lower arcuate recess 848, is greater than the circumferential length extending between shoulders 851A, 851B of upper arcuate recess 850. Particularly, in this embodiment, lower arcuate recess 848 extends approximately 160° about the circumference of lower adjustment mandrel 840 while upper arcuate recess 850 extends approximately 60° about the circumference of lower adjustment mandrel 840; however, in other embodiments, the circumferential length of both lower arcuate recess 848 and upper arcuate recess 850 about lower adjustment mandrel 840 may vary. As will be discussed further herein, In this embodiment, lower adjustment mandrel 840 also includes a pair of circumferentially spaced first or short slots 852, a pair of circumferentially spaced second or long slots 854A, and a second pair of circumferentially spaced long slots 854B, where both short slots 852 and long slots 854A, 854B extend axially into lower adjustment mandrel 840 from lower end 840B. In this embodiment: each short slot 852 is circumferentially spaced approximately 180° apart, each long slot 854A is circumferentially spaced approximately 180° apart, and each long slot 854B is circumferentially spaced approximately 180° apart. Each pair of circumferentially spaced slots 852, 854A, and 854B is configured to matingly receive and engage the keys 384 of locking piston 380 to restrict relative rotation between lower adjustment mandrel 840 and lower housing 320'.

Unlike the lower adjustment mandrel 370 of bend adjustment assembly 300, lower adjustment mandrel 840 of bend adjustment assembly 800 is permitted to move axially relative to lower housing 320'. Particularly, lower adjustment mandrel 840 is permitted to travel between a first axial position in upper housing 806 (shown in FIGS. 25, 29, and 30) and a second axial position in upper housing 806 (shown in FIGS. 31-33) that is axially spaced from the first axial position. When lower adjustment mandrel 840 is disposed in the first axial position, the extension 328 of lower housing 320' is received in the upper arcuate recess 850 of lower adjustment mandrel 840 and the upper end 840A of mandrel 840 is axially spaced from shoulder 828 of upper housing extension 820. Conversely, when lower adjustment mandrel 840 is disposed in the second axial position, the extension 328 of lower housing 320' is received in the lower arcuate recess 848 of lower adjustment mandrel 840 and the upper end 840A of mandrel contacts or is disposed directly adjacent shoulder 828 of upper housing extension 820. As shown particularly in FIG. 30, in this embodiment, lower adjustment mandrel 840 is initially held or retained in the first axial position when BHA 30 is run into borehole 16 via a shear pin 858 (shown in FIG. 30) extending radially between lower adjustment mandrel 840 and upper housing extension 820. Shear pin 858 is designed to shear or break upon the application of a predetermined axially directed force against lower adjustment mandrel 840 to allow lower adjustment mandrel 840 to travel from the first axial position to the second axial position.

As described above, bend adjustment assembly 800 is adjustable between more than two positions while disposed in borehole 16. Particularly, in this embodiment, bend adjustment assembly 800 is adjustable between a first position that is unbent, a first bent position providing a first deflection angle between the longitudinal axis 95 of drill bit 90 and the longitudinal axis 25 of drillstring 21, and a second bend position providing a second deflection angle between the longitudinal axis 95 of drill bit 90 and the longitudinal axis 25 of drillstring 21 that is greater than the first deflection angle. In other embodiments, bend adjustment assembly 800 may incorporate a fixed bend, similar to the fixed bend provided by bent housing 602 of the driveshaft assembly 600 shown in FIGS. 22-24, thereby allowing bend adjustment assembly 800 to provide three unbent deflection angles between its first, second, and third positions.

In this embodiment, bend adjustment assembly 800 is initially deployed in borehole 16 in the first position where there is no deflection angle between the longitudinal axis 95 of drill bit 90 and the longitudinal axis 25 of drillstring 21. In the first position of bend adjustment assembly 800, lower adjustment mandrel 840 is retained in the lower position by shear pin 858. Additionally, in the first position, extension 328 of lower housing 320' is received in upper arcuate recess 850 of lower adjustment mandrel 840 with a first of the axially extending shoulders 328S of extension 328 contacting or disposed directly adjacent first shoulder 851A of upper arcuate recess 850 and the second of the axially extending shoulders 328S of extension 328 circumferentially spaced from second shoulder 851B of upper arcuate recess 850.

As borehole 16 is drilled by the drill bit 90 of BHA 30 with bend adjustment assembly 800 disposed in the first position, drillstring 21 is rotated by rotary system 24 and drilling mud is pumped through drillstring 21 from surface pump 23 at a drilling flowrate. In some embodiments, the drilling flowrate comprises approximately 50%-80% of the maximum mud flowrate of well system 10. While drillstring 21 is rotated by rotary system 24 and mud is pumped through drillstring 21 at the drilling flowrate, locking piston 380 is disposed in the locked position with keys 384 of locking piston 380 are received in the first pair of long slots 854B, thereby restricting relative rotation between lower adjustment mandrel 840 and lower housing 320' (locking piston 380 being rotationally locked with lower housing 320').

When it is desired to actuate bend adjustment assembly 800 from the first position to the second position and thereby provide the first deflection angle between drill bit 90 and drillstring 21, rotation of drillstring 21 from rotary system 24 is ceased and the pumping of drilling mud from surface pump 23 is ceased for a predetermined first time period. In some embodiments, the first time period over which pumping is ceased from surface pump 23 comprises approximately 15-60 seconds; however, in other embodiments, the first time period may vary. With the flow of drilling fluid to power section 40 ceased, biasing member 354 displaces locking piston 380 from the locked position with keys 384 received in the first pair of long slots 854A of lower adjustment mandrel 840, to the unlocked position with keys 384 free from long slots 854A, thereby unlocking lower housing 320' from lower adjustment mandrel 840.

Following the first time period, surface pump 23 resumes pumping drilling mud into drillstring 21 at a first flowrate that is reduced by a predetermined percentage from the maximum mud flowrate of well system 10. In some embodiments, the first flowrate of drilling mud from surface pump 23 comprises approximately 1%-30% of the maximum mud flowrate of well system 10; however, in other embodiments, the first flowrate may vary. For instance, in some embodiments, the first flowrate may comprise zero or substantially zero fluid flow. In this embodiment, surface pump 23 continues to pump drilling mud into drillstring 21 at the first flowrate for a predetermined second time period while rotary system 24 remains inactive. In some embodiments, the second time period comprises approximately 15-120 seconds; however, in other embodiments, the second time period may vary.

During the second time period rotational torque is transmitted to bearing mandrel 220 via rotor 50 of power section 40 and driveshaft 120. Additionally, torque applied to bearing mandrel 220 is transmitted to actuator housing 340 via the meshing engagement between teeth 424 of teeth ring 420 and teeth 410 of actuator piston 402. Rotational torque applied to actuator housing 340 via locker assembly 400 is transmitted to housings 310, 320', which rotate in the first rotational direction relative lower adjustment mandrel 840. Particularly, lower housing 320' rotates until one of the shoulders 328S of lower housing 320' contacts second shoulder 851B of the upper arcuate recess 850 of lower adjustment mandrel 840, restricting further rotation of lower housing 320' in the first rotational direction. Following the rotation of lower housing 320', bend adjustment assembly 800 is disposed in the second position, thereby forming the first deflection angle of assembly 800 between drill bit 90 and drillstring 21.

Following the second time period, with bend adjustment assembly 800 now disposed in the second position, the flowrate of drilling mud from surface pump 23 is increased from the first flowrate to a second flowrate that is greater than the first flowrate to displace locking piston 380 back into the locked position with keys 384 now received in the second pair of long slots 854B of lower adjustment mandrel 800. In some embodiments, the second flowrate of drilling mud from surface pump 23 comprises the drilling flowrate (e.g., approximately 50%-100% of 50%-80% of the maximum mud flowrate of well system 10); however, in other embodiments, the second flowrate may vary. Additionally, with drilling mud flowing through BHA 30 from drillstring 21 at the second flowrate, actuator piston 402 is disengaged from teeth ring 420, preventing torque from being transmitted from bearing mandrel 220 to actuator housing 340. With locking piston 380 now disposed in the locked position and actuator piston 402 being disengaged from teeth ring 420, BHA 30 may resume drilling borehole 16.

When it is desired to actuate bend adjustment assembly 800 from the second position to the third position and thereby provide the second deflection angle of assembly 800 between drill bit 90 and drillstring 21, rotation of drillstring 21 by rotary system 24 is ceased and the mud flowrate of surface pump 23 is increased to a third flowrate that is greater than the drilling flowrate. In some embodiments, the third flowrate of drilling mud from surface pump 23 comprises approximately 80%-100% of the maximum mud flowrate of well system 10; however, in other embodiments, the first flowrate may vary. The increased flowrate provided by the third flowrate increases the hydraulic pressure acting against the lower end 380B of locking piston 380, with locking piston 380 transmitting the hydraulic pressure force applied against lower end 380B to lower adjustment mandrel 840 via contact between keys 384 of locking piston 380 and the lower end 840B of lower adjustment mandrel 840. In this embodiment, the force applied to lower adjustment mandrel 840 from locking piston 380 is sufficient to shear the shear pin 858, thereby allowing both locking piston 380 and lower adjustment mandrel 840 to shift or move axially upwards through lower housing 320' and upper housing 802 until lower adjustment mandrel 840 is disposed in the second axial position with the upper end 840A of lower adjustment mandrel 840 contacting shoulder 828 of upper housing extension 820. Following the displacement of lower adjustment mandrel 840 into the second axial position, extension 328 of lower housing 320' is received in lower arcuate recess 848 (and is spaced from the inner end 850E of upper arcuate recess 850) of lower adjustment mandrel 840, with axially extending shoulders 328S of extension 328 circumferentially spaced from both the first and second shoulders 849A, 849B of upper arcuate recess 848.

Once lower adjustment mandrel 840 is located in the second axial position, the pumping of drilling mud from surface pump 23 is ceased for a predetermined third time period. In some embodiments, the third time period over which pumping is ceased from surface pump 23 comprises approximately 15-60 seconds; however, in other embodiments, the third time period may vary. With the flow of drilling fluid to power section 40 ceased, biasing member 354 displaces locking piston 380 from the locked position with keys 384 received in the second pair of long slots 854B of lower adjustment mandrel 840, to the unlocked position with keys 384 free from long slots 854B, thereby unlocking lower housing 320' from lower adjustment mandrel 840.

Following the third time period, surface pump 23 resumes pumping drilling mud into drillstring 21 at the first flowrate for a predetermined fourth time period while rotary system 24 remains inactive. In some embodiments, the fourth time period comprises approximately 15-120 seconds; however, in other embodiments, the fourth time period may vary. During the fourth time period rotational torque is transmitted to actuator housing 340 via the meshing engagement between teeth 424 of teeth ring 420 and teeth 410 of actuator piston 402. Rotational torque applied to actuator housing 340 via locker assembly 400 is transmitted to housings 310, 320', which rotate in the first rotational direction relative lower adjustment mandrel 840. Particularly, lower housing 320' rotates until one of the shoulders 328S of lower housing 320' contacts second shoulder 49B of the lower arcuate recess 848 of lower adjustment mandrel 840, restricting further rotation of lower housing 320' in the first rotational direction. Following the rotation of lower housing 320', bend adjustment assembly 800 is disposed in the third position, thereby forming the second deflection angle of assembly 800 between drill bit 90 and drillstring 21. With bend adjustment assembly 800 now disposed in the third position, the flowrate of drilling mud from surface pump 23 is increased from the first flowrate to the second flowrate to displace locking piston 380 back into the locked position with keys 384 now received in short slots 852 of lower adjustment mandrel 800. Additionally, with drilling mud flowing through BHA 30 from drillstring 21 at the second flowrate, actuator piston 402 is disengaged from teeth ring 420, preventing torque from being transmitted from bearing mandrel 220 to actuator housing 340. With locking piston 380 now disposed in the locked position and actuator piston 402 being disengaged from teeth ring 420, BHA 30 may resume drilling borehole 16.

In this embodiment, the transition of locking piston 380 into the locked position with keys 384 received in short slots 852 of lower adjustment mandrel 840 is indicated or registered at the surface by an increase in pressure at the outlet of surface pump 23 in response to the formation of a flow restriction in bend adjustment assembly 800. Particularly, as shown particularly in FIGS. 32, 33, in this embodiment, lower housing 320' comprises a ring 880 coupled to the inner surface 322 thereof, ring 880 including a radial port 882 extending therethrough that is circumferentially and axially aligned with a radial port 884 formed in lower housing 320'. When keys 384 are received in one of the pairs of long slots 854A, 854B of lower adjustment mandrel 840 (shown in FIG. 32), radial ports 882, 884 of ring 880 and lower housing 320', respectively, are not covered by locking piston 380, with the lower end 380B of locking piston 380 being disposed adjacent or axially spaced from radial ports 882, 884. In the position of locking piston 380 shown in FIG. 32, when drilling mud is pumped from surface pump 23 through bend adjustment assembly 800, a portion of the pumped drilling mud may be bled into borehole 16 via ports 882, 884, thereby reducing the pressure at the outlet of surface pump 23 at a given flowrate of surface pump 23.

Conversely, when keys 384 are received in short slots 852 of lower adjustment mandrel 840 (shown in FIG. 33), radial ports 882, 884 of ring 880 and lower housing 320', respectively, are obstructed or covered by locking piston 380, with the lower rend 380B of locking piston 380 being disposed axially below radial ports 882, 884. In the position of locking piston 380 shown in FIG. 33, when drilling mud is pumped from surface pump 23 through bend adjustment assembly 800, the pumped drilling mud is obstructed from flowing through radial ports 882, 884, thereby providing a pressure signal at the surface by increasing the pressure at the outlet of surface pump 23 at the given flowrate of surface pump 23. In other words, at a fixed flowrate of drilling mud pumped from surface pump 23, the pressure at the outlet of surface pump 23 will be less when keys 384 of locking piston 380 are received in one of the pairs of long slots 854A, 854B of lower adjustment mandrel 840 (corresponding with the first and second positions of bend adjustment assembly 800) than when keys 384 are received in short slots 852 (corresponding with the third position of bend adjustment assembly 800). In other embodiments, locking piston 380 and/or lower adjustment mandrel 840 may be configured such that the pressure signal is provided at the surface when bend adjustment assembly 800 is in the first and/or second positions rather than the third position. In other words, locking piston 380 and/or lower adjustment mandrel 840 may be configured such that the pressure signal is provided when bend adjustment assembly 800 is not at a maximum bend setting (e.g., the second deflection angle of assembly 800), whereas, in this embodiment, the pressure signal is provided when bend adjustment assembly 800 is at the maximum bend setting.

On occasion, it may be desirable to shift bend adjustment assembly 800 from the third position (corresponding with the second deflection angle of assembly 800) to the first position (corresponding to the unbent position of assembly 800). In this embodiment, bend adjustment assembly 800 is actuated from the third position to the first position by ceasing the pumping of drilling fluid from surface pump 23 for a predetermined fifth period of time. Either concurrent with the fifth time period or following the start of the fifth time period, rotary system 24 is activated to rotate drillstring 21 at the actuation rotational speed for a predetermined sixth period of time. In some embodiments, both the fifth time period and the sixth time period each comprise approximately 15-120 seconds; however, in other embodiments, the fifth and sixth time periods may vary. During the sixth time period, with drillstring 21 rotating at the actuation rotational speed, reactive torque is applied to bearing housing 210 via physical engagement between stabilizers 211 and the wall 19 of borehole 16, thereby rotating lower housing 320' relative to lower adjustment mandrel 840 in the second rotational direction. Rotation of lower housing 320' causes extension 328 to rotate through lower arcuate recess 848 of lower adjustment mandrel 840 until a shoulder 328S of extension 328 contacts the first shoulder 849A of lower arcuate recess 848, restricting further rotation of lower housing 320' in the second rotational direction. Following the fifth and sixth time periods (the sixth time period ending either at the same time as the fifth time period or after the fifth time period has ended), drilling mud is pumped through drillstring 21 from surface pump 23 at the drilling flowrate to permit BHA 30 to continue drilling borehole 16 with bend adjustment assembly 800 disposed in the first position such that no deflection angle is provided between the longitudinal axis 95 of drill bit 90 and the longitudinal axis 25 of drillstring 21.

Referring to FIGS. 4-33, locking piston 380 (shown particularly in FIGS. 13, 14, 24, and 32) is used to both lock relative rotation in bend adjustment assemblies 300, 800 and selectively create a pressure increase similar to a choke. In some embodiments, the choke assembly comprising locking piston 380 may be used for multiple bend settings of bend adjustment assemblies 300, 800 while only changing a single component—the lower adjustment mandrel (e.g., lower adjustment mandrels 370, 840). The overall functionality of the lock signal provided by bend adjustment assemblies 300, 800, and maximum bend angle (e.g., magnitude of bend 301) can be adjusted by changing only the lower adjustment mandrel. This modularity may provide an advantage as being able to quickly and cheaply provide a highly configurable bend adjustment assembly that is identically operable across many different bend angles.

Additionally, the design of the bend adjustment assembly (e.g., bend adjustment assemblies 300, 800) where lock piston 380 is activated using biasing member 354 and a fluid column positioned upwards from lock piston 380 allows relatively large biasing forces to be applied to locking piston 380 while avoiding a relatively long bit-to-bend distance (e.g., bit-to-bend distance D shown in FIG. 1). The fluid column and compensating piston 356 that engage biasing member 354 and connect it to locking piston 380 may allow for the bend adjustment assembly 300, 800 to be hydrostatically balanced at pressures in excess of what a conventional oil filled ambient pressure chamber could withstand and still rotate at low torque. Further, locking piston 380, pressure increasing choke, bend adjustment angle limiter, and associated slots 376, 378 in lower adjustment mandrel 370 are provided in a compact space that is torsionally strong. The placement of the choke (locking piston 38) proximal to the location of the connection between bearing mandrel 220 and driveshaft 120 allow high differential pressures across the choke. As the distance from the connection between bearing mandrel 220 and driveshaft 120 is increased, the tightness of the choke becomes limited due to the increasing eccentricity of the driveshaft 120 caused by the eccentric rotation of downhole mud motor 35, thereby reducing the choke's maximum choking pressure.

In some embodiments, the choke or lock piston 380 must pass the majority of the drilling fluid flow to drill bit 90, and thus, must be able to pass large debris through lock piston 380. In some embodiments, components of mud motor 35 (e.g., lock piston 380, driveshaft 120) may comprise erosion resistant materials to handle high fluid velocities. In some embodiments, the portion of driveshaft 120 disposed within lock piston 380 may be covered by an annular member coated with erosion resistant material to reduce costs. In certain embodiments, an outer surface of driveshaft 120 may be provided with axial slots to allow large debris to pass through lock piston 380 while allowing the flow to be choked tighter than what would normally be allowed without the inclusion of the axial slots or grooves on the outer surface of driveshaft 120. When the choke is made as a separate, non-integral component of driveshaft 120 (e.g., an annular member placed over a portion of the outer surface of driveshaft 120), the debris resistant features such as slots and grooves can be cheaply formed on the separate, non-integral component. The inclusion of these features allows the choke to have a high pressure drop with the potential added benefit of allowing drilling cuttings, LCM, debris, and rocks to pass the choke without plugging off during operation in the tightly choked position.

In some embodiments, lock piston 380 may be used with cam ramp angles added to the sides of the slots 376, 378 of lower adjustment mandrel 370 to allow the bend adjustment assembly 300 to be actuated in response to displacing lock piston 380 uphole. Particularly, keys 384 of lock piston 380 engage an angled cam ramp adjacent to the slots 376 or 378 of lower adjustment mandrel 370 to provide a torque to lower housing 320 via splines of lower housing 320 that interact with lock piston 380 when lock piston 380 is displaced in the uphole direction. The torque provided in response to axially moving lock piston 380 can be relatively large and is only dependent on the resultant hydraulic force acting on lock piston 380. In certain embodiments, by increasing the flowrate through downhole mud motor 35 large hydraulic pressures and thus rotational forces may be transferred by lock piston 380 and slots 376, 378 of lower adjustment mandrel 370 via the cam ramp angles interaction. Lock piston 380 and lower adjustment mandrel 370 may be configured to rotate clockwise or counterclockwise when axial force is applied to lock piston 380 by switching the side of the slot 376, 378 of lower adjustment mandrel 370 the cam ramp is positioned. In certain embodiments, the rotation of lower housing 320 is only performed when lock piston 380 moves in a single direction (uphole in this embodiment), there being no rotational force transferred when lock piston 380 is displaced in the opposite direction.

Figure 34:
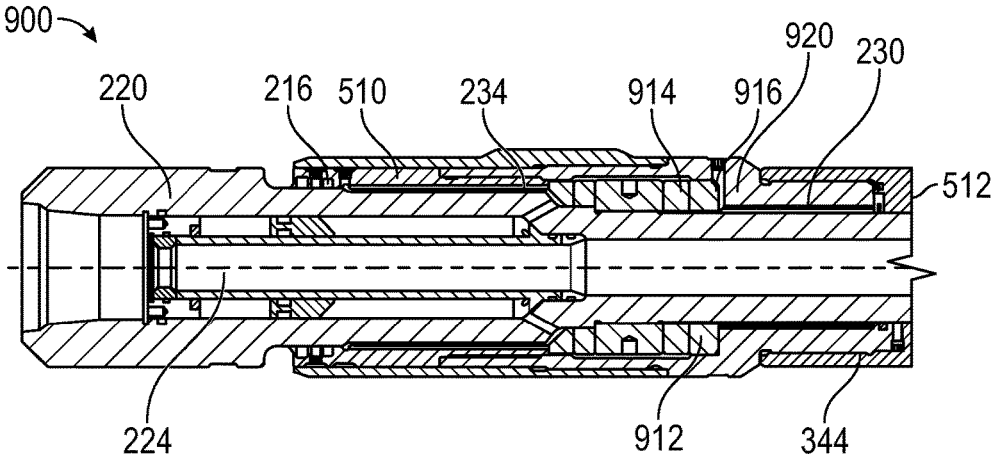
FIG. 34 is a side cross-sectional view of another embodiment of a bearing assembly of the mud motor of FIG. 1 in accordance with principles disclosed herein.
Figure 35:
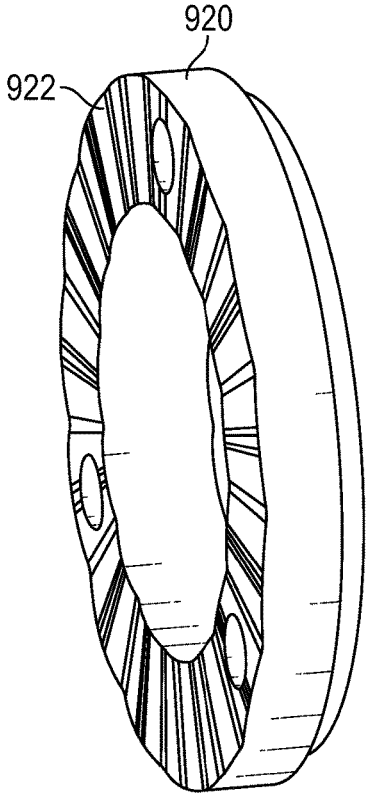
FIG. 35 is a perspective view of an embodiment of a vibration race of the bearing assembly of FIG. 34 in accordance with principles disclosed herein.

Referring to FIGS. 34, 35, another embodiment of a bearing assembly 900 of the BHA 30 of FIG. 1 is shown in FIGS. 34, 35. Bearing assembly 900 includes features in common with the bearing assemblies 200 and 500 shown in FIGS. 4-20 and 21, respectively, and shared features are labeled similarly. Bearing assembly 900 includes a vibration or thrust bearing assembly 912. In the embodiment of FIGS. 34, 35, thrust bearing assembly 912 generally includes a bearing race 914, a cage 916 that receives a plurality of rollers or rolling elements, and a vibration race 920. The rollers received in cage 916 are positioned between the bearing race 914 and the vibration race 920. The cage 916 rotationally supports the rollers received therein. The vibration race 920 may be fixed to the bearing housing 510 by connectors, such as shoulder bolts, etc.

The vibration race 920 of thrust bearing assembly 912 is configured to provide additional movement (e.g., axial movement, hammering, vibration, etc.) to the bearing mandrel 220 of bearing assembly 900. In this embodiment, vibration race 920 includes a nonplanar (e.g., wavy, etc.) engagement surface 922 (shown in FIG. 35). The rollers received in cage 916 roll along the nonplanar engagement surface 922 of vibration race 920 to induce movement (e.g., axial movement, hammering, vibration, etc.) in the bearing mandrel 220 of bearing assembly 900. The thrust bearing assembly 912 of bearing assembly 900 may include features in common with Publication No. US 2018/0080284 (U.S. application Ser. No. 15/565,224), which is incorporated herein by reference for all of its teachings.

Additionally, the layout of bearing assembly 900 is altered from bearing assemblies 200, 500 to allow the addition of thrust bearing assembly 912 (including vibration race 920) while incorporating a high torque bearing design. The layout of bearing assembly 900 allows the addition of the vibration race 920 of thrust bearing assembly 912. In some embodiments, thrust bearing assembly 912 provides a high frequency low amplitude oscillation to bearing mandrel 220, which thereby increases and decreases the WOB applied to the drill bit 90 of BHA 30 and helps to increase rate of penetration (ROP) in harder earthen formations. The high frequency low amplitude oscillation induced by vibration race 920 may also extend the life of drill bit 90 and decrease stick-slip that often occurs in applications including relatively hard earthen formations.

Further, the layout of bearing assembly 900 allow the small amplitude oscillation induced by vibration race 920 to occur with little to no detriment to the functionality of the bend adjustment assembly (e.g., bend adjustment assemblies 300, 800, etc.) of BHA 30. In this embodiment, the engagement surface 922 of vibration race includes a plurality of ramps formed therein, where the number of ramps equals the number of bearing rollers received in cage 916. In the off-bottom position the oscillating action is disengaged, providing the ability to perform adjustments to the bend adjustment assembly of BHA 30 off-bottom without the presence of oscillations and then, subsequently, oscillate downhole once WOB is applied to drill bit 90. Moreover, the functionality of the bend adjustment assembly of BHA 30 is not affected by the inclusion of the vibration race 920 of thrust bearing assembly 912.

Figure 36:
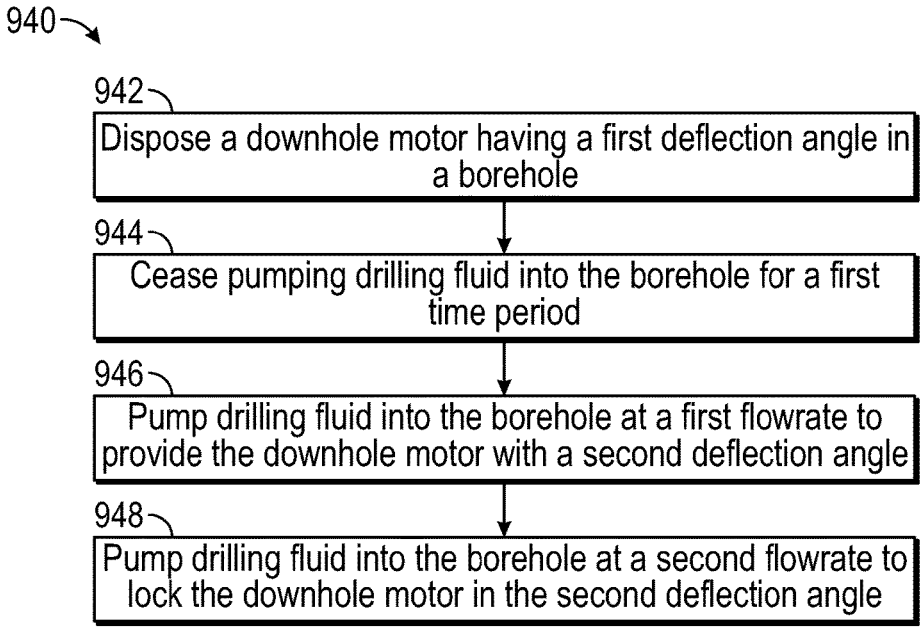
FIG. 36 is a block diagram of an embodiment of a method of adjusting a deflection angle of a downhole mud motor disposed in a borehole in accordance with principles disclosed herein.

Referring to FIG. 36, an embodiment of a method 940 for adjusting a deflection angle of a downhole mud motor disposed in a borehole is shown. At block 942 of method 940, a downhole mud motor having a first deflection angle is disposed in a borehole. In some embodiments, block 942 comprises providing downhole mud motor 35 (shown in FIG. 1) in borehole 16, mud motor 35 comprising a bend adjustment assembly 300 that provides a first deflection angle $\theta_1$ (shown in FIGS. 4-9) along motor 35. In certain embodiments, block 942 comprises providing an embodiment of mud motor 35 in borehole 16 that comprises a bend adjustment assembly 800 (shown in FIGS. 25-33) that provides a first deflection angle $\theta_1$ along motor 35 (e.g., between central axis 115 of driveshaft housing 110 of motor 35 and central axis 225 of bearing mandrel 220 of motor 35).

At block 944 of method 940, the pumping of drilling fluid into the borehole is ceased for a first time period. In some embodiments, block 944 comprises reducing the rate of pumping of drilling fluid (without ceasing pumping into the borehole) such that a reduced flowrate is provided through the downhole mud motor (e.g., below 10% of the drilling flowrate). In some embodiments, the first time period of block 944 comprises approximately 15-120 seconds. In certain embodiments, block 944 comprises pumping drilling fluid into drillstring 21 (shown in FIG. 1) using surface pump 23, drillstring 21 extending from a drilling rig 20 disposed at the surface, and through borehole 16 to BHA 30 disposed in borehole 16 that comprises downhole mud motor 35.

At block 946 of method 940, drilling fluid is pumped into the borehole at a first flowrate to provide the downhole mud motor (disposed in the borehole) with a second deflection angle that is different from the first deflection angle. In some embodiments, block 946 comprises pumping drilling fluid into drillstring 21 from surface pump 23 at 0%-30% of either the desired drilling flowrate or the maximum drilling fluid flowrate of drillstring 21 and/or BHA 30. In some embodiments, block 946 comprises pumping drilling fluid at the first flowrate to provide the downhole mud motor with a second deflection angle that is greater than the first deflection angle (e.g., creates or provides a greater bend along the downhole mud motor). In some embodiments, block 946 comprises pumping drilling fluid into the borehole at the first flowrate while drillstring 21 is not rotated (e.g., held stationary) by rotary system 24 (shown in FIG. 1). In certain embodiments, block 946 comprises pumping drilling fluid into borehole 16 at the first flowrate to rotate lower housing 320 of bend adjustment assembly 300 (shown in FIG. 7) relative to adjustment mandrels 360, 370 of assembly 300 to form the second deflection angle $\theta_2$ (shown in FIG. 7) along motor 35. In certain embodiments, block 946 comprises pumping drilling fluid into borehole 16 at the first flowrate to rotate lower housing 320' (shown in FIGS. 22-24) of bend adjustment assembly 800 relative to lower adjustment mandrel 840 of assembly 800 to form the second deflection angle that is greater than the first deflection angle.

At block 948 of method 940, drilling fluid is pumped into the borehole at a second flowrate that is different from the first flowrate to lock the downhole mud motor (disposed in the borehole) in the second deflection angle. In some embodiments, block 948 comprises pumping drilling fluid into drillstring 21 from surface pump 23 at 50%-100% of either the desired drilling flowrate or maximum drilling fluid flowrate of drillstring 21 and/or BHA 30. In some embodiments, block 948 comprises pumping drilling fluid into the borehole at the second flowrate while drillstring 21 is not rotated (e.g., held stationary) by rotary system 24. In certain embodiments, block 948 comprises pumping drilling fluid into borehole 16 at the second flowrate to actuate locking piston 380 (shown in FIGS. 4-7) of a bend adjustment assembly (e.g., bend adjustment assemblies 300, 800, etc.) from the unlocked position to the locked position to lock the bend adjustment assembly in a position providing the second deflection angle.

Figure 37:
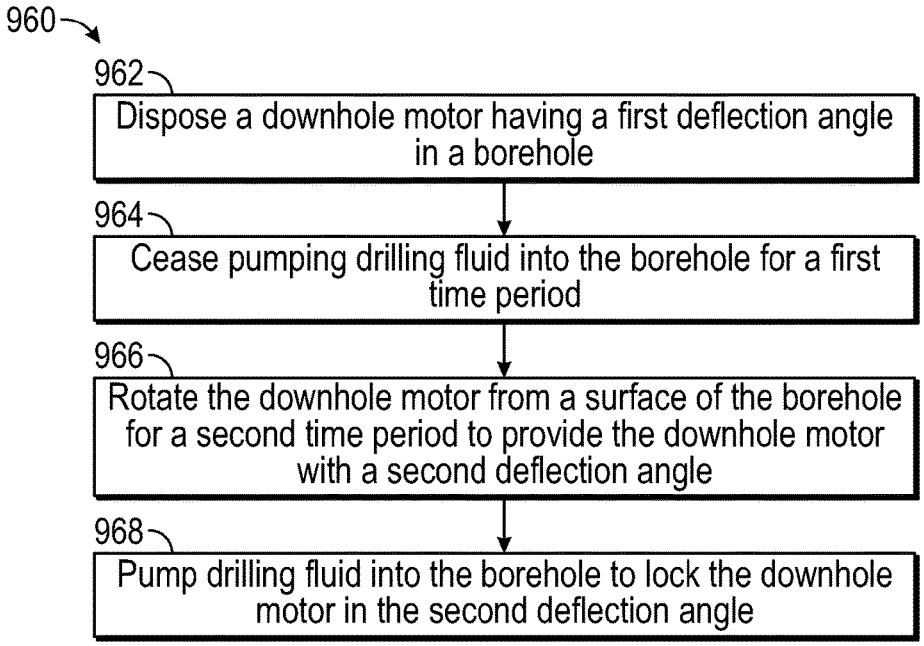
FIG. 37 is a block diagram of another embodiment of a method of adjusting a deflection angle of a downhole mud motor disposed in a borehole in accordance with principles disclosed herein.

Referring to FIG. 37, an embodiment of a method 960 for adjusting a deflection angle of a downhole mud motor disposed in a borehole is shown. At block 962 of method 960, a downhole mud motor having a first deflection angle is disposed in a borehole. In some embodiments, block 962 comprises providing downhole mud motor 35 (shown in FIG. 1) in borehole 16, mud motor 35 comprising a bend adjustment assembly 300 that provides a first deflection angle $\theta_1$ or a second deflection angle $\theta_2$ (shown in FIGS. 4-9) along motor 35. In certain embodiments, block 962 comprises providing an embodiment of mud motor 35 in borehole 16 that comprises a bend adjustment assembly 800 (shown in FIGS. 25-33) that provides a first deflection angle $\theta_1$ along motor 35.

At block 964 of method 960, the pumping of drilling fluid into the borehole is ceased for a first time period. In some embodiments, the first time period of block 964 comprises approximately 15-120 seconds. In certain embodiments, block 964 comprises pumping drilling fluid into drillstring 21 (shown in FIG. 1) using surface pump 23, drillstring 21 extending from a drilling rig 20 disposed at the surface, and through borehole 16 to BHA 30 disposed in borehole 16 that comprises downhole mud motor 35.

At block 966 of method 960, the downhole mud motor (disposed in the borehole) is rotated from a surface of the borehole for a second time period to provide the downhole mud motor with a second deflection angle that is different from the first deflection angle. In some embodiments, the second time period of block 966 comprises approximately 15-120 seconds. In some embodiments, block 966 comprises rotating the downhole mud motor from the surface of the borehole for the second time period to provide the downhole mud motor with a second deflection angle that is less than the first deflection angle (e.g., reduces or eliminates a bend along the downhole mud motor). In certain embodiments, block 966 comprises rotating drillstring 21 via rotary system 24 at approximately 1-30 RPM.

In some embodiments, block 966 comprises rotating drillstring 21 via rotary system 24 to rotate bearing housing 210 (shown in FIGS. 4-7) of BHA 30 and offset housings 310, 320 of bend adjustment assembly 300 relative to adjustment mandrels 360, 370 of assembly 300 to actuate motor 35 from a position providing second deflection angle $\theta_2$ to a position providing first deflection angle $\theta_1$. In some embodiments, block 966 comprises rotating drillstring 21 via rotary system 24 to rotate lower housing 320' of bend adjustment assembly 800 relative to lower adjustment mandrel 840 to actuate motor 35 from a position providing second deflection angle to a position providing first deflection angle. In certain embodiments of block 966, drilling fluid is pumped into drillstring 21 from surface pump at 30%-75% of either the desired drilling flowrate or maximum drilling fluid flowrate of drillstring 21 and/or BHA 30 while the downhole mud motor is rotated from the surface of the borehole for the second time period. In certain embodiments of block 968, drilling fluid is pumped into drillstring 21 from surface pump 23 at 30%-75% of either the desired drilling flowrate or the maximum drilling fluid flowrate of drillstring 21 and/or BHA 30 while at least a portion of downhole mud motor 35 is rotated from the surface of borehole 16 for the second time period. In such an embodiment, the pumping of drilling fluid at the 30-75% rate from surface pump 23 causes torque applied to bearing mandrel 220 to be substantially reduced or ceased and not transmitted to actuator housing 340 of bend adjustment assembly 300 via meshing engagement between teeth 424 of teeth ring 420 (rotationally fixed to bearing mandrel 220) and teeth 410 of actuator piston 402 (rotationally fixed to actuator housing 340). In certain embodiments of block 966, no drilling fluid is pumped into drillstring 21 from surface pump 23 while the downhole mud motor is rotated from the surface of the borehole for the second time period.

At block 968 of method 960, drilling fluid is pumped into the borehole to lock the downhole mud motor (disposed in the borehole) in the second deflection angle. In some embodiments, block 968 comprises pumping drilling fluid into drillstring 21 from surface pump 23 at 50%-100% of either the desired drilling flowrate or maximum drilling fluid flowrate of drillstring 21 and/or BHA 30. In some embodiments, block 968 comprises pumping drilling fluid into drillstring 21 from surface pump 23 at 75%-100% of either the desired drilling flowrate or maximum drilling fluid flowrate of drillstring 21 and/or BHA 30. In certain embodiments, block 968 comprises pumping drilling fluid into borehole 16 at the second flowrate to actuate locking piston 380 (shown in FIGS. 4-7) of a bend adjustment assembly (e.g., bend adjustment assemblies 300, 800, etc.) from the unlocked position to the locked position to lock the bend adjustment assembly in a position providing the second deflection angle.

Figure 38:
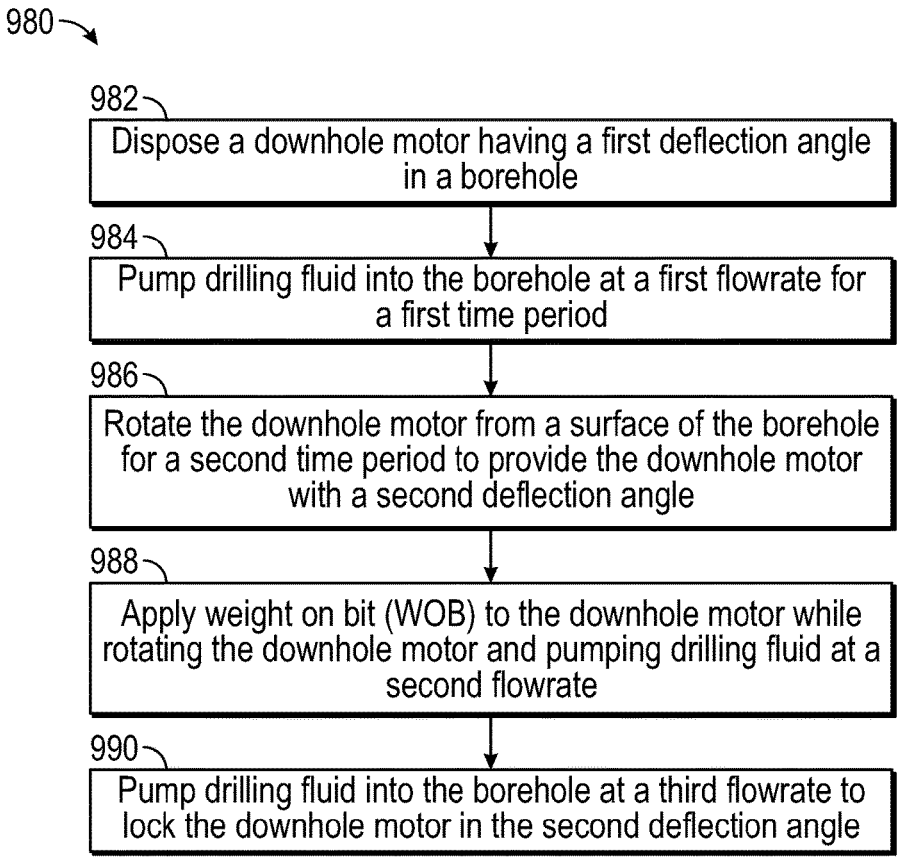
FIG. 38 is a block diagram of another embodiment of a method of adjusting a deflection angle of a downhole mud motor disposed in a borehole in accordance with principles disclosed herein.

Referring to FIG. 38, an embodiment of a method 980 for adjusting a deflection angle of a downhole mud motor disposed in a borehole is shown. At block 982 of method 980, a downhole mud motor having a first deflection angle is disposed in a borehole. In some embodiments, block 982 comprises providing downhole mud motor 35 (shown in FIG. 1) in borehole 16, mud motor 35 comprising a bend adjustment assembly 300 that provides a first deflection angle $\theta_1$ or a second deflection angle $\theta_2$ (shown in FIGS. 4-9) along mud motor 35. In certain embodiments, block 982 comprises providing an embodiment of mud motor 35 in borehole 16 that includes a bend adjustment assembly 800 (shown in FIGS. 25-33) providing a first deflection angle $\theta_1$ along motor 35.

At block 984 of method 980, drilling fluid is pumped into the borehole at a first flowrate for a first time period. In some embodiments, block 984 comprises reducing the flowrate below 10% of the drilling flowrate (the first flowrate being below 10% of the drilling flowrate). In some embodiments, the first time period of block 984 comprises approximately 15-120 seconds. In certain embodiments, block 984 comprises pumping drilling fluid into drillstring 21 (shown in FIG. 1) using surface pump 23, drillstring 21 extending from a drilling rig 20 disposed at the surface, and through borehole 16 to BHA 30 disposed in borehole 16 that comprises downhole mud motor 35. In some embodiments of block 984, fluid flow through the downhole mud motor may be ceased for 15-120 seconds.

At block 986 of method 980, the downhole mud motor (disposed in the borehole) is rotated from a surface of the borehole (e.g., borehole 16) for a second time period to provide the downhole mud motor (e.g., downhole mud motor 35) with a second deflection angle that is different from the first deflection angle. In some embodiments, the second time period of block 986 comprises approximately 15-120 seconds. In some embodiments, block 986 comprises rotating the downhole mud motor from the surface of the borehole for the second time period to provide the downhole mud motor with a second deflection angle that is less than the first deflection angle (e.g., reduces or eliminates a bend along the downhole mud motor). In certain embodiments, block 986 comprises rotating drillstring 21 via rotary system 24 at approximately 1-30 RPM.

In some embodiments, block 986 comprises rotating drillstring 21 via rotary system 24 to rotate bearing housing 210 (shown in FIGS. 4-7) of BHA 30 and offset housings 310, 320 of bend adjustment assembly 300 relative to adjustment mandrels 360, 370 of bend adjustment assembly 300 to actuate motor 35 from a position providing second deflection angle $\theta_2$ to a position providing first deflection angle $\theta_1$. In some embodiments, block 986 comprises rotating drillstring 21 via rotary system 24 to rotate the lower housing 320' of bend adjustment assembly 800 relative to lower adjustment mandrel 840 to actuate mud motor 35 from a position providing second deflection angle $\theta_2$ to a position providing first deflection angle $\theta_1$. At block 988 of method 980, WOB is applied to the downhole mud motor while the downhole mud motor is rotated from the surface and drilling fluid is pumped into the drillstring at a second flowrate of 30%-75% of the drilling flowrate. In some embodiments of block 988, WOB is applied to the downhole mud motor by having the drill bit drill ahead a fixed distance (e.g., several feet). The application of WOB to the downhole mud motor may assist in torquing the lower end of the downhole mud motor to aid in shifting the downhole mud motor to the position providing the second deflection angle. In certain embodiments of block 988, drilling fluid is pumped into drillstring 21 from surface pump 23 at 30%-75% of either the desired drilling flowrate or the maximum drilling fluid flowrate of drillstring 21 and/or BHA 30 while at least a portion of downhole mud motor 35 is rotated from the surface of borehole 16 for the second time period. In such an embodiment, the pumping of drilling fluid at the 30-75% rate from surface pump 23 causes torque applied to bearing mandrel 220 to be substantially reduced or ceased and not transmitted to actuator housing 340 of bend adjustment assembly 300 via meshing engagement between teeth 424 of teeth ring 420 (rotationally fixed to bearing mandrel 220) and teeth 410 of actuator piston 402 (rotationally fixed to actuator housing 340).

At block 990 of method 980, while rotation and WOB are applied to the downhole mud motor, drilling fluid is pumped into the borehole at a third flowrate that is different from the first and second flowrates to lock the downhole mud motor (disposed in the borehole) in the second deflection angle. In some embodiments, block 990 comprises pumping drilling fluid into drillstring 21 from surface pump 23 at 50%-100% of either the desired drilling flowrate or maximum drilling fluid flowrate of drillstring 21 and/or BHA 30. In some embodiments, block 990 comprises pumping drilling fluid into drillstring 21 from surface pump 23 at 75%-100% of either the desired drilling flowrate or maximum drilling fluid flowrate of drillstring 21 and/or BHA 30. In certain embodiments, block 990 comprises pumping drilling fluid into borehole 16 at the third flowrate to actuate locking piston 380 (shown in FIGS. 4-7) of a bend adjustment assembly (e.g., bend adjustment assemblies 300, 800, etc.) from the unlocked position to the locked position to lock the bend adjustment assembly in a position providing the second deflection angle. In some embodiments, following block 990, method 980 further comprises relieving the WOB applied to the downhole mud motor, such as by pulling the drill bit off of the "bottom" of the borehole (e.g., the "toe" of a deviated borehole).

While disclosed embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A bend adjustment assembly for a downhole mud motor, comprising:

a driveshaft housing;

a driveshaft rotatably disposed in the driveshaft housing;

a bearing mandrel coupled to the driveshaft;

wherein the bend adjustment assembly includes a first position that provides a first deflection angle between a longitudinal axis of the driveshaft housing and a longitudinal axis of the bearing mandrel;

wherein the bend adjustment assembly includes a second position that provides a second deflection angle between the longitudinal axis of the driveshaft housing and the longitudinal axis of the bearing mandrel that is different from the first deflection angle;

an actuator assembly configured to shift the bend adjustment assembly between the first position and the second position in response to a change in at least one of flowrate of a drilling fluid supplied to the downhole mud motor, pressure of the drilling fluid supplied to the downhole mud motor, and relative rotation between the driveshaft housing and the bearing mandrel;

wherein the actuator assembly comprises:

an actuator housing through which the bearing mandrel extends;

an actuator piston coupled to the actuator housing, wherein the actuator piston comprises a first plurality of teeth; and a teeth ring coupled to the bearing mandrel and comprising a second plurality of teeth;

wherein the actuator piston is configured to matingly engage the first plurality of teeth with the second plurality of teeth of the teeth ring to transfer torque between the actuator housing and the bearing mandrel in response to the change in at least one of flowrate and pressure of the drilling fluid supplied to the downhole mud motor.

2. The bend adjustment assembly of claim 1, wherein the actuator assembly further comprises a biasing member configured to bias the first plurality of teeth of the actuator piston into mating engagement with the second plurality of teeth of the teeth ring.

3. The bend adjustment assembly of claim 1, wherein the actuator assembly comprises a biasing member configured to apply a mechanical force against the actuator piston to bias the actuator piston in a first axial direction and to apply a hydraulic force against the actuator piston to bias the actuator piston in a second axial direction opposite the first axial direction.

4. The bend adjustment assembly of claim 1, further comprising:

an offset housing comprising a first longitudinal axis and a first offset engagement surface concentric to a second longitudinal axis that is offset from the first longitudinal axis;

an adjustment mandrel comprising a third longitudinal axis and a second offset engagement surface concentric to a fourth longitudinal axis that is offset from the third longitudinal axis, wherein the second offset engagement surface is in mating engagement with the first offset engagement surface; and a locking piston disposed in the offset housing;

wherein the locking piston comprises a locked position restricting relative rotation between the offset housing and the adjustment mandrel, and an unlocked position, axially spaced from the locked position, permitting relative rotation between the offset housing and the adjustment mandrel;

wherein the locking piston is configured to shift between the locked position and the unlocked position in response to a change in at least one of flowrate and pressure of the drilling fluid supplied to the downhole mud motor.

5. The bend adjustment assembly of claim 4, wherein the bend adjustment assembly is locked in at least one of the first and second positions when the locking piston is disposed in the locked position.

6. The bend adjustment assembly of claim 4, further comprising:

a first annular seal disposed on an outer surface of the locking piston;

a second annular seal disposed on an outer surface of a compensating piston of the bend adjustment assembly;

a sealed chamber extending axially between the first annular seal and the second annular seal; and a biasing member in engagement with the compensating piston, wherein the biasing member biases the locking piston towards the unlocked position.

7. The bend adjustment assembly of claim 1, further comprising:

an offset housing comprising a first longitudinal axis and a first offset engagement surface concentric to a second longitudinal axis that is offset from the first longitudinal axis;

an adjustment mandrel comprising a third longitudinal axis and a second offset engagement surface concentric to a fourth longitudinal axis that is offset from the third longitudinal axis, wherein the second offset engagement surface is in mating engagement with the first offset engagement surface;

a locking piston disposed in the offset housing about the driveshaft; and a thrust bearing assembly including a vibration race having a nonplanar engagement surface;

wherein the locking piston is configured to alter a restriction to fluid flow of the drilling fluid supplied to the downhole mud motor in response to shifting the locking piston between a first axial position and a second axial position.

8. The bend adjustment assembly of claim 1, further comprising:

an offset housing comprising a first longitudinal axis and a first offset engagement surface concentric to a second longitudinal axis that is offset from the first longitudinal axis; and an adjustment mandrel comprising a third longitudinal axis and a second offset engagement surface concentric to a fourth longitudinal axis that is offset from the third longitudinal axis, wherein the second offset engagement surface is in mating engagement with the first offset engagement surface;

the offset housing comprises an arcuate extension concentric to the second longitudinal axis and defined by a first pair of circumferentially spaced shoulders;

the adjustment mandrel comprises a first arcuate groove concentric to the fourth longitudinal axis and defined by a second pair of circumferentially spaced shoulders;

a first shoulder of the first pair of shoulders contacts a first shoulder of the second pair of shoulders when the bend adjustment assembly is in the first position; and a second shoulder of the first pair of shoulders contacts a second shoulder of the second pair of shoulders when the bend adjustment assembly is in the second position.

9. A bend adjustment assembly for a downhole mud motor, comprising:

a driveshaft housing;

a driveshaft rotatably disposed in the driveshaft housing;

a bearing mandrel coupled to the driveshaft;

wherein the bend adjustment assembly includes a first position that provides a first deflection angle between a longitudinal axis of the driveshaft housing and a longitudinal axis of the bearing mandrel, wherein the bend adjustment assembly includes a second position that provides a second deflection angle between the longitudinal axis of the driveshaft housing and the longitudinal axis of the bearing mandrel that is different from the first deflection angle;

an actuator assembly configured to shift the bend adjustment assembly between the first position and the second position in response to a change in at least one of flowrate of a drilling fluid supplied to the downhole mud motor, pressure of the drilling fluid supplied to the downhole mud motor, and relative rotation between the driveshaft housing and the bearing mandrel;

an offset housing comprising a first longitudinal axis and a first offset engagement surface concentric to a second longitudinal axis that is offset from the first longitudinal axis;

an adjustment mandrel comprising a third longitudinal axis and a second offset engagement surface concentric to a fourth longitudinal axis that is offset from the third longitudinal axis, wherein the second offset engagement surface is in mating engagement with the first offset engagement surface; and a locking piston disposed in the offset housing;

wherein the locking piston comprises a locked position restricting relative rotation between the offset housing and the adjustment mandrel, and an unlocked position, axially spaced from the locked position, permitting relative rotation between the offset housing and the adjustment mandrel;

wherein the locking piston is configured to shift between the locked position and the unlocked position in response to a change in at least one of flowrate and pressure of the drilling fluid supplied to the downhole mud motor.

10. The bend adjustment assembly of claim 9, wherein the bend adjustment assembly is locked in at least one of the first and second positions when the locking piston is disposed in the locked position.

11. The bend adjustment assembly of claim 9, further comprising:

a first annular seal disposed on an outer surface of the locking piston;

a second annular seal disposed on an outer surface of a compensating piston of the bend adjustment assembly;

a sealed chamber extending axially between the first annular seal and the second annular seal; and a biasing member in engagement with the compensating piston, wherein the biasing member biases the locking piston towards the unlocked position.

12. The bend adjustment assembly of claim 9, further comprising:

an actuator housing through which the bearing mandrel extends, an actuator piston coupled to the actuator housing, wherein the actuator piston comprises a first plurality of teeth; and a teeth ring coupled to the bearing mandrel and comprising a second plurality of teeth;

wherein the actuator piston is configured to matingly engage the first plurality of teeth with the second plurality of teeth of the teeth ring to transfer torque between the actuator housing and the bearing mandrel in response to the change in at least one of flowrate and pressure of the drilling fluid supplied to the downhole mud motor.

13. The bend adjustment assembly of claim 12, wherein the actuator assembly further comprises a biasing member configured to bias the first plurality of teeth of the actuator piston into mating engagement with the second plurality of teeth of the teeth ring.

14. The bend adjustment assembly of claim 12, wherein the actuator assembly comprises a biasing member configured to apply a mechanical force against the actuator piston to bias the actuator piston in a first axial direction and to apply a hydraulic force against the actuator piston to bias the actuator piston in a second axial direction opposite the first axial direction.

15. The bend adjustment assembly of claim 9, further comprising:

a thrust bearing assembly including a vibration race having a nonplanar engagement surface;

wherein the locking piston is configured to alter a restriction to fluid flow of the drilling fluid supplied to the downhole mud motor in response to shifting the locking piston between a first axial position and a second axial position.

16. The bend adjustment assembly of claim 9, wherein:

the offset housing comprises an arcuate extension concentric to the second longitudinal axis and defined by a first pair of circumferentially spaced shoulders;

the adjustment mandrel comprises a first arcuate groove concentric to the fourth longitudinal axis and defined by a second pair of circumferentially spaced shoulders;

a first shoulder of the first pair of shoulders contacts a first shoulder of the second pair of shoulders when the bend adjustment assembly is in the first position; and a second shoulder of the first pair of shoulders contacts a second shoulder of the second pair of shoulders when the bend adjustment assembly is in the second position.

17. A bend adjustment assembly for a downhole mud motor, comprising:

a driveshaft housing;

a driveshaft rotatably disposed in the driveshaft housing;

a bearing mandrel coupled to the driveshaft;

wherein the bend adjustment assembly includes a first position that provides a first deflection angle between a longitudinal axis of the driveshaft housing and a longitudinal axis of the bearing mandrel;

wherein the bend adjustment assembly includes a second position that provides a second deflection angle between the longitudinal axis of the driveshaft housing and the longitudinal axis of the bearing mandrel that is different from the first deflection angle;

an actuator assembly configured to shift the bend adjustment assembly between the first position and the second position in response to a change in at least one of flowrate of a drilling fluid supplied to the downhole mud motor, pressure of the drilling fluid supplied to the downhole mud motor, and relative rotation between the driveshaft housing and the bearing mandrel;

an offset housing comprising a first longitudinal axis and a first offset engagement surface concentric to a second longitudinal axis that is offset from the first longitudinal axis;

an adjustment mandrel comprising a third longitudinal axis and a second offset engagement surface concentric to a fourth longitudinal axis that is offset from the third longitudinal axis, wherein the second offset engagement surface is in mating engagement with the first offset engagement surface;

a locking piston disposed in the offset housing about the driveshaft; and a thrust bearing assembly including a vibration race having a nonplanar engagement surface;

wherein the locking piston is configured to alter a restriction to fluid flow of the drilling fluid supplied to the downhole mud motor in response to shifting the locking piston between a first axial position and a second axial position.

18. The bend adjustment assembly of claim 17, further comprising:

an actuator housing through which the bearing mandrel extends;

an actuator piston coupled to the actuator housing, wherein the actuator piston comprises a first plurality of teeth; and a teeth ring coupled to the bearing mandrel and comprising a second plurality of teeth;

wherein the actuator piston is configured to matingly engage the first plurality of teeth with the second plurality of teeth of the teeth ring to transfer torque between the actuator housing and the bearing mandrel in response to the change in at least one of flowrate and pressure of the drilling fluid supplied to the downhole mud motor.

19. The bend adjustment assembly of claim 18, wherein the actuator assembly further comprises a biasing member configured to bias the first plurality of teeth of the actuator piston into mating engagement with the second plurality of teeth of the teeth ring.

20. The bend adjustment assembly of claim 18, wherein the actuator assembly comprises a biasing member configured to apply a mechanical force against the actuator piston to bias the actuator piston in a first axial direction and to apply a hydraulic force against the actuator piston to bias the actuator piston in a second axial direction opposite the first axial direction.

21. The bend adjustment assembly of claim 17, wherein:

the locking piston comprises a locked position restricting relative rotation between the offset housing and the adjustment mandrel, and an unlocked position, axially spaced from the locked position, permitting relative rotation between the offset housing and the adjustment mandrel; and the locking piston is configured to shift between the locked position and the unlocked position in response to a change in at least one of flowrate and pressure of the drilling fluid supplied to the downhole mud motor.

22. The bend adjustment assembly of claim 21, wherein the bend adjustment assembly is locked in at least one of the first and second positions when the locking piston is disposed in the locked position.

23. The bend adjustment assembly of claim 21, further comprising:

a first annular seal disposed on an outer surface of the locking piston;

a second annular seal disposed on an outer surface of a compensating piston of the bend adjustment assembly;

a sealed chamber extending axially between the first annular seal and the second annular seal; and a biasing member in engagement with the compensating piston, wherein the biasing member biases the locking piston towards the unlocked position.

24. A bend adjustment assembly for a downhole mud motor, comprising:

a driveshaft housing;

a driveshaft rotatably disposed in the driveshaft housing;

a bearing mandrel coupled to the driveshaft;

wherein the bend adjustment assembly includes a first position that provides a first deflection angle between a longitudinal axis of the driveshaft housing and a longitudinal axis of the bearing mandrel, wherein the bend adjustment assembly includes a second position that provides a second deflection angle between the longitudinal axis of the driveshaft housing and the longitudinal axis of the bearing mandrel that is different from the first deflection angle;

an actuator assembly configured to shift the bend adjustment assembly between the first position and the second position in response to a change in at least one of flowrate of a drilling fluid supplied to the downhole mud motor, pressure of the drilling fluid supplied to the downhole mud motor, and relative rotation between the driveshaft housing and the bearing mandrel;

an offset housing comprising a first longitudinal axis and a first offset engagement surface concentric to a second longitudinal axis that is offset from the first longitudinal axis; and an adjustment mandrel comprising a third longitudinal axis and a second offset engagement surface concentric to a fourth longitudinal axis that is offset from the third longitudinal axis, wherein the second offset engagement surface is in mating engagement with the first offset engagement surface;

the offset housing comprises an arcuate extension concentric to the second longitudinal axis and defined by a first pair of circumferentially spaced shoulders;

the adjustment mandrel comprises a first arcuate groove concentric to the fourth longitudinal axis and defined by a second pair of circumferentially spaced shoulders;

a first shoulder of the first pair of shoulders contacts a first shoulder of the second pair of shoulders when the bend adjustment assembly is in the first position; and a second shoulder of the first pair of shoulders contacts a second shoulder of the second pair of shoulders when the bend adjustment assembly is in the second position.

25. The bend adjustment assembly of claim 24, further comprising:

an actuator housing through which the bearing mandrel extends;

an actuator piston coupled to the actuator housing, wherein the actuator piston comprises a first plurality of teeth; and a teeth ring coupled to the bearing mandrel and comprising a second plurality of teeth;

wherein the actuator piston is configured to matingly engage the first plurality of teeth with the second plurality of teeth of the teeth ring to transfer torque between the actuator housing and the bearing mandrel in response to the change in at least one of flowrate and pressure of the drilling fluid supplied to the downhole mud motor.

26. The bend adjustment assembly of claim 25, wherein the actuator assembly further comprises a biasing member configured to bias the first plurality of teeth of the actuator piston into mating engagement with the second plurality of teeth of the teeth ring.

27. The bend adjustment assembly of claim 25, wherein the actuator assembly comprises a biasing member configured to apply a mechanical force against the actuator piston to bias the actuator piston in a first axial direction and to apply a hydraulic force against the actuator piston to bias the actuator piston in a second axial direction opposite the first axial direction.

28. The bend adjustment assembly of claim 24, further comprising:

a locking piston disposed in the offset housing;

wherein the locking piston comprises a locked position restricting relative rotation between the offset housing and the adjustment mandrel, and an unlocked position, axially spaced from the locked position, permitting relative rotation between the offset housing and the adjustment mandrel;

wherein the locking piston is configured to shift between the locked position and the unlocked position in response to a change in at least one of flowrate and pressure of the drilling fluid supplied to the downhole mud motor.

29. The bend adjustment assembly of claim 28, wherein the bend adjustment assembly is locked in at least one of the first and second positions when the locking piston is disposed in the locked position.

30. The bend adjustment assembly of claim 28, further comprising:

a first annular seal disposed on an outer surface of the locking piston;

a second annular seal disposed on an outer surface of a compensating piston of the bend adjustment assembly;

a sealed chamber extending axially between the first annular seal and the second annular seal; and a biasing member in engagement with the compensating piston, wherein the biasing member biases the locking piston towards the unlocked position.

31. A bend adjustment assembly for a downhole mud motor, comprising:

an offset housing comprising a first longitudinal axis, a first offset engagement surface concentric to a second longitudinal axis offset from the first longitudinal axis, and an arcuate extension concentric to the second longitudinal axis and defined by a first pair of circumferentially spaced shoulders; and an adjustment mandrel comprising a third longitudinal axis, a second offset engagement surface concentric to a fourth longitudinal axis offset from the third longitudinal axis, and a first arcuate groove concentric to the fourth longitudinal axis and defined by a second pair of circumferentially spaced shoulders, wherein the first offset engagement surface matingly engages the second offset engagement surface and the arcuate extension of the offset housing is disposed in the first arcuate groove of the adjustment mandrel;

wherein the bend adjustment assembly includes a first position with a first shoulder of the first pair of shoulders contacting a first shoulder of the second pair of shoulders, and wherein the first position provides a first deflection angle between the first longitudinal axis of the offset housing and the third longitudinal axis of the adjustment mandrel;

wherein the bend adjustment assembly includes a second position angularly spaced from the first position with a second shoulder of the first pair of shoulders contacting a second shoulder of the second pair of shoulders, and wherein the second position provides a second deflection angle between the first longitudinal axis of the offset housing and the third longitudinal axis of the adjustment mandrel that is different from the first deflection angle.

32. The bend adjustment assembly of claim 31, wherein:

the offset housing comprises a locked position locking the bend adjustment assembly in at least one of the first and second positions and an unlocked position permitting the bend adjustment assembly to shift between the first and second positions; and an angular distance between the second pair of shoulders defines a magnitude of the difference between the first deflection angle and the second deflection angle.

33. The bend adjustment assembly of claim 31, wherein the bend adjustment assembly is configured to shift from the first position to the second position in response to at least one of flowrate and pressure of a drilling fluid supplied to the downhole mud motor, and shift from the second position to the first position in response to a change in relative rotation between the offset housing and the adjustment mandrel;

the bend adjustment assembly is configured to shift from the first position to the second position in response to rotation of the offset housing in a first direction relative to the adjustment mandrel, and shift from the second position to the first position in response to rotation of the offset housing in a second direction relative to the adjustment mandrel that is opposite the first direction.

34. The bend adjustment assembly of claim 31, wherein:

the adjustment mandrel further comprises a second arcuate groove concentric to the fourth longitudinal axis and defined by a third pair of circumferentially spaced shoulders; and the bend adjustment assembly includes a third position angularly spaced from the first and second positions with a second shoulder of the first pair of shoulders contacting a second shoulder of the third pair of shoulders, and wherein the third position provides a third deflection angle between the first longitudinal axis of the offset housing and the third longitudinal axis of the adjustment mandrel that is different from the first and second deflection angles.

35. The bend adjustment assembly of claim 31, farther comprising:

a locking piston disposed in the offset housing;

wherein the locking piston comprises a locked position restricting relative rotation between the offset housing and the adjustment mandrel, and an unlocked position, axially spaced from the locked position, permitting relative rotation between the offset housing and the adjustment mandrel;

wherein the locking piston is configured to shift between the locked position and the unlocked position in response to a change in at least one of flowrate and pressure of the drilling fluid supplied to the downhole mud motor.

36. The bend adjustment assembly of claim 35, wherein:

the locking piston comprises a key;

the adjustment mandrel comprises a first slot and a second slot each extending into an end of the adjustment mandrel, wherein a length of the second slot is different from a length of the first slot; and relative rotation between the adjustment mandrel and the offset housing is restricted when the key of the locking piston is received in either the first slot or the second slot of the adjustment mandrel.

37. The bend adjustment assembly of claim 36, wherein:

the bend adjustment assembly is locked in the first position when the key of the locking piston is received in the first slot of the adjustment mandrel; and the bend adjustment assembly is locked in the second position when the key of the locking piston is received in the second slot of the adjustment mandrel.

38. The bend adjustment assembly of claim 36, wherein the locking piston is configured to induce a pressure signal providing a surface indication of the deflection angle of the bend adjustment assembly.

39. The bend adjustment assembly of claim 35, further comprising:

a locking piston disposed in the offset housing; and a radial port formed in the offset housing;

wherein the locking piston comprises first and second locked positions each restricting relative rotation between the offset housing and the adjustment mandrel, and an unlocked position, axially spaced from the first and second locked positions, permitting relative rotation between the offset housing and the adjustment mandrel;

wherein the locking piston is configured to lock the bend adjustment assembly in the first position when the locking piston is in the first locked position, and lock the bend adjustment assembly in the second position when the locking piston is in the second position;

wherein the locking piston axially covers the radial port when the locking piston is in at least one of the first locked position, second locked position, and unlocked position to restrict fluid flow through the radial port into the offset housing.

40. The bend adjustment assembly of claim 31, further comprising an actuator assembly configured to shift the bend adjustment assembly between the first position and the second position in response to a change in at least one of flowrate of a drilling fluid supplied to the downhole mud motor, pressure of the drilling fluid supplied to the downhole mud motor, and relative rotation between the driveshaft housing and the bearing mandrel.

41. The bend adjustment assembly of claim 40, wherein the actuator assembly is in fluid communication with a sealed volume of oil in which a bearing of the downhole motor is disposed.

42. The bend adjustment assembly of claim 40, wherein the actuator assembly comprises:

an actuator housing through which the bearing mandrel extends;

an actuator piston coupled to the actuator housing, wherein the actuator piston comprises a first plurality of teeth; and a teeth ring coupled to the bearing mandrel and comprising a second plurality of teeth;

wherein the actuator piston is configured to matingly engage the first plurality of teeth with the second plurality of teeth of the teeth ring to transfer torque between the actuator housing and the bearing mandrel in response to the change in flowrate of the drilling fluid supplied to the downhole mud motor.

43. The bend adjustment assembly of claim 40, wherein the actuator assembly comprises: an actuator housing through which the bearing mandrel extends;

an actuator piston disposed in the actuator housing; and a teeth ring coupled to the bearing mandrel;

wherein the actuator piston is configured to permit relative rotation between the actuator housing and the bearing mandrel in response to the application of a torque to the actuator piston from the teeth ring which exceeds a threshold torque.

44. A method for forming a deviated borehole, comprising:

(a) providing a bend adjustment assembly of a downhole mud motor in a first position that provides a first deflection angle between a longitudinal axis of a driveshaft housing of the downhole mud motor and a longitudinal axis of a bearing mandrel of the downhole mud motor; and (b) with the downhole mud motor positioned in the borehole, actuating the bend adjustment assembly front the first position to a second position that provides a second deflection angle between the longitudinal axis of the driveshaft housing and the longitudinal axis of the bearing mandrel, the second deflection angle being different from the first deflection angle;

wherein (b) comprises:

(b1) pumping drilling fluid into the borehole from the surface pump at a first flowrate that is less than a drilling flowrate for a first time period;

(b2) rotating a drillstring coupled to the bend adjustment assembly from a surface of the borehole for a second time period; and (b3) applying weight on bit (WOB) to the downhole mud motor while rotating the drillstring and pumping drilling fluid into the borehole from the surface pump at a second flowrate that is greater than the first flowrate for a third time period.

45. The method of claim 44, wherein (b) comprises:

(b4) shifting a locking piston of the downhole mud motor from a locked position to an unlocked position axially spaced from the locked position to permit the bend adjustment assembly to actuate between the first position and the second position;

(b5) rotating an offset housing of an actuator assembly of the bend adjustment assembly relative to an adjustment mandrel of the bend adjustment assembly to actuate the bend adjustment assembly from the first position to the second position; and (b6) shifting the locking piston from the unlocked position to the locked position to lock the bend adjustment assembly in the second position.

46. The method of claim 44, further comprising:

(c) oscillating the bearing mandrel axially in a bearing housing of the downhole mud motor in response to pumping drilling fluid into the borehole from the surface pump.

47. The method of claim 44, further comprising:

(c) with the downhole mud motor positioned in the borehole, actuating the bend adjustment assembly from the second position to a third position that provides a third deflection angle between the longitudinal axis of the driveshaft housing and the longitudinal axis of the bearing mandrel, the third deflection angle being different from the first deflection angle and the second deflection angle.

48. A method for forming a deviated borehole, comprising:

(a) providing a bend adjustment assembly of a downhole mud motor in a first position that provides a first deflection angle between a longitudinal axis of a driveshaft housing of the downhole mud motor and a longitudinal axis of a bearing mandrel of the downhole mud motor;

(b) with the downhole mud motor positioned in the borehole, actuating the bend adjustment assembly from the first position to a second position that provides a second deflection angle between the longitudinal axis of the driveshaft housing and the longitudinal axis of the bearing mandrel, the second deflection angle being different from the first deflection angle; and (c) oscillating the bearing mandrel axially in a bearing housing of the downhole mud motor in response to pumping drilling fluid into the borehole from the surface pump.

49. The method of claim 48, wherein (b) comprises:

(b1) pumping drilling fluid into the borehole from the surface pump at a first flowrate that is less than a drilling flowrate for a first time period; and (b2) following the first time period, pumping drilling fluid in the borehole from the surface pump at a second flowrate that is different than the first flowrate for a second time period.

50. The method of claim 48, wherein (b) comprises:

(b1) ceasing the pumping of drilling fluid into the borehole from the surface pump for a first time period;

(b2) rotating a drillstring coupled to the bend adjustment assembly from a surface of the borehole for a second time period; and (b3) following the second time period, pumping drilling fluid into the borehole from the surface pump at a flowrate greater than zero for a third time period.

51. The method of claim 48, wherein (b) comprises:

(b1) pumping drilling fluid into the borehole from the surface pump at a first flowrate that is less than a drilling flowrate for a first time period;

(b2) rotating a drillstring coupled to the bend adjustment assembly from a surface of the borehole for a second time period; and (b3) applying weight on bit (WOB) to the downhole mud motor while rotating the drillstring and pumping drilling fluid into the borehole from the surface pump at a second flowrate that is greater than the first flowrate for a third time period.

52. The method of claim 48, further comprising:

(d) with the downhole mud motor positioned in the borehole, actuating the bend adjustment assembly from the second position to a third position that provides a third deflection angle between the longitudinal axis of the driveshaft housing and the longitudinal axis of the bearing mandrel, the third deflection angle being different from the first deflection angle and the second deflection angle.

53. The method of claim 48, wherein (b) comprises:

(b1) shifting a locking piston of the downhole mud motor from a locked position to an unlocked position axially spaced from the locked position to permit the bend adjustment assembly to actuate between the first position and the second position;

(b2) rotating an offset housing of an actuator assembly of the bend adjustment assembly relative to an adjustment mandrel of the bend adjustment assembly to actuate the bend adjustment assembly from the first position to the second position; and (b3) shifting the locking piston from the unlocked position to the locked position to lock the bend adjustment assembly in the second position.

54. A method for forming a deviated borehole, comprising:

(a) providing a bend adjustment assembly of a downhole mud motor in a first position that provides a first deflection angle between a longitudinal axis of a driveshaft housing of the downhole mud motor and a longitudinal axis of a bearing mandrel of the downhole mud motor;

(b) with the downhole mud motor positioned in the borehole, actuating the bend adjustment assembly front the first position to a second position that provides a second deflection angle between the longitudinal axis of the driveshaft housing and the longitudinal axis of the bearing mandrel, the second deflection angle being different from the first deflection angle; and (c) with the downhole mud motor positioned in the borehole, actuating the bend adjustment assembly front the second position to a third position that provides a third deflection angle between the longitudinal axis of the driveshaft housing and the longitudinal axis of the bearing mandrel, the third deflection angle being different from the first deflection angle and the second deflection angle;

wherein (b) comprises:

(b1) pumping drilling fluid into the borehole from the surface pump at a first flowrate that is less than a drilling flowrate for a first time period; and (b2) following the first time period, pumping drilling fluid in the borehole from the surface pump at a second flowrate that is different than the first flowrate;

wherein (c) comprises:

(c1) pumping drilling fluid into the borehole from the surface pump at the first flowrate for a third time period; and (c2) following the third time period, pumping drilling fluid in the borehole from the surface pump at a third flowrate.

55. The method of claim 54, further comprising:

(d) oscillating the bearing mandrel axially in a bearing housing of the downhole mud motor in response to pumping drilling fluid into the borehole from the surface pump.

56. The method of claim 54, wherein (b) comprises:

(b4) shifting a locking piston of the downhole mud motor from a locked position to an unlocked position axially spaced from the locked position to permit the bend adjustment assembly to actuate between the first position and the second position;

(b5) rotating an offset housing of an actuator assembly of the bend adjustment assembly relative to an adjustment mandrel of the bend adjustment assembly to actuate the bend adjustment assembly from the first position to the second position; and (b6) shifting the locking piston from the unlocked position to the locked position to lock the bend adjustment assembly in the second position.

* * * * *